US009555316B2

(12) United States Patent
Imbrie et al.

(10) Patent No.: US 9,555,316 B2
(45) Date of Patent: Jan. 31, 2017

(54) ADJUSTABLE MOUNTING MEMBERS FOR SKATEBOARDS AND RELATED METHODS OF USE

(71) Applicant: ORIGINAL SKATEBOARDS, LLC, Newton, NJ (US)

(72) Inventors: Timothy Scott Imbrie, Newton, NJ (US); Joel Penkala, Sandyston, NJ (US)

(73) Assignee: Original Skateboards, LLC, Newton, NJ (US)

( * ) Notice: Subject to any disclaimer, the term of this patent is extended or adjusted under 35 U.S.C. 154(b) by 0 days.

(21) Appl. No.: 14/321,154

(22) Filed: Jul. 1, 2014

(65) Prior Publication Data

US 2015/0001817 A1 Jan. 1, 2015

Related U.S. Application Data

(60) Provisional application No. 61/841,531, filed on Jul. 1, 2013.

(51) Int. Cl.

| | |
|---|---|
| ***A63C 1/00*** | (2006.01) |
| ***A63C 17/26*** | (2006.01) |
| *A63C 17/01* | (2006.01) |

(52) U.S. Cl.

CPC ..... *A63C 17/262* (2013.01); *A63C 17/015* (2013.01); *Y10T 29/49826* (2015.01)

(58) Field of Classification Search

CPC ..... A63C 17/01; A63C 17/00; A63C 17/012; A63C 17/017; A63C 2203/40; A63C 2203/42; A63C 2203/50; A63C 2203/52; A63C 17/262; A63C 17/015

(Continued)

(56) References Cited

U.S. PATENT DOCUMENTS

| | | | |
|---|---|---|---|
| 3,075,816 | A | 1/1963 | Harris et al. |
| D222,158 | S | 10/1971 | Noches |

(Continued)

OTHER PUBLICATIONS

Written Opinion dated Nov. 25, 2014 relating to PCT International Application No. PCT/US2014/045079.

(Continued)

*Primary Examiner* — James M Dolak

(74) *Attorney, Agent, or Firm* — McCarter & English, LLP

(57) ABSTRACT

The present disclosure provides advantageous skateboard assemblies (e.g., advantageous skateboard mounting member assemblies). More particularly, the present disclosure provides advantageous adjustable mounting members/assemblies for skateboards and related methods of use. In exemplary embodiments, the present disclosure provides for adjustable, movable, slideable, rotatable, interchangeable and/or removable mounting members/assemblies for skateboards. The skateboard mounting member assemblies typically include a contoured or shaped top surface (e.g., ergonomically curved, shaped and/or contoured top surface), each contoured/shaped top surface configured and dimensioned to provide the user/rider an advantageous surface that a user/rider can position a foot (or feet) onto/over during use (e.g., a surface that a user/rider can utilize to place or position a foot directly onto/above, with the bottom side of the user's foot contacting the contoured top surface of the mounting member assembly).

11 Claims, 29 Drawing Sheets

(58) Field of Classification Search
USPC ..... 280/87.042, 87.041, 87.021
See application file for complete search history.

(56) References Cited

U.S. PATENT DOCUMENTS

| | | | | |
|---|---|---|---|---|
| 3,990,713 | A | 11/1976 | Hokanson | |
| 4,140,326 | A | 2/1979 | Huber | |
| 4,160,554 | A * | 7/1979 | Cooney | A63C 17/01 280/87.042 |
| 4,739,723 | A | 4/1988 | Plucknett | |
| 5,292,141 | A | 3/1994 | Ekedal et al. | |
| 5,310,221 | A | 5/1994 | Schmidt | |
| 5,458,351 | A | 10/1995 | Yu | |
| 5,833,252 | A | 11/1998 | Strand | |
| 5,868,408 | A * | 2/1999 | Miller | A63C 17/0046 280/11.28 |
| 5,947,495 | A * | 9/1999 | Null | A63C 17/004 280/87.01 |
| 5,975,546 | A | 11/1999 | Strand | |
| 6,145,857 | A | 11/2000 | Bernstein | |
| 6,491,310 | B1 * | 12/2002 | Work | A63C 10/14 280/14.24 |
| 6,817,622 | B2 | 11/2004 | Dodge | |
| 6,896,274 | B2 * | 5/2005 | Leslie | A63C 17/01 280/809 |
| 6,945,837 | B2 | 9/2005 | Crumrine et al. | |
| 7,172,205 | B1 * | 2/2007 | Vujtech | A63C 17/004 280/87.021 |
| 7,314,223 | B2 | 1/2008 | Lin | |
| 7,390,010 | B2 | 6/2008 | Elkington et al. | |
| 7,441,787 | B1 * | 10/2008 | Jordan | A63C 17/006 280/842 |
| 7,628,412 | B2 | 12/2009 | Colon | |
| 8,025,300 | B1 * | 9/2011 | Jordan | A63C 17/014 280/87.021 |
| 8,047,556 | B2 | 11/2011 | Jang et al. | |
| 8,104,776 | B2 | 1/2012 | Messmer et al. | |
| 8,256,779 | B1 * | 9/2012 | Johnson | A63C 17/015 280/87.01 |
| 8,485,556 | B2 * | 7/2013 | Shaheen | A63C 5/06 280/809 |
| 8,500,145 | B2 * | 8/2013 | Chen | A63C 17/0033 280/87.042 |
| 8,777,240 | B2 * | 7/2014 | Edginton | A63C 5/035 280/841 |
| 8,925,936 | B1 * | 1/2015 | Clos | A63C 17/012 280/11.27 |
| 9,132,338 | B2 * | 9/2015 | Cassidy | A63C 17/0046 |
| 9,248,365 | B2 * | 2/2016 | Cole, III | A63C 10/18 |
| 9,387,388 | B2 * | 7/2016 | King | A63C 17/12 |
| 9,403,414 | B2 * | 8/2016 | DeFerrari | B60F 3/003 |
| 2003/0075890 | A1 | 4/2003 | Jacobs | |
| 2003/0155733 | A1 | 8/2003 | Tan et al. | |
| 2006/0273550 | A1 | 12/2006 | Delago | |
| 2008/0216948 | A1 | 9/2008 | Delehanty | |
| 2009/0134551 | A1 | 5/2009 | Delehanty | |
| 2015/0238845 | A1 * | 8/2015 | Clayton | B62K 3/002 280/87.042 |

OTHER PUBLICATIONS

Website pages from http://pritchardskatedesigns.com dated Apr. 25, 2013, pp. 1-3.

* cited by examiner

ADJUSTABLE MOUNTING MEMBERS FOR SKATEBOARDS AND RELATED METHODS OF USE

CROSS-REFERENCE TO RELATED APPLICATIONS

This application claims the benefit of U.S. Provisional Application No. 61/841,531 filed Jul. 1, 2013, all of which is herein incorporated by reference in its entirety.

BACKGROUND

1. Technical Field

The present disclosure relates to skateboard assemblies (e.g., 3-D concave mounting member assemblies for skateboards) and, more particularly, to adjustable, interchangeable and/or removable mounting member assemblies for skateboards and related methods of use.

2. Background Art

In general, skateboards or the like are known. Some exemplary skateboards or the like are described/disclosed in U.S. Pat. Nos. 3,990,713; 4,140,326; 5,833,252; 5,975,546; D222,158; 6,145,857 and 8,047,556, and U.S. Pat. Pub. Nos. 2003/0155733 and 2003/0075890, the entire contents of each being hereby incorporated by reference in their entireties.

A constant need exists among skateboard end-users and/or manufacturers to develop skateboards and related accessories that are cost-effective and/or include improved features/structures.

Thus, an interest exists for improved skateboards and related accessories. These and other inefficiencies and opportunities for improvement are addressed and/or overcome by the assemblies, systems and methods of the present disclosure.

SUMMARY

The present disclosure provides advantageous skateboard assemblies (e.g., 3-D concave skateboard mounting member assemblies). More particularly, the present disclosure provides advantageous adjustable mounting member assemblies for skateboards and related methods of use.

In exemplary embodiments, the present disclosure provides for adjustable, movable, slideable, rotatable, interchangeable and/or removable mounting members/assemblies for skateboards. The skateboard mounting member assemblies typically include a contoured or shaped top surface (e.g., ergonomically curved, shaped and/or contoured top surface), each contoured/shaped top surface configured and dimensioned to provide a user/rider an advantageous surface that the user/rider can position a foot (or feet) onto/over during use (e.g., a surface that a user/rider can utilize to place or position a foot directly onto/above, with the bottom side of the user's foot contacting the contoured top surface of the mounting member assembly during use).

The present disclosure provides for a skateboard assembly including a skateboard deck having a top side and a bottom side; first and second truck assemblies mounted with respect to the bottom side of the skateboard deck; and a first adjustable mounting member assembly that includes a first adjustable mounting member having a contoured top surface, the first adjustable mounting member assembly configured and dimensioned to be mounted with respect to: (i) the top side of the skateboard deck, and (ii) the first or second truck assembly; wherein the contoured top surface of the first adjustable mounting member is configured and dimensioned to provide a user a surface that the user can utilize to place or position a foot directly onto or above, with a bottom side of the user's foot contacting the contoured top surface of the mounted first mounting member during use.

The present disclosure also provides for a skateboard mounting member assembly including a first adjustable mounting member having a contoured top surface, the first adjustable mounting member configured and dimensioned to be mounted with respect to a top side of a skateboard deck; wherein the contoured top surface of the first adjustable mounting member is configured and dimensioned to provide a user a surface that the user can utilize to place or position a foot directly onto or above, with a bottom side of the user's foot contacting the contoured top surface of the mounted first mounting member during use of the skateboard deck.

The present disclosure also provides for a skateboard mounting member assembly wherein the first adjustable mounting member is configured and dimensioned to be mounted with respect to a first or second truck assembly, the first and second truck assemblies mounted with respect to a bottom side of the skateboard deck. The present disclosure also provides for a skateboard mounting member assembly further including a second adjustable mounting member having a top surface, the second adjustable mounting member configured and dimensioned to be mounted with respect to: (i) the first adjustable mounting member, and (ii) the top side of a skateboard deck; wherein the top surface of the second adjustable mounting member is configured and dimensioned to provide a user a surface that the user can utilize to place or position a foot directly onto or above, with a bottom side of the user's foot contacting the top surface of the mounted second mounting member during use of the skateboard deck.

Any combination or permutation of embodiments is envisioned. Additional advantageous features, functions and applications of the disclosed systems and methods of the present disclosure will be apparent from the description which follows, particularly when read in conjunction with the appended figures. All references listed in this disclosure are hereby incorporated by reference in their entireties.

BRIEF DESCRIPTION OF THE DRAWINGS

Features and aspects of embodiments are described below with reference to the accompanying drawings, in which elements are not necessarily depicted to scale.

Exemplary embodiments of the present disclosure are further described with reference to the appended figures. It is to be noted that the various features, steps and combinations of features/steps described below and illustrated in the figures can be arranged and organized differently to result in embodiments which are still within the spirit and scope of the present disclosure. To assist those of ordinary skill in the art in making and using the disclosed systems, assemblies and methods, reference is made to the appended figures, wherein.

DETAILED DESCRIPTION

Figure 1:
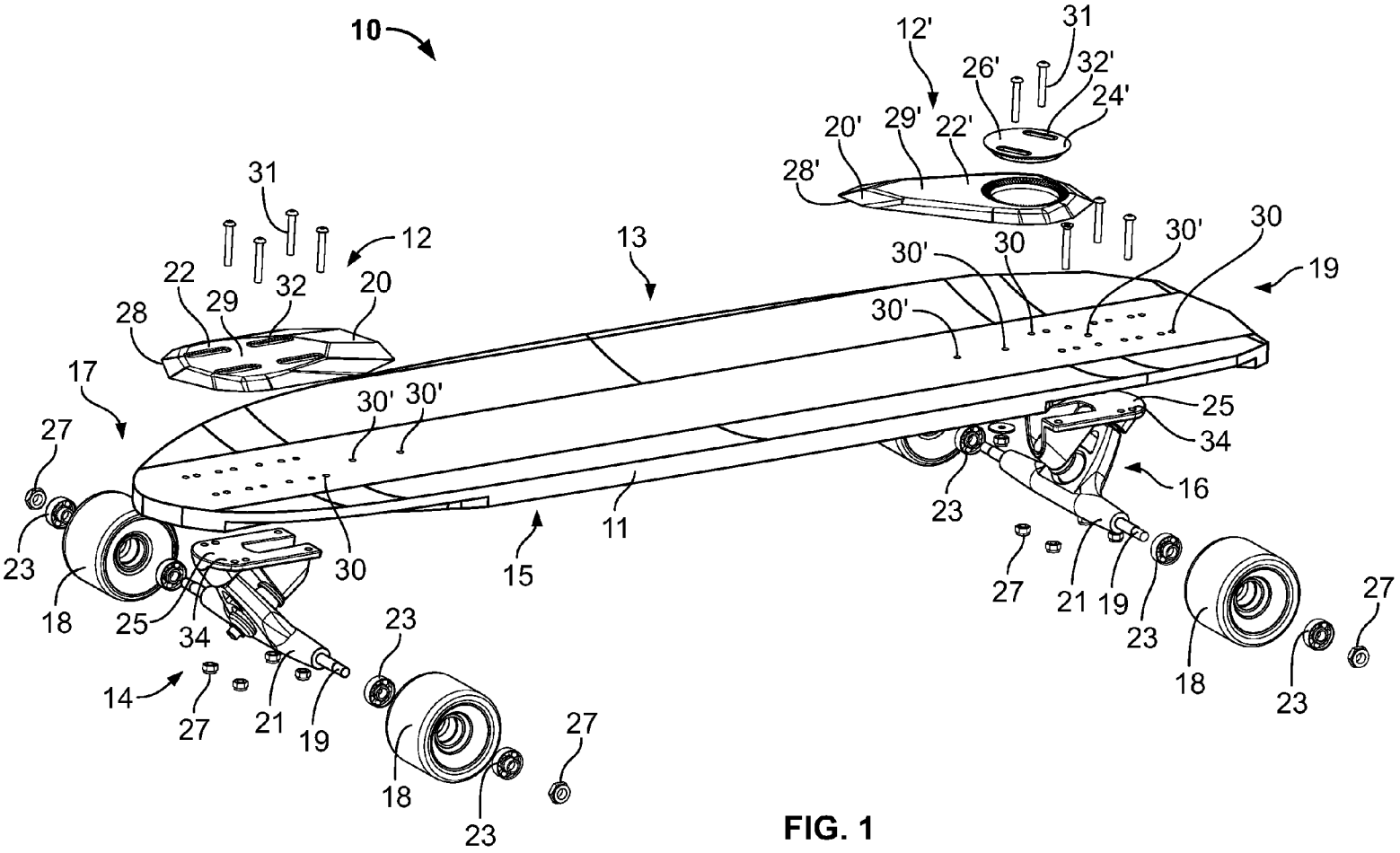
FIG. 1 is a side perspective view of an exemplary skateboard assembly according to the present disclosure, prior to exemplary mounting member assemblies being mounted thereon.

The exemplary embodiments disclosed herein are illustrative of advantageous skateboard assemblies and/or mounting member assemblies, and systems of the present disclosure and methods/techniques thereof. It should be understood, however, that the disclosed embodiments are merely exemplary of the present disclosure, which may be embodied in various forms. Therefore, details disclosed herein with reference to exemplary skateboard assemblies or mounting member assemblies or fabrication methods and associated processes or techniques of assembly and use are not to be interpreted as limiting, but merely as the basis for teaching one skilled in the art how to make and use the advantageous assemblies/systems and/or alternative assemblies/systems of the present disclosure.

The present disclosure provides improved skateboard assemblies (e.g., advantageous skateboard mounting member assemblies). More particularly, the present disclosure provides adjustable mounting member assemblies for skateboards and related methods of use.

The present disclosure provides for adjustable, movable, slideable, rotatable, interchangeable and/or removable mounting members/assemblies for skateboards. In exemplary embodiments, the skateboard mounting member assemblies include a contoured or shaped top surface (e.g., ergonomically curved, shaped and/or contoured top surface), each contoured/shaped top surface configured and dimensioned to provide the user/rider an advantageous surface that a user/rider can position a foot (or feet) onto/over during use. In general, the surface provided by the mounting member assemblies is a surface that a user/rider can utilize to place or position a foot directly onto/above, with the bottom side of the user's foot contacting the contoured top surface of the mounting member assembly during use of the skateboard assembly.

Current practice provides that some skateboard users/riders desire to have additional types of surfaces or geometries under their foot or feet while riding, other than the surfaces that are available on their skateboard. For example, some users/riders ball or bunch up grip tape or some other material or the like and place/position such material on their skateboards in an effort to provide other surfaces for use during riding. However, such practices/surfaces are inefficient, time-consuming, short-lived, non-adjustable and/or non-reproducible over time.

In exemplary embodiments, the present disclosure provides for cost-effective and adjustable, movable, slideable, rotatable, interchangeable and/or removable mounting members/assemblies for skateboards, the skateboard mounting member assemblies including a top surface (e.g., an ergonomic and/or contoured top surface), each top surface configured and dimensioned to provide a user an advantageous surface (e.g., a curved/contoured surface) that the user can position a foot onto/over during use, thereby providing a significant operational, commercial and/or manufacturing advantage as a result.

By providing such advantageous skateboards having the adjustable, movable, slideable, rotatable and/or interchangeable mounting member assemblies, users/riders can quickly and easily adjust and/or provide various surfaces/members on the skateboard for the user's foot/feet to be positioned on/over during use, as desired. In short, the advantageous mounting members assemblies of the present disclosure make it simple for a user to adjust or provide various surfaces on the skateboard for the user to utilize during use of the skateboard (e.g., so the bottom of a user's foot can contact the desired surfaces that have been adjusted or provided for by the user's use of the mounting member assemblies).

Referring now to the drawings, like parts are marked throughout the specification and drawings with the same reference numerals, respectively. Drawing figures are not necessarily to scale and in certain views, parts may have been exaggerated for purposes of clarity.

Figure 2:
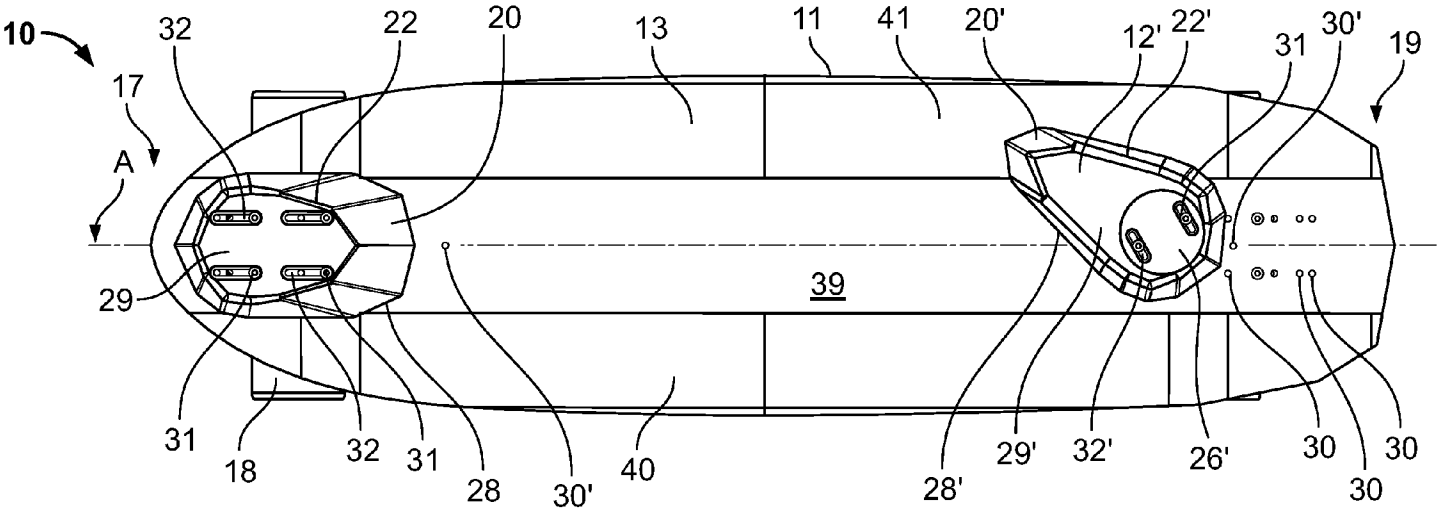
FIG. 2 is a top view of the skateboard assembly of FIG. 1, after the mounting member assemblies have been mounted thereon.
Figure 3:
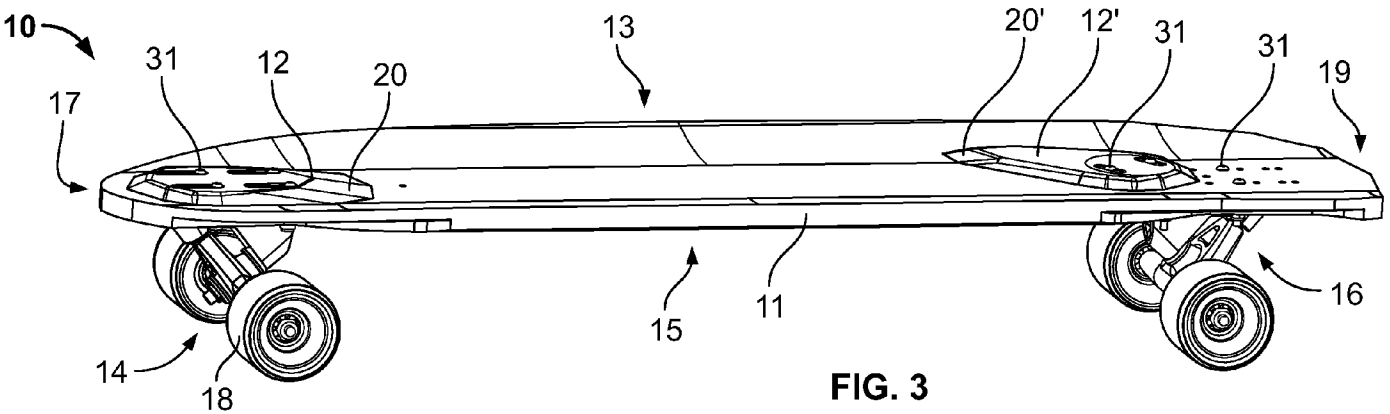
FIG. 3 is a side perspective view of the skateboard assembly of FIG. 2.

With reference to FIGS. 1-3, there is illustrated an embodiment of an exemplary skateboard assembly 10 according to the present disclosure. In general, skateboard assembly 10 is configured and dimensioned for skateboarding or riding purposes. It is noted that skateboard assembly 10 can take a variety of forms and/or designs.

In general, skateboard assembly 10 includes a skateboard deck 11, the skateboard deck 11 typically having a top side 13 and a bottom side 15, and a front end 17 and a rear end 19. Top side 13 is typically configured and adapted to receive at least a portion of the feet of a rider. Skateboard deck 11 can be fabricated from a variety of materials and/or combination of materials, such as, for example, wood or wood-based materials or the like, metal or metal-based materials or the like, and/or plastic or plastic-based materials or the like, although the present disclosure is not limited thereto. Rather, it is noted that skateboard deck 11 can be fabricated from a variety of materials and/or combination of materials, and can take a variety of shapes, styles and/or designs.

As shown in FIG. 1, skateboard assembly 10 typically includes a first (e.g., fore) truck assembly 14 and a second (e.g., aft) truck assembly 16. In exemplary embodiments, each truck assembly 14, 16 is positioned underneath and/or mounted with respect to the bottom side 15 of skateboard deck 11, as discussed further below.

In general, each truck assembly 14, 16 includes one or more wheels 18. In exemplary embodiments and as shown in FIG. 1, each truck assembly 14, 16 includes two wheels 18, although the present disclosure is not limited thereto. In certain embodiments, each truck assembly 14, 16 includes an axle 19 housed in a hanger member 21, each axle 19 rotatably mounted with respect to bearings 23. As shown in FIG. 1, a baseplate member 25 is typically mounted with respect to each hanger member 21. Securement members 27 (e.g., nuts) typically allow wheels 18 and bearings 23 to be mounted with respect to axle 19. It is noted that truck assemblies 14 and/or 16 can take/have a variety of suitable forms/configurations/members.

In general, exemplary skateboard assembly 10 includes one or more mounting member assembly 12 and/or 12'. In exemplary embodiments and as discussed further below, the mounting member assemblies 12, 12' are adjustable, movable, slideable, rotatable, interchangeable and/or removable relative to skateboard assembly 10 (e.g., relative to the top side 13 of skateboard deck 11). As discussed further below, each mounting member assembly 12, 12' generally is configured to be mounted with respect to at least a portion of the top side 13 (e.g., mounted proximally above the first or second truck assembly 14, 16; or extending on the top side 13 from the front end 17 to the rear end 19) of the skateboard deck 11 to give the user a more advantageous surface, position and/or geometry to place or position their feet on the skateboard assembly 10. It is noted that the exemplary mounting member assemblies (e.g., assemblies 12, 12') of the present disclosure can be placed/mounted above or below any gripping tape or the like that is on skateboard assembly 10 (e.g., placed/mounted above or below any gripping tape or the like that is on the top side 13 of the skateboard deck 11).

In some embodiments, board/deck 11 includes a pattern or grid or cut surface or the like (e.g., embossed printed pattern/grid, or de-bossed etched or printed pattern/grid) on the board surface (e.g., 13), with printing of the pattern/grid aligned to meaningful locations on the board 11 using numbers, measurements or corresponding shapes to highlight exactly where on the surface of the board/deck 11 the user is placing an assembly 12 or the like (e.g., relative to the truck mounting brackets 14, 16, or relative to the center of the board, or relative to some other meaningful location, etc.).

Each mounting member assembly 12, 12' typically includes at least one mounting member 22, 22' that has or defines a contoured or shaped top surface 20, 20' (e.g., an ergonomically curved, shaped and/or contoured top surface 20, 20'). In general, each contoured/shaped top surface 20, 20' is configured and dimensioned to provide a user/rider an advantageous surface 20, 20' that the user/rider can position a foot or feet onto, over and/or above during use of skateboard assembly 10. In other words, each contoured/shaped top surface 20, 20' is configured to provide a user a surface 20, 20' that the user can utilize to place or position a foot directly onto/above, with the bottom side of the user's foot contacting the contoured top surface 20, 20' of the mounting member 22, 22' during use of mounted assembly 12, 12'. In exemplary embodiments, the advantageous mounting member assemblies 12, 12' of the present disclosure make it easy for a user to adjust or provide various surfaces and/or positions/locations of surfaces (e.g., surfaces 20, 20') on the skateboard deck 11 for the user to utilize during use of the skateboard assembly 10 (e.g., so the bottom of a user's foot can contact the desired surfaces (20, 20') that have been adjusted/positioned or provided for by the user's use of the mounting member assemblies 12, 12').

In exemplary embodiments and as shown in FIGS. 1-2, mounting member assembly 12 includes an adjustable mounting member 22 having a contoured top surface 20, the mounting member assembly 12 configured and dimensioned to be mounted with respect to: (i) the top side 13 of the skateboard deck 11, and/or (ii) the first or second truck assembly 14, 16. As shown in FIGS. 1 and 2, exemplary mounting member assembly 12 is mounted with respect to first truck assembly 14. It is noted that assembly 12 can be mounted with respect to second truck assembly 16 in lieu of assembly 12' (e.g., with or without assembly 12' then being mounted with respect to first truck assembly 14). It is noted that assembly 12 can be mounted to skateboard assembly 10 utilizing holes/apertures 30, 30' that are (30) and/or are not (30') typically associated with truck assembly 14 or 16, as discussed further below.

In general, the contoured top surface 20 of the first adjustable mounting member 22 is configured and dimensioned to provide a user a surface 20 that the user can utilize to place or position a foot directly onto or above, with a bottom side of the user's foot contacting the contoured top surface 20 of the mounted mounting member 22 during use.

In exemplary embodiments and as shown in FIGS. 1-2, the contoured top surface 20 of mounting member 22 rises, slants, curves and/or slopes upwardly and/or inwardly from at least a portion of the outer edge 28 of the top surface 20, until it reaches upper section 29 of the top surface 20. In certain embodiments, the upper section 29 of top surface 20 is substantially flat or planar, although the present disclosure is not limited thereto. Rather, upper section 29 can take a variety of shapes, sizes and/or forms (e.g., curved, conical, rounded, slanted, undulating, etc.).

Similarly and as shown in FIGS. 1-2 (and as discussed further below), the contoured top surface 20' of first mounting member 22' rises, slants, curves and/or slopes upwardly and/or inwardly from at least a portion of the outer edge 28' of the top surface 20', until it reaches upper section 29' of the top surface 20'. In certain embodiments, the upper section 29' of top surface 20' is substantially flat or planar, although the present disclosure is not limited thereto. Rather, upper section 29' can take a variety of shapes, sizes and/or forms (e.g., curved, conical, rounded, slanted, undulating, etc.).

In certain embodiments and as discussed further below, mounting member assembly 12' can include a second adjustable mounting member 24' having a top surface 26'. In general, the second mounting member 24' is configured and dimensioned to be mounted with respect to: (i) the first mounting member 22', (ii) the top side 13 of skateboard deck 11, and/or (iii) the first or second truck assembly 14, 16. As shown in FIG. 2, exemplary mounting member assembly 12' is mounted with respect to second truck assembly 16, although the present disclosure is not limited thereto. Rather, it is noted that assembly 12' can be mounted with respect to first truck assembly 14 in lieu of assembly 12 (e.g., with or without assembly 12 then being mounted with respect to second truck assembly 16). Moreover, assembly 12' can be mounted to skateboard assembly 10 utilizing holes/apertures 30, 30' that are (30) and/or are not (30') typically associated with truck assembly 14 or 16, as noted below.

The top surface 26' of the second adjustable mounting member 24' is typically configured and dimensioned to provide a user a surface 26' that the user can utilize to place or position a foot directly onto or above, with a bottom side of the user's foot contacting the top surface 26' of the mounted second mounting member 24' during use of the skateboard deck 11.

In certain embodiments, top surface 26' is substantially planar, although the present disclosure is not limited thereto. Rather, top surface 26' can take a variety of shapes, sizes and/or forms (e.g., curved, conical, rounded, slanted, undulating, etc.). In certain embodiments, top surface 26' is substantially planar and/or flush with the upper section 29' of top surface 20' after the second member 24' and first member 22' are mounted with respect to one another (FIGS. 2-3). However, it is noted that top surface 26' may be below or above the upper section 29' of top surface 20' after the second member 24' and first member 22' are mounted with respect to one another.

Mounting members 22, 22', 24' (or the other exemplary mounting members of the present disclosure discussed below) can be fabricated from a variety of suitable materials or combinations of materials, such as, for example and without limitation, plastic, nylon, polymers, hard plastic, moldable materials, metals, non-metals, wood, sticky and/or "grippy" grip-friendly and/or soft materials (e.g., urethane/rubber or the like) etc., and combinations thereof. Moreover and as further discussed below, some mounting members 22, 22', 24' (or some other exemplary mounting members of the present disclosure discussed below) can be fabricated (e.g., extruded, printed, and/or 3D printed onto the board/deck 11) via an additive process or the like.

In certain embodiments, it is noted that mounting members 22, 22', 24' (or the other exemplary mounting members of the present disclosure discussed below) can be fabricated (wholly or in part) from moldable/curable materials (e.g., self-adhesive moldable materials). The moldable/curable material may take a variety of forms (e.g., single or multi-part plastic, epoxy, clay, rubber, putty, room-temperature vulcanizing silicone composition, or other curable material, which is soft, or liquid, and then hardens, which is molded by hand, or otherwise, where the desired shape of the member is created and determined by the end user, by hand molding the material, or where the user uses a previously created cavity mold or other molding tool to press the curable material into the desired shape).

Exemplary self-adhesive moldable materials are described and disclosed in U.S. Patent Pubs. Nos. 2009/

0134551 and 2008/0216948, the entire contents of each being hereby incorporated by reference in their entireties. Moreover and as discussed further below in connection with FIGS. 56-58, it is noted that exemplary moldable materials (e.g., hand-moldable and self-adhesive/curable compositions) can be utilized in conjunction with the exemplary mounting member assemblies 12 (12', 112, 212, etc.) of the present disclosure for mounting purposes (e.g., to deck 11).

As noted, mounting members 22, 22', 24' (or the other exemplary mounting members of the present disclosure discussed below) can be fabricated (wholly or in part) from moldable materials. As such, the present disclosure provides for an assembly 10 incorporating a mounting member (e.g., 22, etc.) wholly, or partially, constructed/fabricated out of a single or multi-part plastic, epoxy, clay, rubber, putty, or other curable material, which is soft, or liquid, and then hardens, which is molded by hand, or otherwise, where at least a portion of the desired shape of the mounting member is created and determined by the end user (e.g., by hand molding the material, or where the user uses a previously created cavity mold or other molding tool to press/fabricate the curable material into the desired shape), thereby allowing the user to mount the mounting member on the desired contact surface of the board/deck 11, or onto pre-existing grip tape abrasive/adhesive paper surface (e.g., on deck 11).

Moreover, it is noted that a mold having a shape and/or internal texture for wholly or partially assisting a user in the creation of a mounting member using a moldable/curable material (e.g., single or multi-part plastic, epoxy, clay, rubber, putty, or other curable material, which is soft and then hardens) can be utilized by a user. For example, the user can add the not yet cured curable/moldable material to the exemplary mold shape and then, prior to the moldable material hardening, press the mold assembly to the contact surface of the skateboard, thereby causing the contoured mounting member shape and texture to transfer to the moldable curable material, and causing the contoured mounting member to adhere mechanically to the contact surface of the skateboard or to the grip tape abrasive adhesive paper applied to that skateboard.

Furthermore, it is noted that various tools or the like can be utilized by a user when fabricating (wholly or partially) the mounting member from a moldable/curable material. For example, a tool having a rolling/pressing surface/structure (e.g., a rolling barrel, rolling pin, cylinder, sphere or other rolling or pressing shaped object or a thin bendable thin paper like surface, where at least one object surface has geometric shapes, grids, lines, reversed readable text, or other extrusions, indentations or textures designed to transfer the impression of those shapes, grids, lines, text, extrusions, indentations or textures to the surface of the mounting member) can be utilized to fabricate the mounting member from the moldable/curable material.

In certain embodiments, the mounting member assemblies 12, 12' (or the other exemplary mounting member assemblies of the present disclosure discussed below) can be mounted with respect to one or more of the apertures/holes 30 (e.g., one to four apertures 30) typically associated with the truck mounting patterns 14, 16 of the skateboard assembly 10, although the present disclosure is not limited thereto. Rather, it is noted that assemblies 12, 12' (or the other exemplary mounting member assemblies of the present disclosure discussed below) can be mounted with respect to skateboard assembly 10 by utilizing other apertures or holes 30' or the like in skateboard assembly 10 (e.g., by utilizing apertures/holes 30' in deck 11 that are typically not associated with the truck mounting patterns 14, 16), and not just mounted via the one or more of the apertures/holes 30 associated with the truck mounting patterns 14, 16 of assembly 10. For example, the exemplary mounting member assemblies (e.g., 12, 12') of the present disclosure can be mounted with respect to assembly 10 by utilizing one or more holes 30, or by utilizing one or more holes 30', or by utilizing a combination of holes 30 and 30', as discussed further below. In exemplary embodiments and as shown in FIG. 2, one or more of the apertures/holes 30' in deck 11 that are typically not associated with the truck mounting patterns 14, 16 are positioned substantially along the central longitudinal axis A of skateboard deck 11, although the present disclosure is not limited thereto. Rather, apertures 30' may be positioned at any suitable location on deck 11.

In exemplary embodiments, mounting member assemblies 12, 12' are mounted with respect to skateboard assembly 10 with one or more fasteners or fastener members 31 (e.g., bolts or screws 31). In one embodiment and as shown in FIGS. 1 and 2, mounting member assembly 12 is mounted with respect to the top side 13 and to the first truck assembly 14 by utilizing four fasteners 31 (e.g., buttonhead fasteners). The top surface 20 (e.g., the upper section 29 of the top surface 20) of mounting member 22 includes four elongated slots 32 (e.g., substantially vertically oriented slots 32). Each slot 32 is configured and dimensioned to allow one or more fasteners 31 to extend through the elongated slot 32 and through mounting member 22 of assembly 12. It is noted that mounting member 22 may include any suitable number of slots 32 (e.g., one slot 32, two slots 32, multiple slots 32—see FIGS. 4A-4B, discussed below).

In exemplary embodiments, each fastener 31 extends through each slot 32, and then through an aperture 30 (e.g., the apertures 30 associated with the mounting pattern of first truck assembly 14) in deck 11, and then through an aperture 34 of baseplate member 25 of first truck assembly 14. Securement members 27 (e.g., nuts) can be utilized to secure the distal end of the fasteners 31 to thereby mount assembly 12 with respect to the top side 13 and with respect to the first truck assembly 14 (FIG. 2).

It is noted that member 22 can be mounted with respect to assembly 10 by utilizing any number of fasteners 31 (e.g., one, two, three, four fasteners 31, etc.). For example, member 22 can be mounted to assembly 10 by utilizing one fastener 31 in one slot 32. In another example, two of the four slots 32 may include a fastener 31 inserted therethrough during the mounting process. In another example, three of the slots 32 may each include one fastener 31 inserted therethrough, and the fourth slot 32 may have two or more fasteners 31 inserted therethrough. It is to be appreciated that member 22 can be mounted to assembly 10 utilizing a variety of combinations of fasteners 31 in the various slots 32.

Moreover, it is to be appreciated that member 22 of assembly 12 can be mounted with respect to deck 11 (and to assembly 14 in some embodiments) utilizing any suitable combination of apertures 30 and/or 30' (and corresponding fasteners 31). For example, assembly 12 can be mounted with respect to deck 11 by first moving the un-mounted assembly 12 towards the front end 17 of deck 11 so that the assembly 12 is positioned over the next forward set of apertures 30 towards the front end 17. In another example, assembly 12 can be mounted with respect to deck 11 by first moving the un-mounted assembly 12 towards the rear end 19 of deck 11 so that the assembly 12 is positioned over the next rearward set of apertures 30 towards the rear end 19. In yet another example, assembly 12 can be mounted with respect to deck 11 by moving/rotating the un-mounted assembly so that at least one slot 32 is positioned over an aperture 30' for mounting purposes via at least one fastener 31. In such an embodiment, it is noted that none or at least one other slot 32 may be positioned over an aperture 30 and/or 30' for mounting purposes via fasteners. In this regard and in certain embodiments, assembly 12 may be mounted with respect to deck 11 (via at least one fastener 31) and not to assembly 14 or 16.

Furthermore and as noted above, assembly 12 can be mounted with respect to second truck assembly 16 in lieu of assembly 12' (e.g., with or without assembly 12' then being mounted with respect to first truck assembly 14). In a related example, assembly 12 can be mounted with respect to deck 11 (and to assembly 16 in some embodiments) by moving/rotating the un-mounted assembly 12 so that at least one slot 32 is positioned over a rear end 19 side aperture 30 and/or 30' on deck 11 (e.g., an aperture 30, 30' that is positioned at the rear end 19 side of deck 11) for mounting purposes via at least one fastener 31.

Thus, it is to be appreciated that advantageous assembly 12 provides users with a very wide range of mounting positions, locations and/or geometries on assembly 10.

After assembly 12 has been mounted with respect to deck 11 (and to assembly 14 or 16 in some embodiments), the user/rider may further adjust/move the position of the previously mounted assembly 12 by first loosening (e.g., slightly loosening) the fasteners 31 utilized to mount the assembly 12. The user/rider can then move/slide the member 22 forwards (e.g., towards the front end 17) or backwards (e.g., towards the rear end 19) relative to deck 11, with each loosened fastener 31 allowing the member 22 to travel forward or backward via its respective slot 32, and while each fastener 31 is still extending through each aperture 34, through each aperture 30 or 30', and/or through each slot 32. After the assembly 12 has moved to its new desired position, the user then can re-tighten the fasteners 31 to thereby re-mount assembly 12 with respect to deck 11. In other embodiments, it is noted that the user may wish to remove the fasteners 31 from the apertures 34 and/or 30, 30' (and possibly from the slots 32) before sliding/moving the assembly 12 forwards or backwards (relative to deck 11) to its desired position before re-tightening the fasteners 31 after the assembly 12 has moved to its new desired position.

For example and with reference to FIG. 2, a user could loosen each fastener 31 and then move/slide the mounting member 22 rearwards towards the rear end 19 until each of the four fasteners 31 were positioned proximal to the forward end of each slot 32, as opposed to being positioned proximal to the rearward end of each slot 32 as is depicted in FIG. 2. The user could then re-tighten the fasteners 31 to thereby re-mount assembly 12 with respect to deck 11. With reference to FIG. 2 again, it is noted that the user could move/position the member 22 towards the rear end 19 with the fasteners 31 being positioned at a variety of positions between being positioned proximal to the rearward end of each slot 32 and positioned proximal to the forward end of each slot 32 (e.g., the fasteners 31 could be positioned in the substantial center of each elongated slot 32). It is also noted that the user can loosen the fasteners 31 and remove assembly 12 from the deck 11 without re-mounting it, or can replace it with other exemplary mounting member assemblies of the present disclosure (e.g., members 12', or 12A-12B, discussed below).

Thus, it is again to be appreciated that advantageous assembly 12 provides users with a very wide range of mounting positions, locations and/or geometries on assembly 10.

Figure 4B:
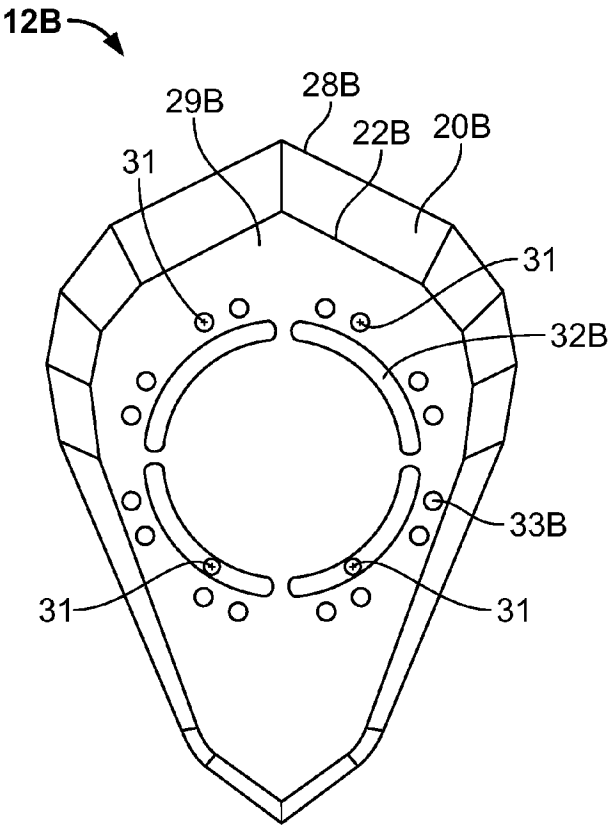
FIGS. 4A-4B depict exemplary mounting member assemblies according to the present disclosure.
Figure 4A:
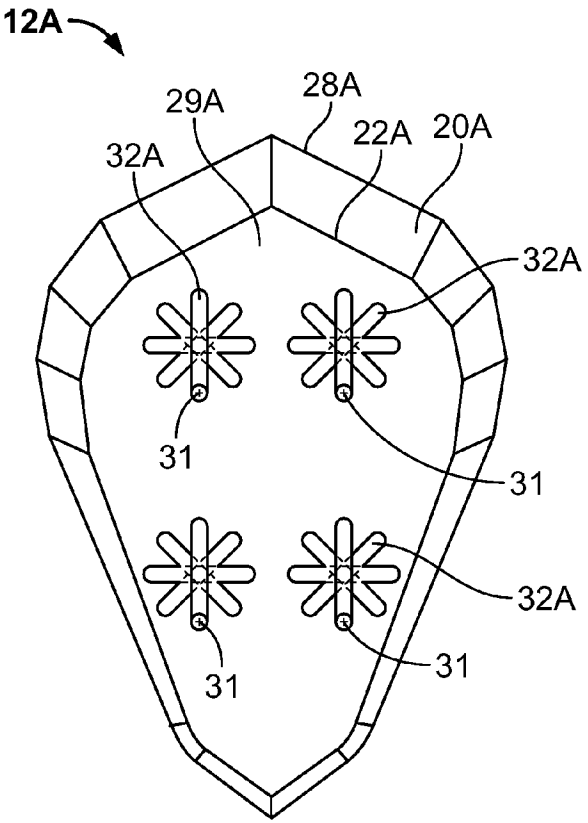

FIGS. 4A-4B depict some other exemplary mounting member assemblies 12A and 12B that may be mounted with respect to skateboard assembly 10 (e.g., in lieu of and/or in addition to assembly 12 and/or 12').

More specifically, FIGS. 4A-4B depict mounting member assemblies 12A through 12B, each assembly 12A-12B including an adjustable mounting member 22A-22B having a contoured top surface 20A-20B, respectively. In general, mounting member assemblies 12A-12B are each configured and dimensioned to be mounted with respect to: (i) at least a portion of the top side 13 of the skateboard deck 11, and/or (ii) the first or second truck assembly 14, 16. Similar to assembly 12 discussed above, it is noted that assemblies 12A and 12B can be mounted to skateboard assembly 10 utilizing holes/apertures 30, 30' that are (30) and/or are not (30') typically associated with truck assembly 14 or 16.

In general, each contoured/shaped top surface 20A-20B is configured and dimensioned to provide a user/rider an advantageous surface 20A-20B that the user/rider can position a foot or feet onto, over and/or above during use of skateboard assembly 10. In other words, the bottom side of the user's foot typically contacts the contoured top surface 20A-20B of the mounting member 22A-22B during use. In exemplary embodiments, the advantageous mounting member assemblies 12A-12B of the present disclosure make it simple for a user to adjust or provide various surfaces and/or positions/locations of surfaces (e.g., surfaces 20A-20B) on the skateboard deck 11 for the user to utilize during use of the skateboard assembly 10 (e.g., so the bottom of a usees foot can contact the desired surfaces (20A-20B) that have been adjusted/positioned or provided for by the user's use of the mounting member assemblies 12A-12B, respectively).

In exemplary embodiments and as shown in FIGS. 4A-4B, the contoured top surface 20A-20B of each mounting member 22A-22B rises, slants, curves and/or slopes upwardly and/or inwardly from at least a portion of the outer edge 28A-28B of the top surface 20A-20B, until it reaches upper section 29A-29B of the top surface 20A-20B, respectively. In certain embodiments, the upper section 29A-29B of each top surface 20A-20B is substantially flat or planar, although the present disclosure is not limited thereto. Rather, each upper section 29A-29B can take a variety of shapes, sizes and/or forms (e.g., curved, conical, rounded, slanted, undulating, etc.). It is noted that mounting members 22A-22B can be fabricated from a variety of suitable materials or combinations of materials, such as, for example and without limitation, plastic, nylon, polymers, hard plastic, metals, non-metals, or wood or the like.

In exemplary embodiments and as noted above, the mounting member assemblies 12A-12B can be mounted with respect to one or more of the apertures/holes 30 typically associated with the truck mounting patterns 14, 16 of the skateboard assembly 10, although the present disclosure is not limited thereto. Rather, it is noted that assemblies 12A-12B can be mounted with respect to skateboard assembly 10 by utilizing other apertures or holes 30' or the like in skateboard assembly 10, and not just mounted via the one or more of the apertures/holes 30 associated with the truck mounting patterns 14, 16. For example, the exemplary mounting member assemblies 12A-12B can be mounted with respect to assembly 10 by utilizing one or more holes 30, or by utilizing one or more holes 30', or by utilizing a combination of holes 30 and 30'.

Mounting member assemblies 12A-12B are typically mounted with respect to assembly 10 with one or more fasteners 31 (and one or more holes 30 or 30'). For example and similar to assembly 12 discussed above, each fastener 31 extends through each assembly 12A-12B (e.g., via slots 32B or holes 33B, as discussed below), and then through an aperture 30 and/or 30' in deck 11, and then optionally through an aperture 34 of baseplate member 25 of truck assembly 14 or 16. Securement members 27 can be utilized to secure the fasteners 31 to then thereby mount each assembly 12A-12B with respect to the top side 13 of deck 11 (and to assembly 14 or 16 in some embodiments). It is noted that each member 12A-12B can be mounted with respect to assembly 10 by utilizing any number of fasteners 31 (and members 27).

Moreover and similar to assembly 12 discussed above, it is to be appreciated that each assembly 12A-12B can be mounted with respect to deck 11 (and to assembly 14 or 16 in some embodiments) utilizing any suitable combination of apertures 30 and/or 30' (and corresponding fasteners 31). In this regard and in certain embodiments, each assembly 12A-12B may be mounted with respect to deck 11 (via at least one fastener 31) and not to assembly 14 or 16. In other embodiments, however, each assembly 12A-12B may be mounted with respect to truck assembly 14 or 16. Thus, it is to be appreciated that each advantageous assembly 12A-12B provides users with a very wide range of mounting positions, locations and/or geometries on assembly 10.

After each assembly 12A-12B has been mounted with respect to deck 11 (and to assembly 14 or 16 in some embodiments), the user/rider may further adjust/move the position of the previously mounted assembly 12A-12B by first loosening the fasteners 31 utilized to mount the assembly 12A-12B. The user/rider can then move and/or slide each assembly 12A-12B to its desired position on deck 11 and relative to at least one aperture 30, 30' (e.g., with at least one slot 32A or at least one hole 33B being positioned over at least one aperture 30 or 30' on deck 11). After the assembly 12A-12B has moved to its new desired position, the user then can re-tighten the fasteners 31 to thereby re-mount assembly 12A-12B with respect to deck 11. It is also noted that the user can loosen the fasteners 31 and remove assembly 12A-12B from the deck 11 without re-mounting it, or can replace it with other exemplary mounting member assemblies of the present disclosure. Thus, it is again to be appreciated that each advantageous assembly 12A-12B provides users with a very wide range of mounting positions, locations and/or geometries on assembly 10.

FIG. 4A depicts a mounting member assembly 12A having a mounting member 22A that has a plurality of elongated slots 32A that intersect one another, with each group of intersecting slots 32A (e.g., four groups of intersecting slots shown in FIG. 4A) having a substantially horizontally oriented slot 32A, a substantially vertically oriented slot 32A and two substantially angled slots 32A, with each slot 32A extending through member 22A. Member 22A allows for one to a plurality fasteners 31 (e.g., four fasteners 31) to be inserted through slots 32A for mounting purposes with assembly 10. It is noted that a user may move the assembly 12A on deck 11 to align the desired positions of the slots 32A/fasteners 31 of member 22A with the desired apertures 30 or 30' of deck 11 for mounting and alignment purposes of assembly 12A.

It is noted that member 22A can include any number of slots 32A (e.g., one, two, four, six, a plurality, etc.), and the slots 32A can be positioned on various locations on member 22A. As such, member 22A may include any suitable number and/or arrangement of slots 32A (e.g., substantially vertically, angled or horizontally oriented slots 32A, and the slots may or may not intersect one another).

FIG. 4B depicts a mounting member assembly 12B having a mounting member 22B that has a plurality of elongated slots 32B (e.g., substantially arcing or arcuate slots 32D) and a plurality of holes 33B extending through member 22B. As such, member 22B allows for one to a plurality fasteners 31 to be inserted through slots 32B and/or holes 33B for mounting purposes with assembly 10. It is noted that a user may move the assembly 12B (e.g., forwards, backwards, sideways or rotationally) on deck 11 to align the desired positions of the slots 32B/holes 33B/fasteners 31 of member 22B with the desired apertures 30 or 30' of deck 11 for mounting and alignment purposes of assembly 12B. Member 22B may only include slots 32B, or may only include holes 33B, or a combination of both.

It is noted that member 22B can include any number of holes 33B (e.g., one, two, four, six, a plurality, etc.), and the holes can be positioned on various locations on member 22B. As such, member 22B may include any suitable number and/or arrangement of holes 33B. Moreover, it is also noted that member 22B can include any number of slots 32B (e.g., one, two, four, six, a plurality, etc.), and the slots 32B can be positioned on various locations on member 22B. As such, member 22B may include any suitable number and/or arrangement of slots 32B (e.g., substantially arcuate/arcing, vertically, angled or horizontally oriented slots 32B, and the slots may or may not intersect one another).

With reference again to FIGS. 1-3, and also with reference to FIGS. 5-8, it is again noted that mounting member assembly 12' can include a second (adjustable) mounting member 24' having a top surface 26', and the second mounting member 24' may be configured and dimensioned to be mounted with respect to: (i) the first (adjustable) mounting member 22', (ii) at least a portion of the top side 13 of skateboard deck 11, and/or (iii) the first or second truck assembly 14, 16. Moreover, exemplary top surface 26' may be substantially planar and/or flush with the upper section 29' of top surface 20' after second member 24' and first member 22' are mounted with respect to one another (FIGS. 2-3 and 6). However, it is again noted that top surface 26' may be below or above the upper section 29' of top surface 20' after the second member 24' and first member 22' are mounted with respect to one another.

Figure 5:
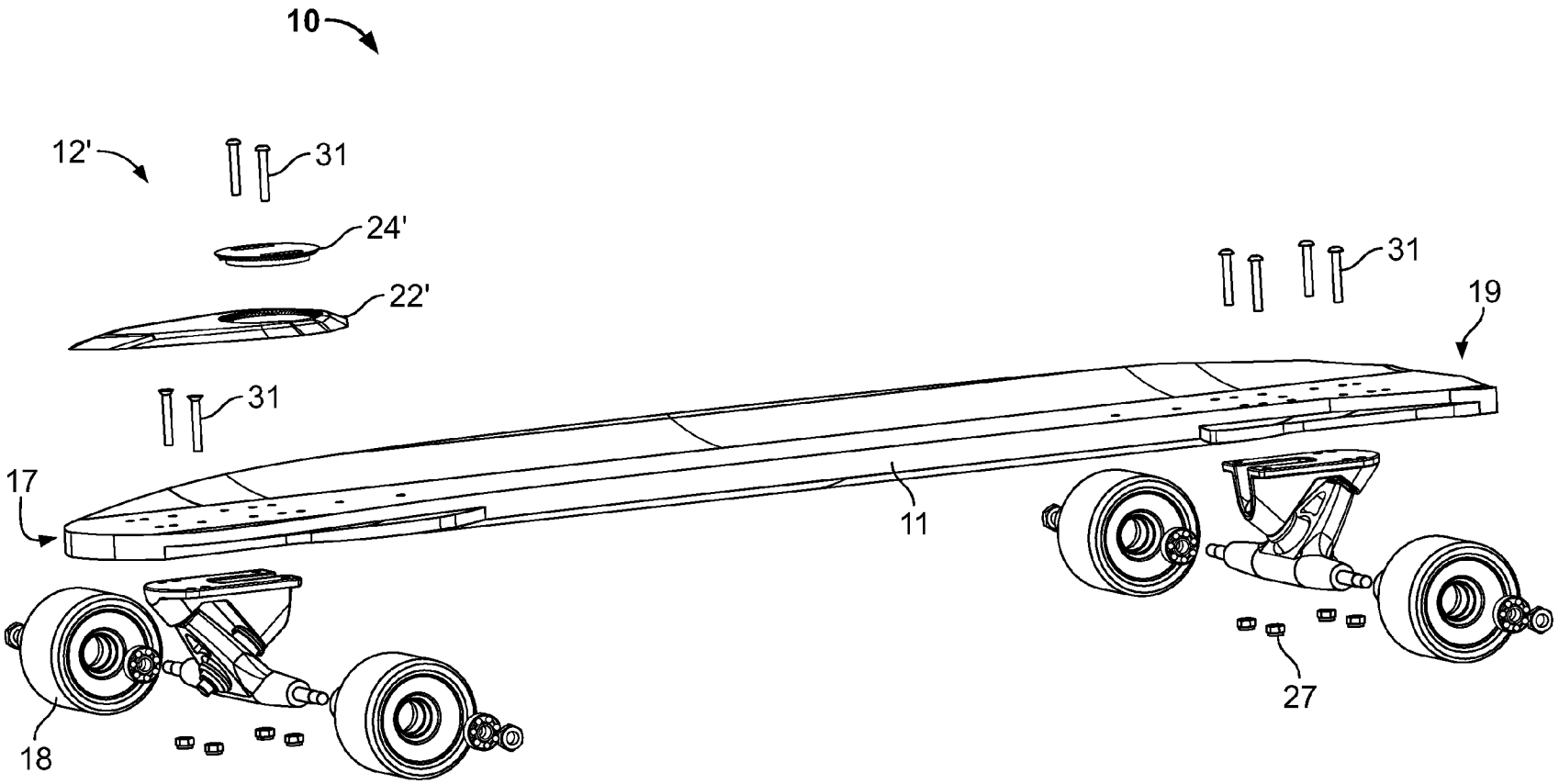
FIG. 5 is a side perspective view of an exemplary skateboard assembly according to the present disclosure, prior to an exemplary mounting member assembly being mounted thereon.
Figure 6:
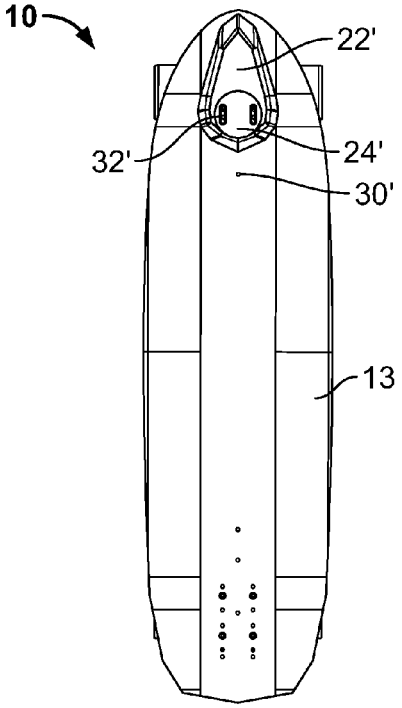
FIG. 6 is a top view of the skateboard assembly of FIG. 5, after assembly.
Figure 8:
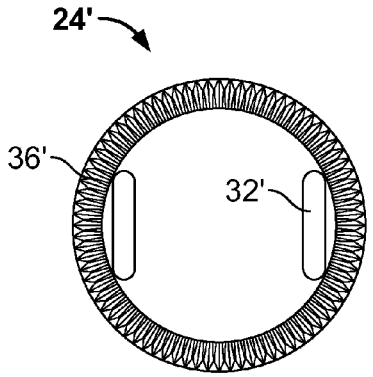
FIG. 8 is a bottom view of a second mounting member of the assembly of FIG. 7.

As noted, assembly 12' can be mounted (via fasteners 31 and nuts 27) with respect to assembly 10 (and assembly 14 or 16 in some embodiments) by utilizing one or more holes 30, or by utilizing one or more holes 30', or by utilizing a combination of holes 30 and 30', as is shown in FIG. 5. In one embodiment, assembly 12' is mounted with respect to deck 11 and truck assembly 16 by utilizing one hole 30 and one hole 30', and via one fastener member 31 through each hole 30, 30', respectively (e.g., buttonhead fastener members 31). It is noted that a washer member can be utilized in conjunction with the fastener member 31 that extends through hole 30' for securement purposes (or with any other fastener members 31 of the present disclosure). The fastener member 31' that extends through deck 11 and truck assembly 16 (and not assembly 12'), and that is positioned underneath assembly 12' after assembly 12' is mounted to deck 11 can be a flushmount or flushhead fastener member 31' or the like. It is noted that a wide variety of combinations of buttonhead members 31, flushhead members 31', and other fastener members 31 can be utilized with the exemplary mounting member assemblies of the present disclosure (e.g., as desired by the user/rider).

In exemplary embodiments and as shown in FIGS. 1-3, the central longitudinal section 39 of deck 11 (FIG. 2) can be substantially planar or flat, although the present disclosure is not limited thereto. The side sections 40, 41 of the deck can angle, slope or arc upwards relative to the central section 39 (e.g., from about 1° to about 60° relative to section 39). In other embodiments, the side sections 40, 41 can be substantially flat or angled differently. It is noted that when side sections 40, 41 angle upwardly relative to section 39, the exemplary mounting members of the present disclosure (e.g., first mounting member 22' as shown in FIG. 2-3) can be fabricated from a substantially flexible material that allows the portion of the member 22' that is positioned over the curved side section 41 to flex and bend to conform to or against the angled section 41 (or 40) over which it is placed when a user/rider has positioned the user's foot/weight over the member 22' (e.g., member 22' acquiesces to the weight of the rider and bends/flexes to conform to the curved/angled section 41 (interfaces with the plane of contact of the curved section 41) over which it is placed).

Figure 7:
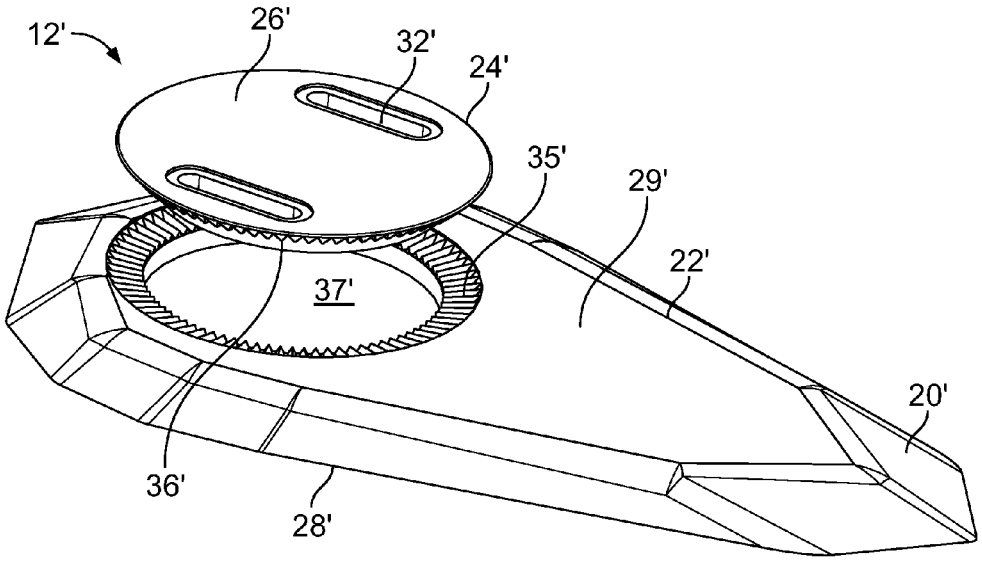
FIG. 7 is an exploded side perspective view of an exemplary mounting member assembly according to the present disclosure.

The top surface 26' of second mounting member 24' can include one or more elongated slots 32' (e.g., two elongated slots 32' shown in FIGS. 1 and 7). Similarly to as described above, each slot 32' is configured to allow one or more fasteners to extend therethrough and through assembly 12' for mounting purposes. As shown in FIGS. 1 and 7, first mounting member 22' of assembly 12' can include an aperture 37' that allows fasteners 31 to extend therethrough. It is to be appreciated that member 24' (and member 22') can be mounted to assembly 10 utilizing a variety of combinations of fasteners 31 in the various slots 32'. Moreover and as similarly discussed above in conjunction with assembly 12, it is to be appreciated that advantageous assembly 12' provides users with a very wide range of mounting positions, locations and/or geometries on assembly 10 (e.g., by utilizing various holes 30, 30', and/or by sliding/moving assembly 12' via slots 32', and/or by moving/rotating assembly 12' to various different positions on assembly 10). Furthermore, after assembly 12' has been mounted to deck 11, the user may further adjust/move its position by loosening the fastenings 31 and moving it as desired, and as discussed above relative to assembly 12.

In exemplary embodiments, members 22' and 24' include mating locking teeth 35' and 36', respectively. Locking teeth 35' and 36' lockingly engage one another when at least one fastener 31 is secured through assembly 12' (e.g., through member 24') and to assembly 10, thereby preventing first mounting member 22' from moving (e.g., from rotationally moving).

When the at least one fastener 31 is loosened or unsecured (e.g., slightly loosened/unsecured from assembly 10), the locking teeth 36' of member 24' can be disengaged from the locking teeth 35' of member 22' (e.g., by raising member 24' above member 22' slightly), thereby allowing member 22' (or member 24') to rotate 360° relative to top side 13 of deck 11 for desired alignment/mounting purposes on assembly 10. It is noted that a user may move the assembly 12' on deck 11 to align the desired positions of the slots 32' of member 24' with the desired apertures 30 or 30' of deck 11 for mounting and alignment purposes of assembly 12'. Moreover, a user may move (e.g., rotate 360° relative to top side 13 of deck 11) member 22' for desired mounting and alignment purposes of member 22'/assembly 12', when the locking teeth 35', 36' are not engaged with one another, as noted above. In exemplary embodiments, loosening the at least one secured fastener 31 allows a user to rotate member 22' without removing the at least one fastener 31 from the assembly 10 (and/or from assembly 14 or 16).

In another embodiment and as shown in FIGS. 5-6, the assembly 12' can be mounted proximal to the front end 17 of deck 11, and mounted with respect to first truck assembly 14. From this mounted position as shown in FIG. 6, a user could then move (e.g., rotate 360° relative to top side 13 of deck 11) member 22' for desired mounting and alignment purposes of member 22'/assembly 12', when the locking teeth 35', 36' are not engaged with one another. A user could also move the assembly 12' on deck 11 to align the desired positions of the slots 32' of member 24' with the desired apertures 30 or 30' of deck 11 for mounting and alignment purposes of assembly 12' (e.g., mount to assembly 14 or 16, or just via apertures 30'). Again, multiple mounting variations are possible, as desired by the user.

In another embodiment and as shown in FIGS. 9-12, skateboard assembly 10 can include mounting member assembly 112 mounted proximal to the front end 17 of the deck, and mounting member assembly 212 mounted proximal to the rear end 19 of the deck 11 (e.g., mounted via holes 30 and/or 30', and fasteners 31).

Mounting member assembly 112 can include a second mounting member 124 having a top surface 126, the second mounting member 124 configured to be mounted with respect to: (i) the first adjustable mounting member 122, (ii) the top side 13 of skateboard deck 11, and/or (iii) the first or second truck assembly 14, 16.

The contoured top surfaces 120, 220 of the mounting members 122, 222 are configured and dimensioned to provide a user a surface 120 and/or 220 that the user can utilize to place or position a foot directly onto or above, with a bottom side of the user's foot contacting the contoured top surface 120 or 220 of the mounted mounting member 122 or 222 during use. Similarly as discussed above, the contoured top surfaces 120, 220 rise, slant, curve and/or slope upwardly/inwardly from at least a portion of the outer edge 128, 228 of the top surface 120, 220, respectively, until it reaches upper section 129, 229 of the top surface 120, 220, respectively.

Figure 9:
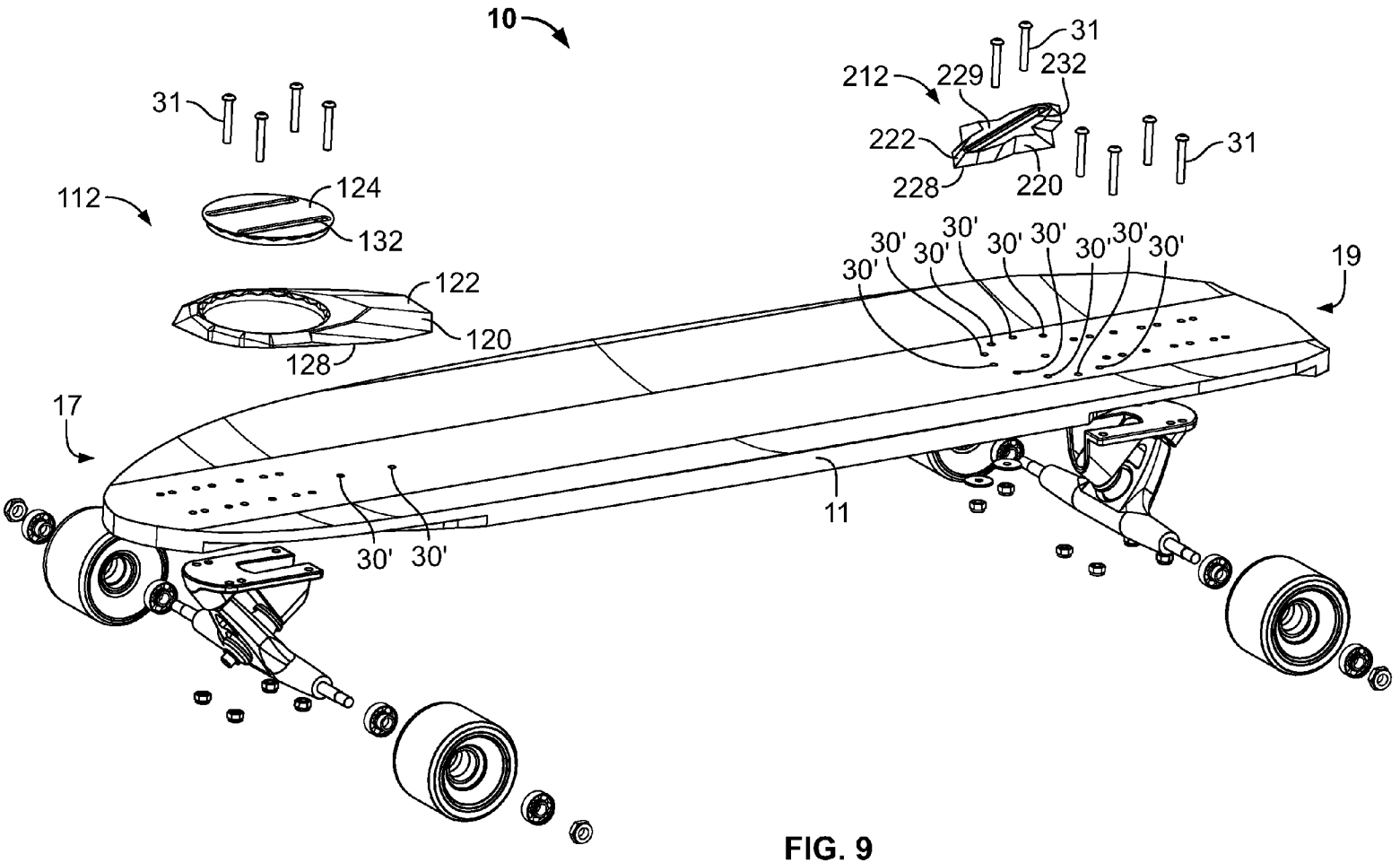
FIG. 9 is a side perspective view of another exemplary skateboard assembly according to the present disclosure, prior to exemplary mounting member assemblies being mounted thereon.
Figure 10:
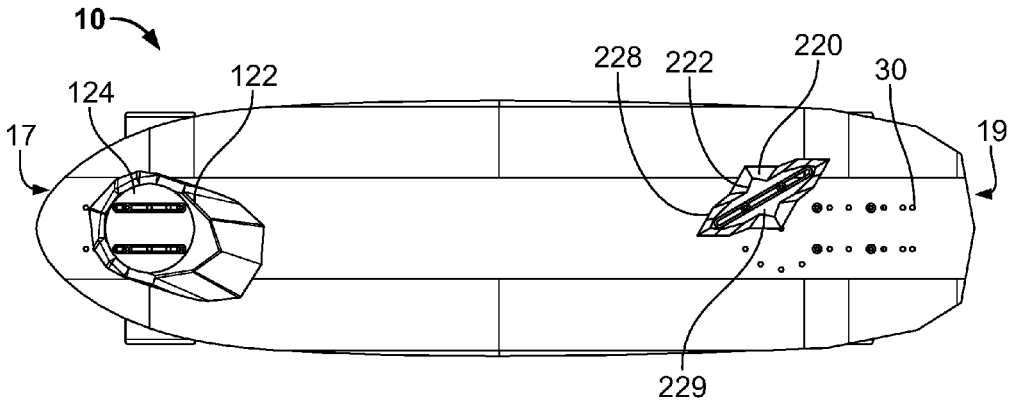
FIG. 10 is a top view of the skateboard assembly of FIG. 9, after the mounting member assemblies have been mounted thereon.
Figure 11:
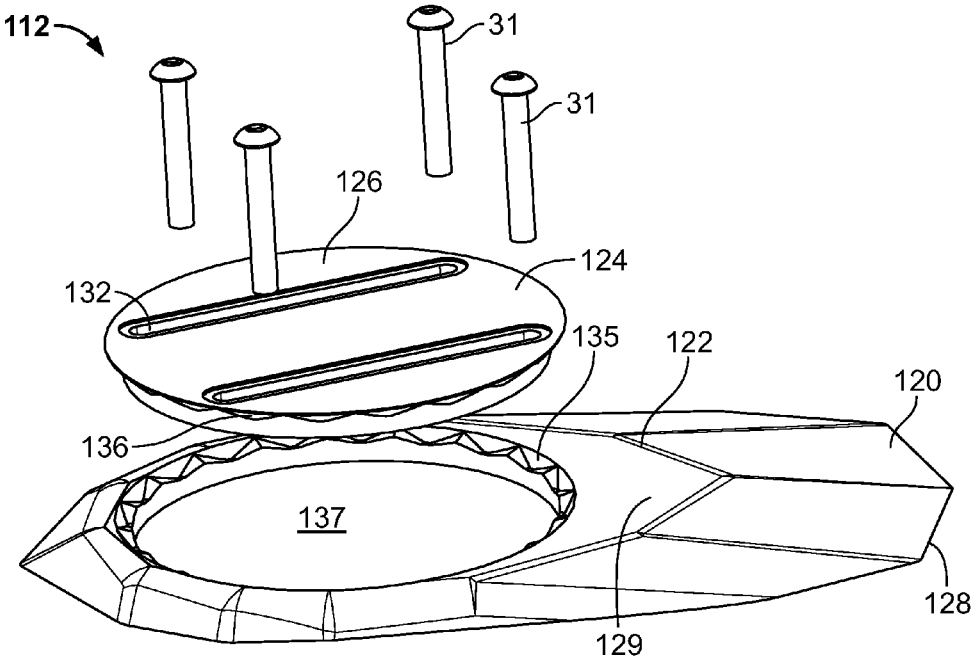
FIG. 11 is an exploded side perspective view of an exemplary mounting member assembly.
Figure 12:
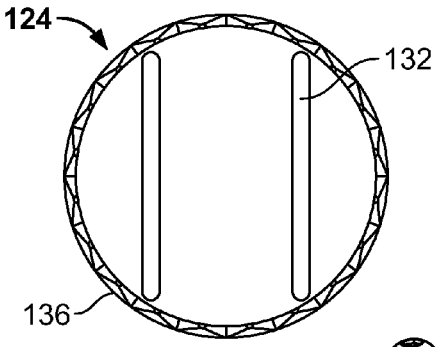
FIG. 12 is a bottom view of the second mounting member of the assembly of FIG. 11.

Assembly 112 (and assembly 212) can be mounted (via fasteners 31, nuts 27) with respect to assembly 10 (and assembly 14 or 16 in some embodiments) by utilizing one or more holes 30, or by utilizing one or more holes 30', or by utilizing a combination of holes 30 and 30', as is shown in FIGS. 9-10.

The top surface 126 of second mounting member 124 includes one or more elongated slots 132. Similarly to as described above, each slot 132 is configured to allow one or more fasteners 31 to extend therethrough and through assembly 112 for mounting purposes.

Similarly, mounting member 222 includes one or more elongated slots 232. Each slot 232 is configured to allow one or more fasteners 31 to extend therethrough and through assembly 212 for mounting purposes.

First mounting member 122 of assembly 112 can include an aperture 137 that allows fasteners 31 to extend therethrough. Member 124 (and member 122) and/or member 222 can be mounted to assembly 10 utilizing a variety of combinations of fasteners 31 in the various slots 132, 232. Advantageous assemblies 112, 212 provide users with a very wide range of mounting positions, locations and/or geometries on assembly 10 (e.g., by utilizing various holes 30, 30', and/or by sliding/moving assembly 112, 212 via slots 132, 232, and/or by moving/rotating assembly 112, 212 to various different positions on assembly 10). Furthermore, after assembly 112, 212 has been mounted to deck 11, the user may further adjust/move its position by loosening the fastenings 31 and moving it as desired, and as discussed above relative to assembly 12 or 12'.

Members 122 and 124 include mating locking teeth 135 and 136, respectively. Locking teeth 135 and 136 lockingly engage one another when at least one fastener 31 is secured through assembly 112 (e.g., through member 124) and to assembly 10, thereby preventing first mounting member 122 from moving (e.g., from rotationally moving). When the at least one fastener 31 is loosened or un-secured, the locking teeth 136 of member 124 can be disengaged from the locking teeth 135 of member 122 (e.g., by raising member 124 above member 122 slightly), thereby allowing member 122 (or member 124) to rotate 360° relative to top side 13 of deck 11 for desired alignment/mounting purposes on assembly 10. A user may move the assembly 112 or 212 on deck 11 to align the desired positions of the slots 132, 232 with the desired apertures 30 or 30' of deck 11 for mounting and alignment purposes of assembly 112 or 212. As similarly noted above, multiple mounting variations of assembly 112 or 212 are possible on assembly 10, as desired by the user.

Figure 13:
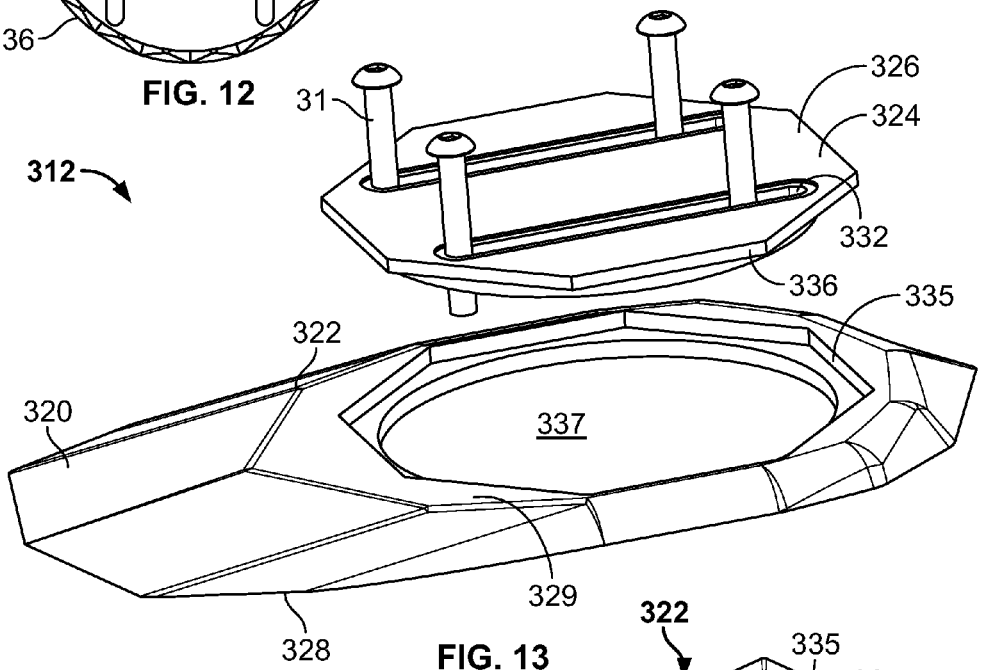
FIG. 13 is an exploded side perspective view of another exemplary mounting member assembly.
Figure 14:
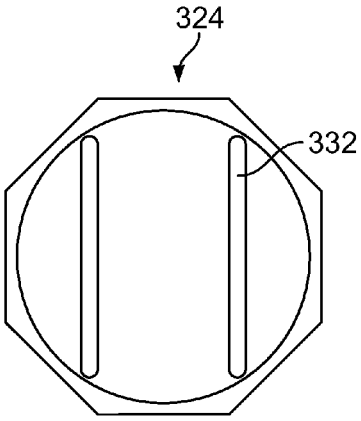
FIG. 14 is a bottom view of the second mounting member of the assembly of FIG. 13.
Figure 15:
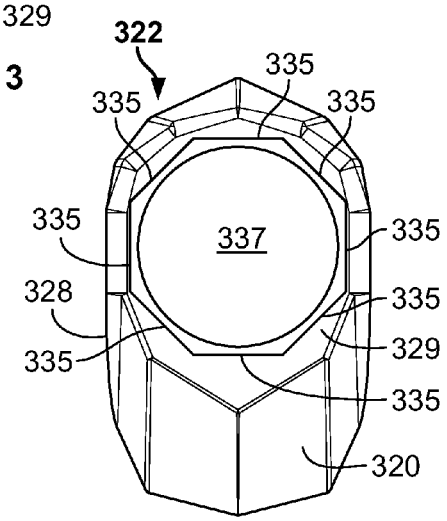
FIG. 15 is a top view of the first mounting member of the assembly of FIG. 13.
Figure 16:
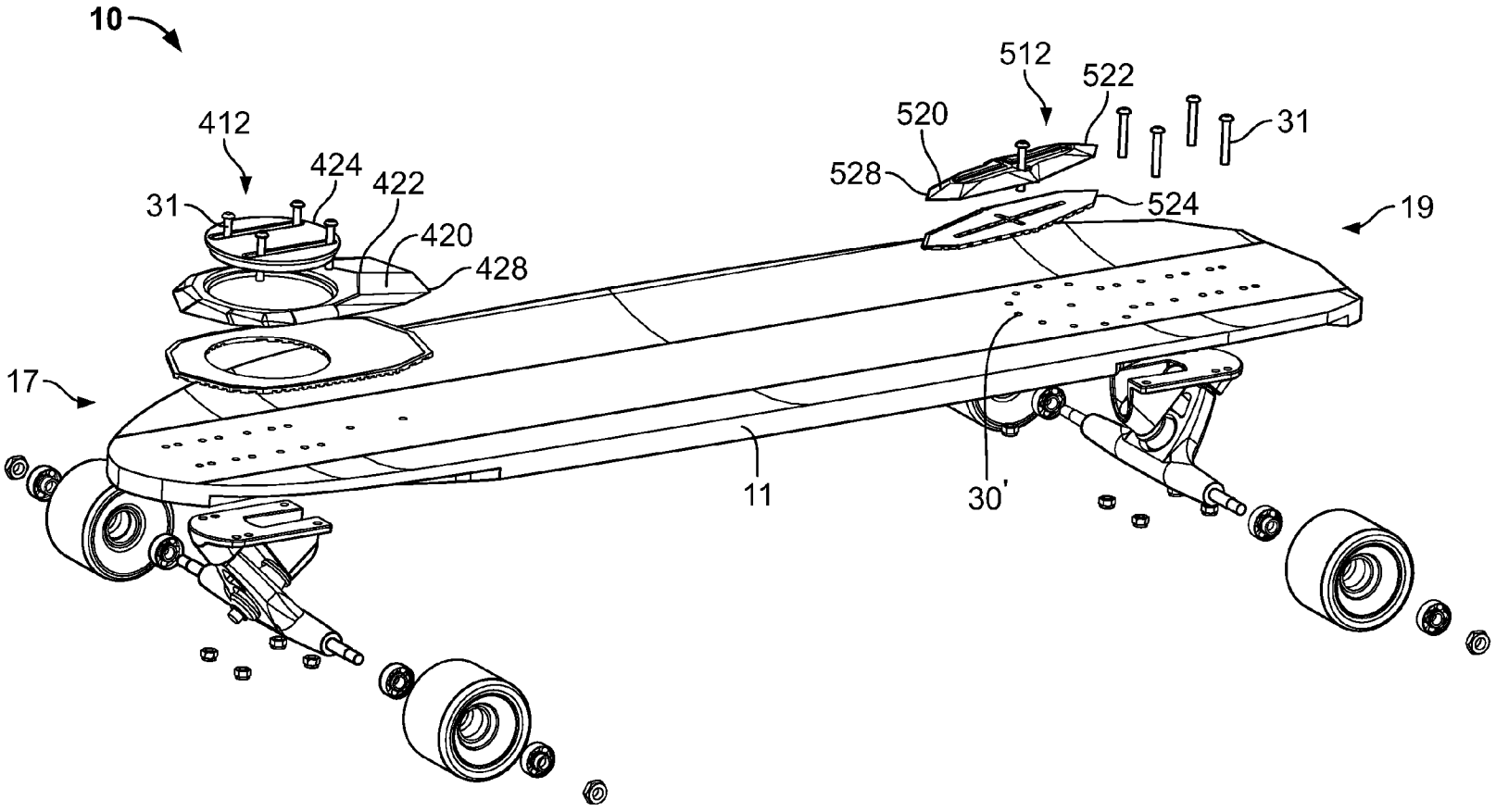
FIG. 16 is a side perspective view of an exemplary skateboard assembly according to the present disclosure, prior to exemplary mounting member assemblies being mounted thereon.
Figure 17:
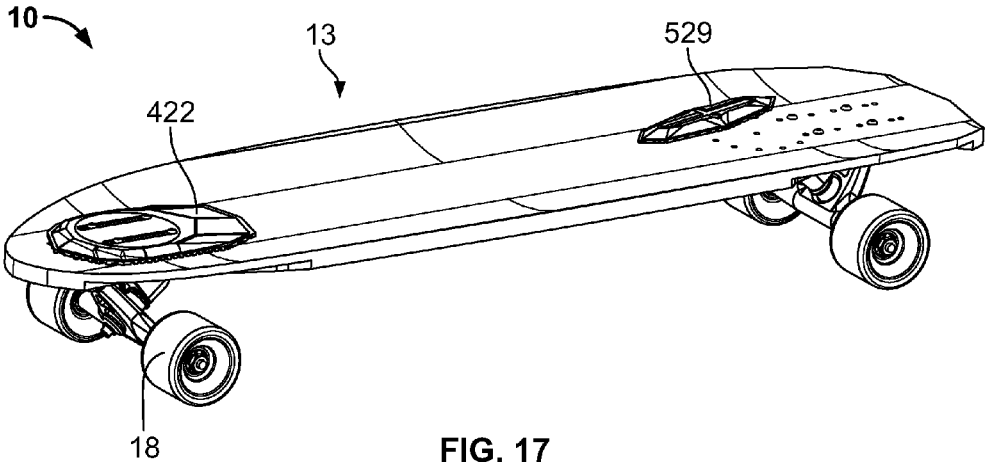
FIG. 17 is a side perspective view of the assemblies of FIG. 16 after assembly.
Figure 18:
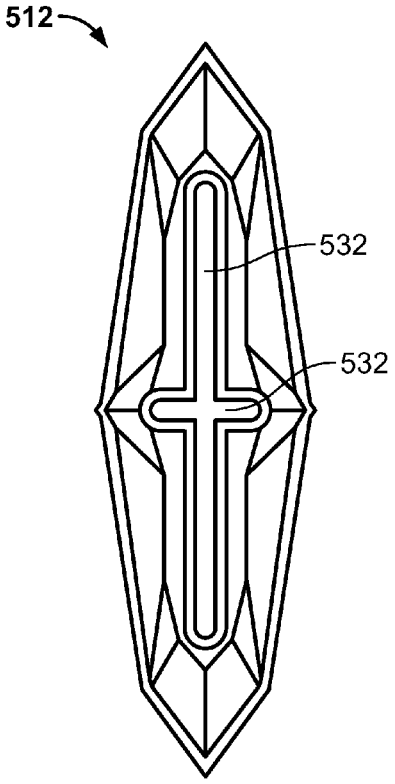
FIG. 18 is a top view of an assembly of FIG. 17.
Figure 19:
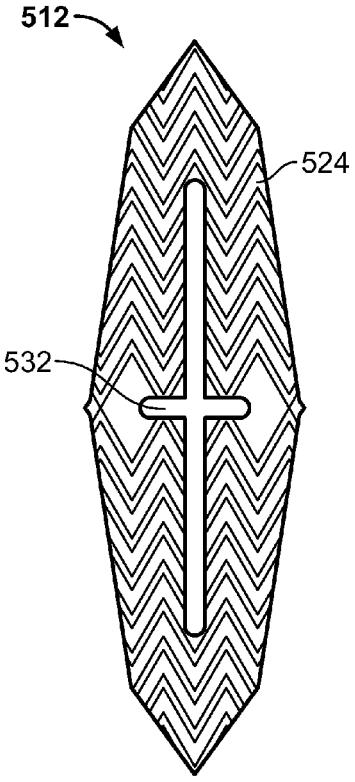
FIG. 19 is a bottom view of the assembly of FIG. 18.
Figure 20:
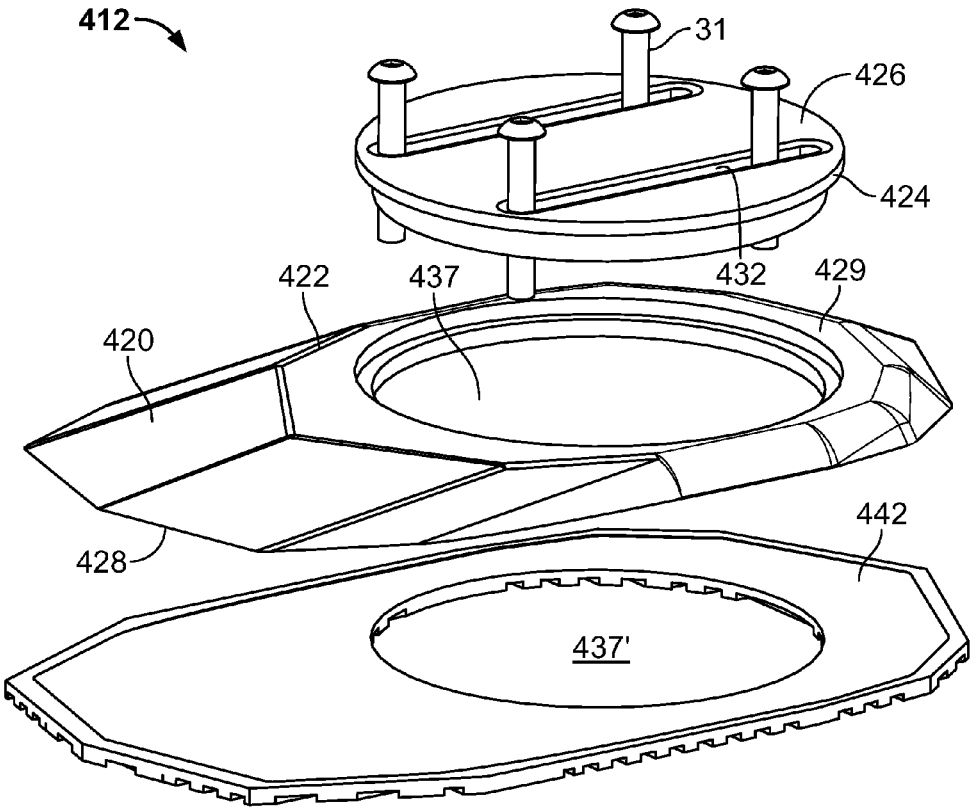
FIG. 20 is an exploded side perspective view of another exemplary mounting member assembly of the present disclosure.
Figure 21:
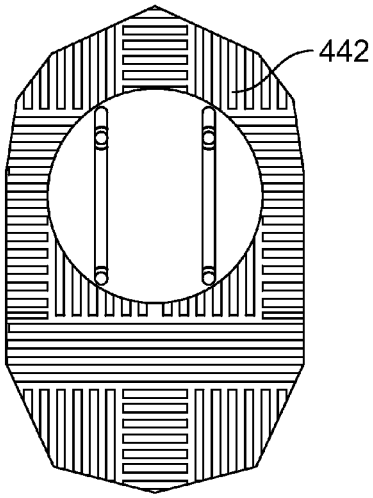
FIG. 21 is a bottom view of the assembly of FIG. 20.

In another embodiment and as shown in FIGS. 13-15, skateboard assembly 10 can include mounting member assembly 312 mounted thereon (e.g., mounted via holes 30 and/or 30', and fasteners 31).

Mounting member assembly 312 includes a first mounting member 322, and a second mounting member 324 having a top surface 326, the second mounting member 324 configured to be mounted with respect to: (i) the first mounting member 322, (ii) the top side 13 of skateboard deck 11, and/or (iii) the first or second truck assembly 14, 16.

The contoured top surface 320 of the mounting member 322 is configured and dimensioned to provide a user a surface 320 that the user can utilize to place or position a foot directly onto or above, with a bottom side of the user's foot contacting the contoured top surface 320 during use. The contoured top surface 320 rises, slants, curves and/or slopes upwardly and/or inwardly from at least a portion of the outer edge 328 of the top surface 320, until it reaches upper section 329.

Assembly 312 can be mounted (via fasteners 31, nuts 27) with respect to assembly 10 (and assembly 14 or 16 in some embodiments) by utilizing one or more holes 30, or by utilizing one or more holes 30', or by utilizing a combination of holes 30 and 30'.

The top surface 326 of second mounting member 324 includes one or more elongated slots 332. Each slot 332 is configured to allow one or more fasteners 31 to extend therethrough and through assembly 312 for mounting purposes.

First mounting member 322 of assembly 312 can include an aperture 337 that allows fasteners 31 to extend therethrough. Member 324 (and member 322) can be mounted to assembly 10 utilizing a variety of combinations of fasteners 31 in the various slots 332. Advantageous assembly 312 provide users with a very wide range of mounting positions, locations and/or geometries on assembly 10.

Members 322 and 324 include mating locking sides 335 and 336, respectively. As such, member 322 includes a polygonal shaped section (e.g., an octagonal shaped section) having a plurality of locking sides 335. Member 324 includes a corresponding polygonal shaped section (e.g., an octagonal shaped section) having a plurality of locking sides 336. It is noted that the polygonal shaped sections of members 322, 324 can take a variety of polygonal forms/shapes/designs (e.g., hexagonal, square, rectangular, triangular, etc.).

Locking sides 335 and 336 lockingly engage one another when at least one fastener 31 is secured through assembly 312 (e.g., through member 324) and to assembly 10 (and/or when the polygonal shaped sections match up to one another), thereby preventing first mounting member 322 from moving (e.g., from rotationally moving). When the at least one fastener 31 is loosened or un-secured, the locking sides 336 of member 324 can be disengaged from the locking sides 335 of member 322 (e.g., by raising member 324 above member 322 slightly), thereby allowing member 322 (or 324) to rotate relative to top side 13 of deck 11 for desired alignment/mounting purposes on assembly 10. Also, a user may move the assembly 312 on deck 11 to align the desired positions of the slots 332 with the desired apertures 30 or 30' of deck 11 for mounting and alignment purposes of assembly 312. As such, multiple mounting variations of assembly 312 are possible on assembly 10, as desired by the user.

In another embodiment and as shown in FIGS. 16-21, skateboard assembly 10 can include mounting member assembly 412 mounted proximal to the front end 17 of the deck, and mounting member assembly 512 mounted proximal to the rear end 19 of the deck 11 (e.g., mounted via holes 30 and/or 30', and fasteners 31).

Mounting member assembly 412 can include a second mounting member 424 having a top surface 426, the second mounting member 424 configured to be mounted with respect to: (i) the first mounting member 422, (ii) the top side 13 of skateboard deck 11, and/or (iii) the first or second truck assembly 14, 16. Assembly 412 also includes a third mounting member 442, the third mounting member 442 configured to be mounted with respect to the first mounting member 422, as discussed further below.

Assembly 512 also includes a second mounting member 524, the second mounting member 524 configured to be mounted with respect to the first mounting member 522 and to the top side 13 of skateboard deck 11, as discussed further below.

The contoured top surfaces 420, 520 of the mounting members 422, 522 are configured and dimensioned to provide a user a surface 420 and/or 520 that the user can utilize to place or position a foot directly onto or above, with a bottom side of the user's foot contacting the contoured top surface 420 or 520 of the mounted mounting member 422 or 522 during use. The contoured top surfaces 420, 520 rise, slant, curve and/or slope upwardly/inwardly from at least a portion of the outer edge 428, 528 of the top surface 420, 520, respectively, until it reaches upper section 429, 529 of the top surface 420, 520, respectively. Assembly 412 (and assembly 512) can be mounted (via fasteners 31, nuts 27) with respect to assembly 10 (and assembly 14 or 16 in some embodiments) by utilizing one or more holes 30, or by utilizing one or more holes 30', or by utilizing a combination.

The top surface 426 of second mounting member 424 includes one or more elongated slots 432. Each slot 432 is configured to allow one or more fasteners 31 to extend therethrough and through assembly 412 for mounting purposes.

Similarly, mounting members 522 and 524 include one or more corresponding elongated slots 532. Each slot 532 is configured to allow one or more fasteners 31 to extend therethrough and through assembly 512 for mounting purposes.

First mounting member 422 of assembly 412 can include an aperture 437 that allows fasteners 31 to extend therethrough. Similarly, third member 442 includes an aperture 437' that allows fasteners 31 to extend therethrough.

Member 424 (and members 522, 524) can be mounted to assembly 10 utilizing a variety of combinations of fasteners 31 in the various slots 432, 532. Advantageous assemblies 412, 512 provide users with a very wide range of mounting positions, locations and/or geometries on assembly 10 (e.g., by utilizing various holes 30, 30', and/or by sliding/moving assembly 412, 512 via slots 432, 532, and/or by moving/rotating assembly 412, 512 to various different positions on assembly 10). Furthermore, after assembly 412, 512 has been mounted to deck 11, the user may further adjust/move its position by loosening the fastenings 31 and moving it as desired, and as discussed above.

In exemplary embodiments, third mounting member 442 is fabricated from a sticky and/or "grippy" grip-friendly and/or soft material (e.g., urethane/rubber or the like). In certain embodiments, member 442 is molded onto or mounted with respect to the first mounting member 422, prior to assembly 412 being mounted on assembly 10. When at least one fastener 31 is secured through assembly 412 (e.g., through member 424) and to assembly 10 to secure assembly 412 to assembly 10, the third mounting member 442 frictionally, stickingly and/or grippingly engages/contacts the top side 13 of the deck 11, thereby preventing first mounting member 422 and third mounting member 442 from moving (e.g., from rotationally moving).

When the at least one fastener 31 is loosened or unsecured, the third mounting member 442 can be frictionally, stickingly and/or grippingly disengaged from the top side 13 of the deck 11, (e.g., by raising member 442 above deck 11 slightly), thereby allowing members 422, 442 to rotate 360° relative to top side 13 of deck 11 for desired alignment/mounting purposes on assembly 10.

In exemplary embodiments, second mounting member 524 is fabricated from a sticky and/or "grippy" grip-friendly and/or soft material (e.g., urethane/rubber or the like). In certain embodiments, member 524 is molded onto or mounted with respect to the first mounting member 522, prior to assembly 512 being mounted on assembly 10. When at least one fastener 31 is secured through assembly 512 (e.g., through members 522, 524) and to assembly 10 to secure assembly 512 to assembly 10, the second mounting member 524 frictionally, stickingly and/or grippingly engages/contacts the top side 13 of the deck 11, thereby preventing members 522, 524 from moving (e.g., from rotationally moving), even when only one fastener 31 or no other locking mechanism is used to secure assembly 512 to assembly 10.

When the at least one fastener 31 is loosened or unsecured, the second member 524 can be frictionally, stickingly and/or grippingly disengaged from the top side 13 of the deck 11, thereby allowing members 522, 524 to rotate relative to top side 13 of deck 11 for desired alignment/mounting purposes on assembly 10.

Moreover, a user may move the assembly 412 or 512 on deck 11 to align the desired positions of the slots 432, 532 with the desired apertures 30 or 30' of deck 11 for mounting and alignment purposes of assembly 412 or 512. As similarly noted above, multiple mounting variations of assembly 412 or 512 are possible on assembly 10, as desired by the user.

Figure 22:
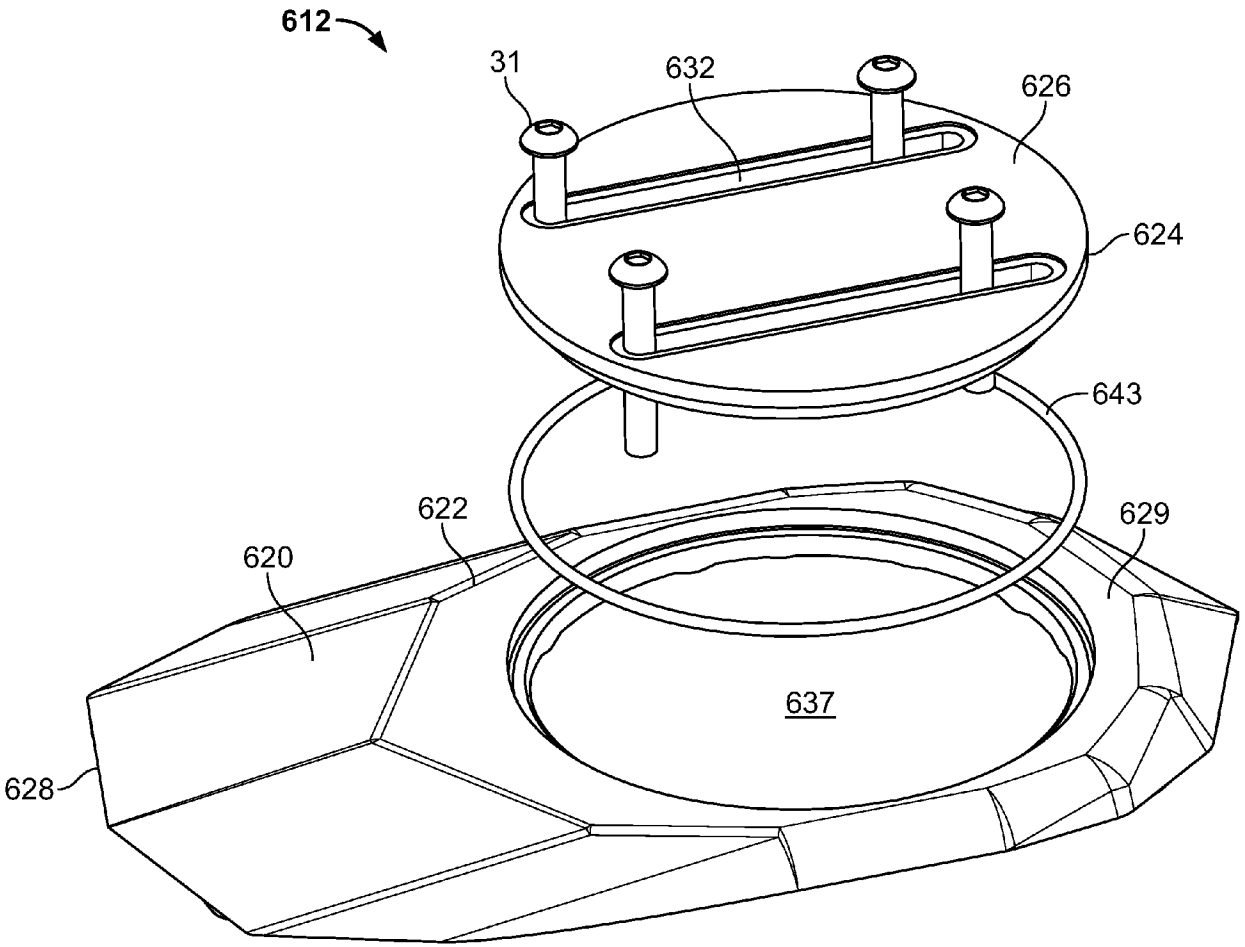
FIGS. 22-23 are side perspective views of another mounting member assembly (exploded and assembled)
Figure 23:
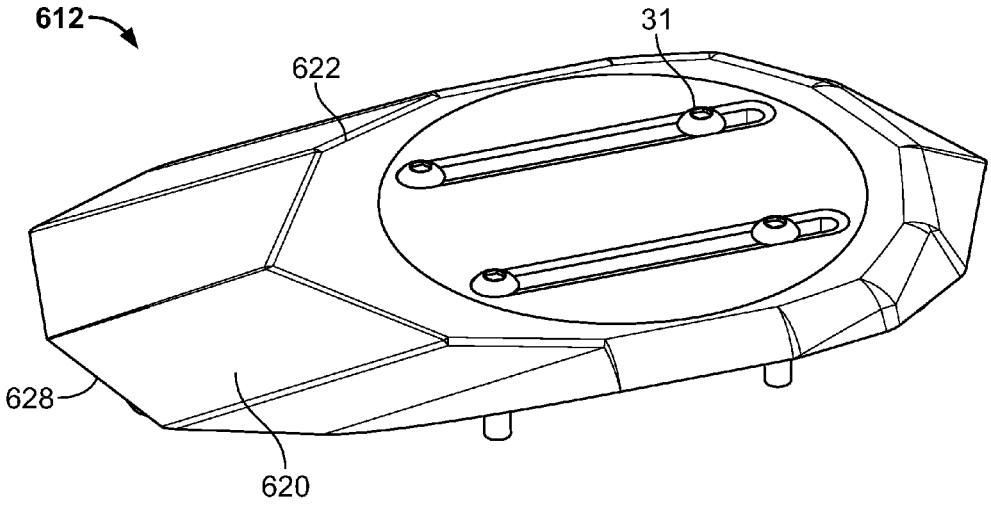
Figure 24:
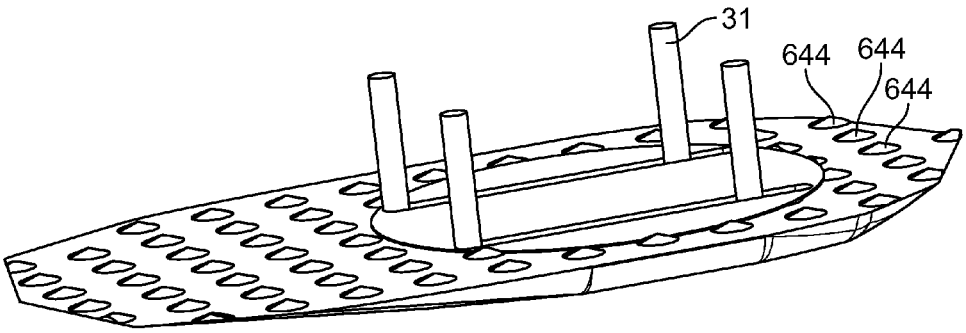
FIG. 24 is a bottom perspective view of the assembly of FIG. 23.
Figure 25:
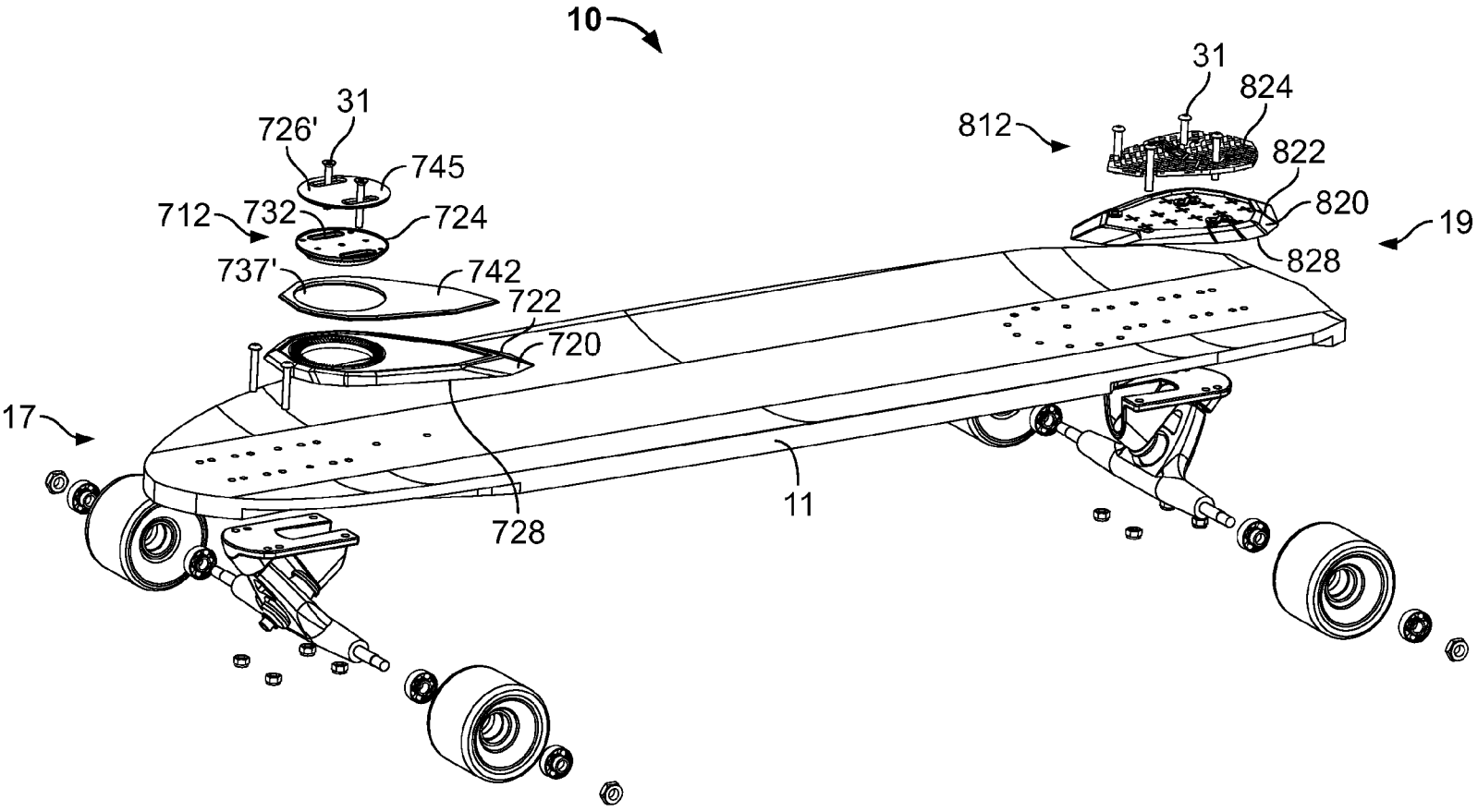
FIG. 25 is a side perspective view of an exemplary skateboard assembly according to the present disclosure, prior to exemplary mounting member assemblies being mounted thereon.
Figure 27:
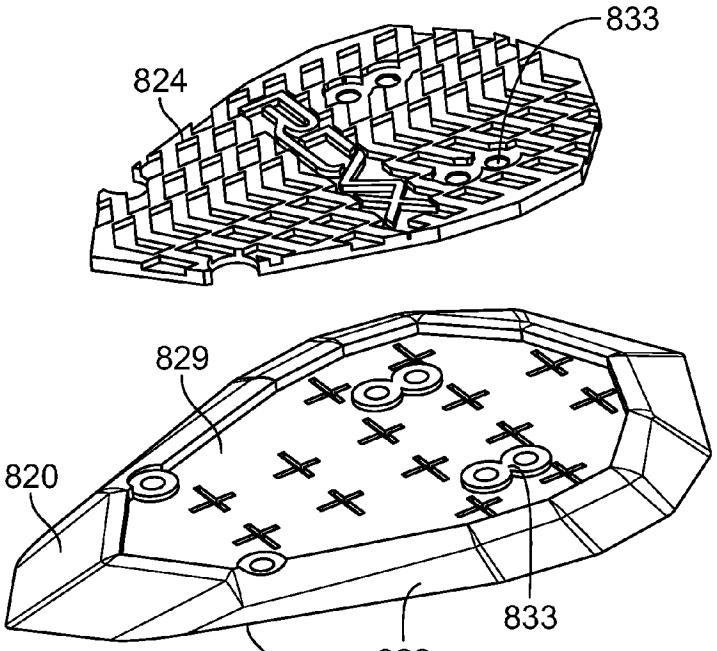
FIG. 27 is an exploded side perspective view of an assembly of FIG. 26.
Figure 26:
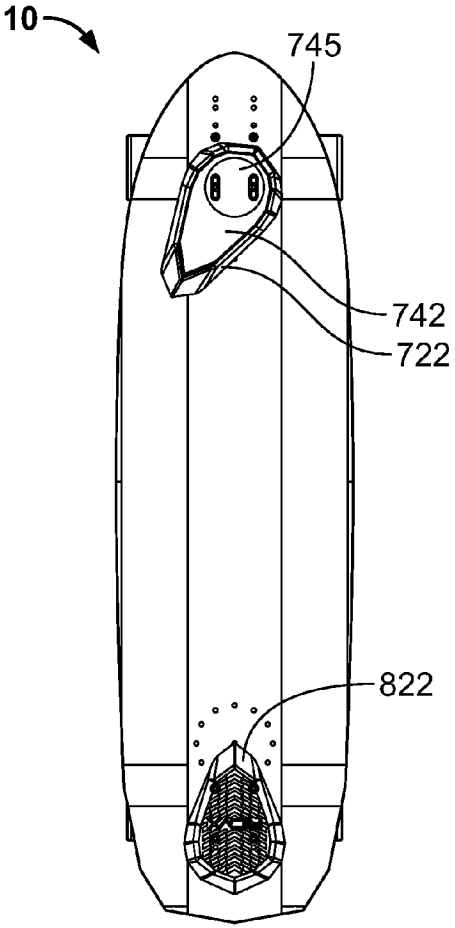
FIG. 26 is a top view of the assemblies of FIG. 25.
Figure 28:
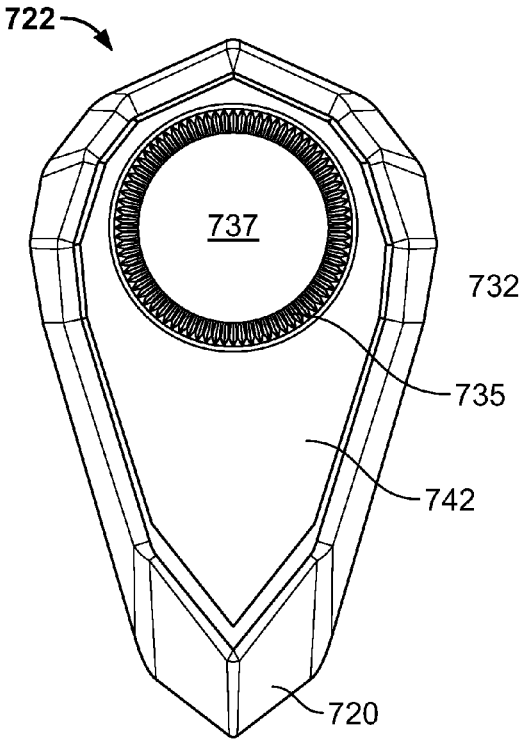
FIG. 28 is a top view of the first mounting member of an assembly of FIG. 26.
Figure 29:
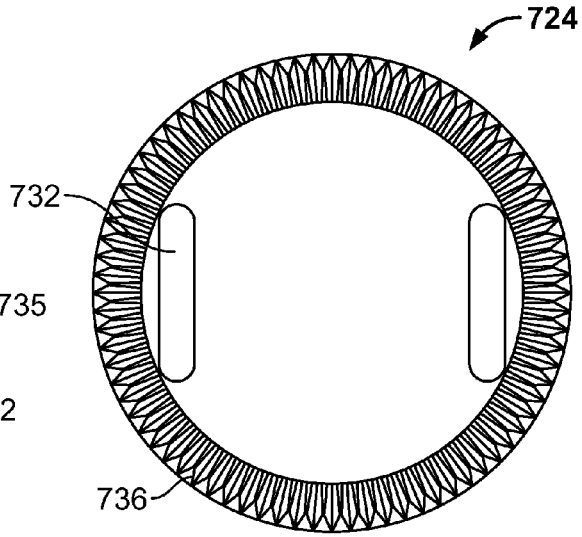
FIG. 29 is a bottom view of the second mounting member of an assembly of FIG. 26.
Figure 30:
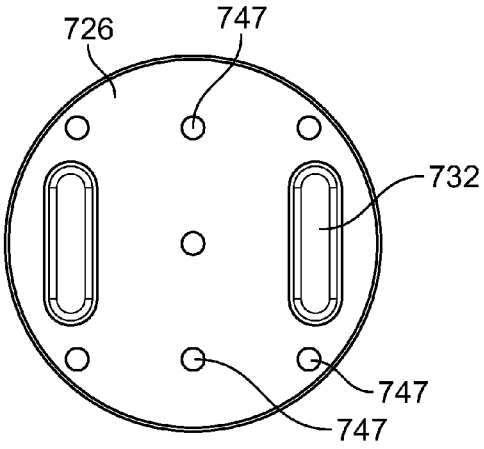
FIG. 30 is a top view of the second mounting member of FIG. 29.
Figure 31:
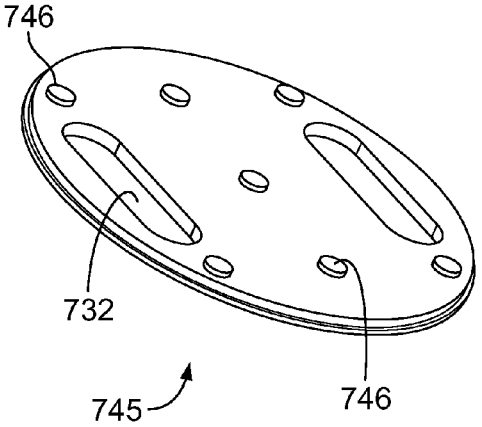
FIG. 31 is a side perspective view of the fourth mounting member of an assembly of FIG. 26.

In another embodiment and as shown in FIGS. 22-24, skateboard assembly 10 can include mounting member assembly 612 mounted thereon (e.g., mounted via holes 30 and/or 30', and fasteners 31).

Mounting member assembly 612 can include a second mounting member 624 having a top surface 626, the second mounting member 624 configured to be mounted with respect to: (i) the first mounting member 622, (ii) the top side 13 of skateboard deck 11, and/or (iii) the first or second truck assembly 14, 16. Assembly 612 also includes a gasketing member 643 (e.g., an O-ring or the like), the gasketing member 643 configured to be mounted with respect to the first and second mounting members 622, 624, as discussed further below.

The contoured top surface 620 of the mounting member 622 is configured to provide a user a surface 620 that the user can utilize to place or position a foot directly onto or above, with a bottom side of the user's foot contacting the contoured top surface 620 during use. The contoured top surface 620 rises, slants, curves and/or slopes upwardly/inwardly from at least a portion of the outer edge 628 until it reaches upper section 629.

The top surface 626 of second mounting member 624 includes one or more elongated slots 632. Each slot 632 is configured to allow one or more fasteners 31 to extend therethrough and through assembly 612 for mounting purposes. First mounting member 622 of assembly 612 can include an aperture 637 that allows fasteners 31 to extend therethrough.

Member 624 can be mounted to assembly 10 utilizing a variety of combinations of fasteners 31 in the various slots 632. Advantageous assembly 612 provides users with a very wide range of mounting positions, locations and/or geometries on assembly 10.

In exemplary embodiments, gasketing member 643 (e.g., O-ring 643) is fabricated from a sticky and/or "grippy" grip-friendly and/or soft material (e.g., urethane/rubber or the like). In certain embodiments, downward facing teeth members 644 or the like are molded into/onto or mounted with respect to the bottom of the first mounting member 622, prior to assembly 612 being mounted on assembly 10. When at least one fastener 31 is secured through assembly 612 (e.g., through member 624) and to assembly 10 to secure assembly 612 to assembly 10, then: (i) the gasketing material 643 frictionally, stickingly and/or grippingly engages/contacts the first and second members 622, 624, thereby preventing first mounting member 622 and member 643 from moving (e.g., from rotationally moving), and (ii) the teeth members 644 frictionally, stickingly and/or grippingly engage/contact the top side 13 of the deck 11, thereby preventing first mounting member 622 from moving (e.g., from rotationally moving).

When the at least one fastener 31 is loosened or unsecured, the gasketing member 643 and the teeth members 644 can be frictionally, stickingly and/or grippingly disengaged, thereby allowing member 622 (or member 624) to rotate 360° relative to top side 13 of deck 11 for desired alignment/mounting purposes on assembly 10.

Moreover, a user may move the assembly 612 on deck 11 to align the desired positions of the slots 632 with the desired apertures 30 or 30' of deck 11 for mounting and alignment purposes of assembly 612. As similarly noted above, multiple mounting variations of assembly 612 are possible on assembly 10, as desired by the user.

In another embodiment and as shown in FIGS. 25-31, skateboard assembly 10 can include mounting member assembly 712 mounted proximal to the front end 17 of the deck 11, and mounting member assembly 812 mounted proximal to the rear end 19 of the deck 11 (e.g., mounted via holes 30 and/or 30', and fasteners 31).

Mounting member assembly 712 can include a second mounting member 724 having a top surface 726, the second mounting member 724 configured to be mounted with respect to: (i) the first (adjustable) mounting member 722, (ii) the top side 13 of skateboard deck 11, and/or (iii) the first or second truck assembly 14, 16.

Mounting member assembly 712 also includes a third mounting member 742 and a fourth mounting member 745. In exemplary embodiments, members 742 and 745 are fabricated from a sticky and/or "grippy" grip-friendly and/or soft material (e.g., urethane/rubber or the like). Member 742 is configured to be mounted with respect to (e.g., overmolded on top of) the top surface of member 722. Member 745 is configured to be mounted with respect to (e.g., overmolded on top of) the top surface of member 724. It is noted that member 722 and/or 724 can also be fabricated from a sticky and/or "grippy" grip-friendly and/or soft material (e.g., urethane/rubber or the like). In certain embodiments, the bottom side of member 745 includes protruding members 746 that matingly engage with recesses 747 positioned on the top side of member 724 when assembly 712 is assembled/secured together.

Mounting member assembly 812 also includes a second mounting member 824. In exemplary embodiments, member 824 is fabricated from a sticky and/or "grippy" grip-friendly and/or soft material (e.g., urethane/rubber or the like). Member 824 is configured to be mounted with respect to (e.g., directly mounted to, positioned or overmolded on top of) the top surface 829 of member 822.

The contoured top surfaces 720, 820 (and the top surfaces of members 742 and 745 and 824) of the mounting members 722, 822 are configured and dimensioned to provide a user a surface 720 and/or 820 that the user can utilize to place or position a foot directly onto or above, with a bottom side of the user's foot contacting the contoured top surface 720 or 820 (and the top surfaces of members 742 and 745 and 824) of the mounted mounting member 722 or 822 during use. Similarly as discussed above, the contoured top surfaces 720, 820 rise, slant, curve and/or slope upwardly/inwardly from at least a portion of the outer edge 728, 828 of the top surface 720, 820, respectively, until it reaches upper section 729, 829, respectively.

Assembly 712 (and assembly 812) can be mounted (via fasteners 31, nuts 27) with respect to assembly 10 (and assembly 14 or 16 in some embodiments) by utilizing one or more holes 30, or by utilizing one or more holes 30', or by utilizing a combination of holes 30 and 30'.

The top surface 726 of second mounting member 724 and the top surface 726' of member 745 includes one or more (corresponding) elongated slots 732. Each slot 732 is configured to allow one or more fasteners 31 to extend therethrough and through assembly 712 for mounting purposes.

Mounting member 822 and member 824 includes one or more (corresponding) holes 833 extending therethrough. Each hole 833 is configured to allow one or more fasteners 31 to extend therethrough and through assembly 812 for mounting purposes.

First mounting member 722 (and member 742) of assembly 712 can include an aperture 737 (and 737') that allows fasteners 31 to extend therethrough. Member 724 (and member 722) and/or member 822 can be mounted to assembly 10 utilizing a variety of combinations of fasteners 31 in the various slots 732 or holes 833. Advantageous assemblies 712, 812 provide users with a very wide range of mounting positions, locations and/or geometries on assembly 10.

Members 722 and 724 include mating locking teeth 735 and 736, respectively. Locking teeth 735 and 736 lockingly engage one another when at least one fastener 31 is secured through assembly 712 (e.g., through member 724) and to assembly 10, thereby preventing first mounting member 722 (and member 742) from moving (e.g., from rotationally moving). When the at least one fastener 31 is loosened or un-secured, the locking teeth 736 of member 724 can be disengaged from the locking teeth 735 of member 722 (e.g., by raising member 724 above member 722 slightly), thereby allowing member 722 (or member 724) to rotate 360° relative to top side 13 of deck 11 for desired alignment/mounting purposes on assembly 10. As similarly noted above, multiple mounting variations of assembly 712 or 812 are possible on assembly 10, as desired by the user.

In another embodiment and as shown in FIGS. 32-37, skateboard assembly 10 can include mounting member assembly 912 mounted proximal to the front end 17 of the deck 11, and mounting member assembly 1012 mounted proximal to the rear end 19 of the deck 11 (e.g., mounted via holes 30 and/or 30', and fasteners 31).

Mounting member assembly 1012 includes a second mounting member 1024, the second mounting member 1024 configured to be mounted with respect to: (i) the first mounting member 1022, (ii) the top side 13 of skateboard deck 11, and/or (iii) the first or second truck assembly 14, 16.

Mounting member assembly 912 also includes a second mounting member 924. In exemplary embodiments, member 924 is fabricated from a sticky and/or "grippy" grip-friendly and/or soft material (e.g., urethane/rubber or the like). Member 924 is configured to be mounted with respect to (e.g., directly mounted to, positioned or overmolded on top of) the top surface 929 of member 922.

The contoured top surfaces 920, 1020 (and the top surface of member 924) of the mounting members 922, 1022 are configured and dimensioned to provide a user a surface 920 and/or 1020 that the user can utilize to place or position a foot directly onto or above, with a bottom side of the user's foot contacting the contoured top surface 920 or 1020 (and the top surface of members 924) of the mounted mounting member 922 or 1022 during use. Similarly as discussed above, the contoured top surfaces 920, 1020 rise, slant, curve and/or slope upwardly/inwardly from at least a portion of the outer edge 928, 1028 of the top surface 920, 1020, respectively, until it reaches upper section 929, 1029, respectively.

Assembly 912 (and assembly 1012) can be mounted (via fasteners 31, nuts 27) with respect to assembly 10 (and assembly 14 or 16 in some embodiments) by utilizing one or more holes 30, or by utilizing one or more holes 30', or by utilizing a combination of holes 30 and 30'.

The second mounting member 1024 includes one or more holes 1033, and first mounting member 1022 includes one or more elongated slots 1032. Each hole 1033 and each slot 1032 is configured to allow one or more fasteners 31 to extend therethrough and through assembly 1012 for mounting purposes.

Mounting member 922 and member 924 includes one or more (corresponding) holes 933 extending therethrough. Each hole 933 is configured to allow one or more fasteners 31 to extend therethrough and through assembly 912 for mounting purposes.

Member 1024 (and member 1022) and/or member 922 can be mounted to assembly 10 utilizing a variety of combinations of fasteners 31 in the various slots 1032 or holes 933, 1033. Advantageous assemblies 912, 1012 provide users with a very wide range of mounting positions, locations and/or geometries on assembly 10.

Members 1022 and 1024 include mating locking teeth 1035 and 1036, respectively. Locking teeth 1035 and 1036 lockingly engage one another when at least one fastener 31 is secured through assembly 1012 (e.g., through members 1022, 1024) and to assembly 10, thereby preventing first mounting member 1022 from moving (e.g., from rotationally moving). When the at least one fastener 31 is loosened or un-secured, the locking teeth 1035 of member 1022 can be disengaged from the locking teeth 1036 of member 1024 (e.g., by raising member 1022 above member 1024 slightly), thereby allowing member 1022 (or member 1024) to rotate relative to top side 13 of deck 11 for desired alignment/mounting purposes on assembly 10. Multiple mounting variations of assembly 912 or 1012 are possible on assembly 10, as desired by the user.

Figure 36:
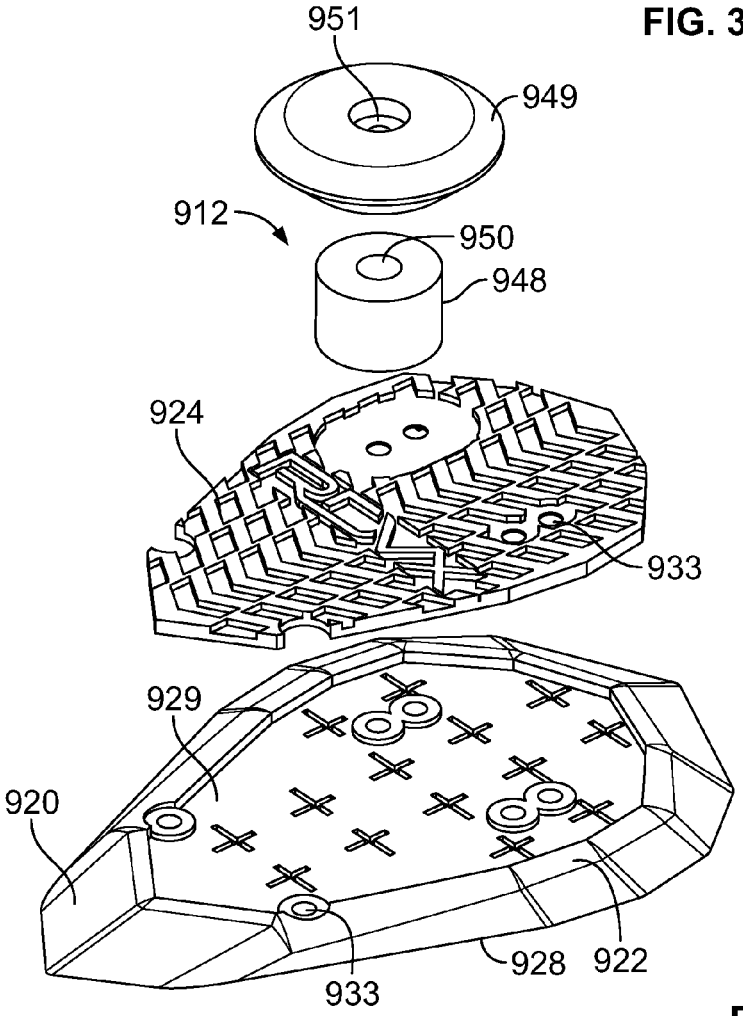
FIG. 36 is an exploded side perspective view of an assembly of FIG. 33.
Figure 37:
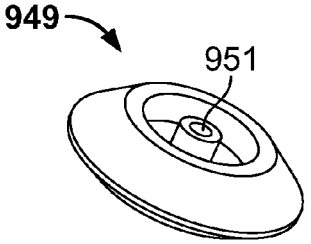
FIG. 37 is a side perspective view of the fourth mounting member of the assembly of FIG. 36.

In exemplary embodiments and as shown in FIGS. 36-37, assembly 912 can also include a third mounting member 948, and a fourth mounting member 949. Members 948 and 949 can be mounted (via fasteners 31, nuts 27) with respect to assembly 10 (and assembly 14 or 16 in some embodiments) by utilizing holes 30, 30' and/or 933, 950, 951. It is noted that members 948 and 949 can be mounted with respect to assembly 10 (by utilizing holes 30 or 30') without members 922 and/or 924 being present.

Figure 32:
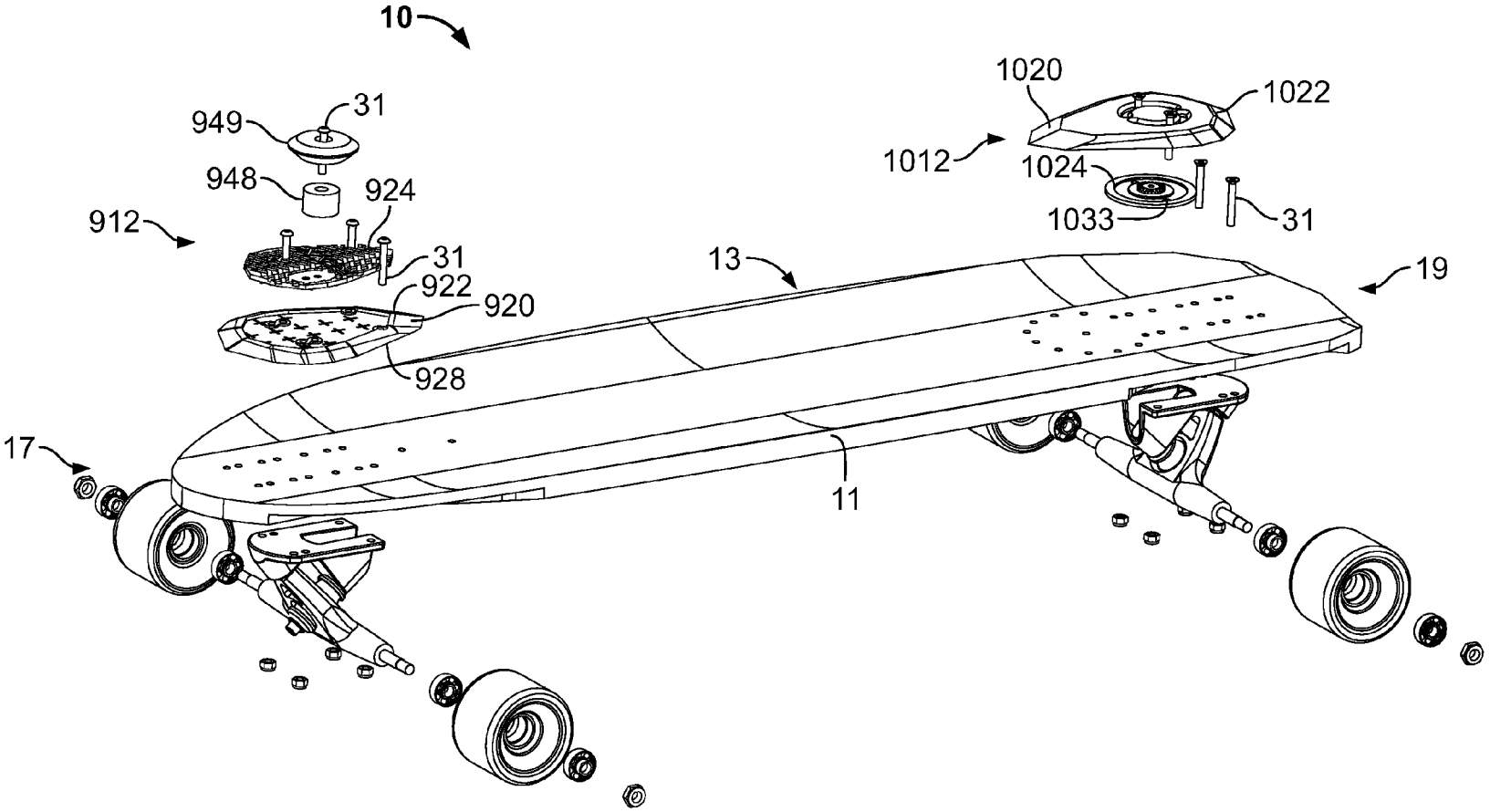
FIG. 32 is a side perspective view of an exemplary skateboard assembly according to the present disclosure, prior to exemplary mounting member assemblies being mounted thereon.
Figure 33:
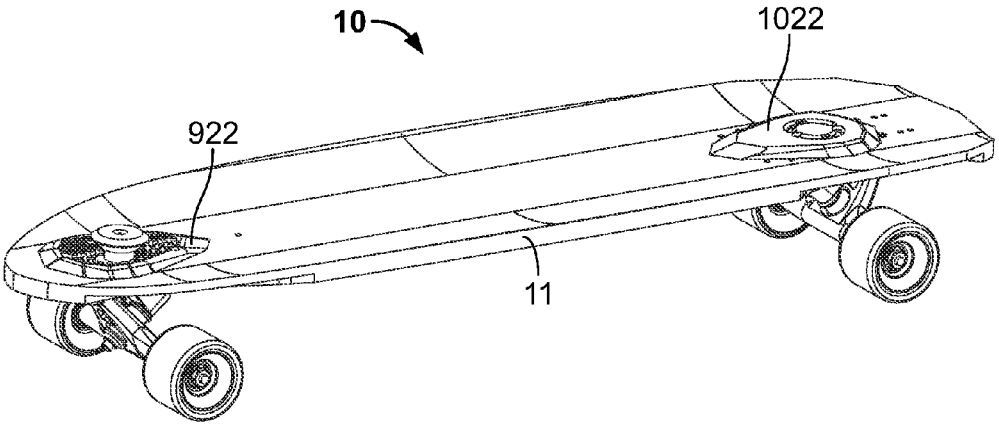
FIG. 33 is a side perspective view of the assemblies of FIG. 32 after assembly.
Figure 34:
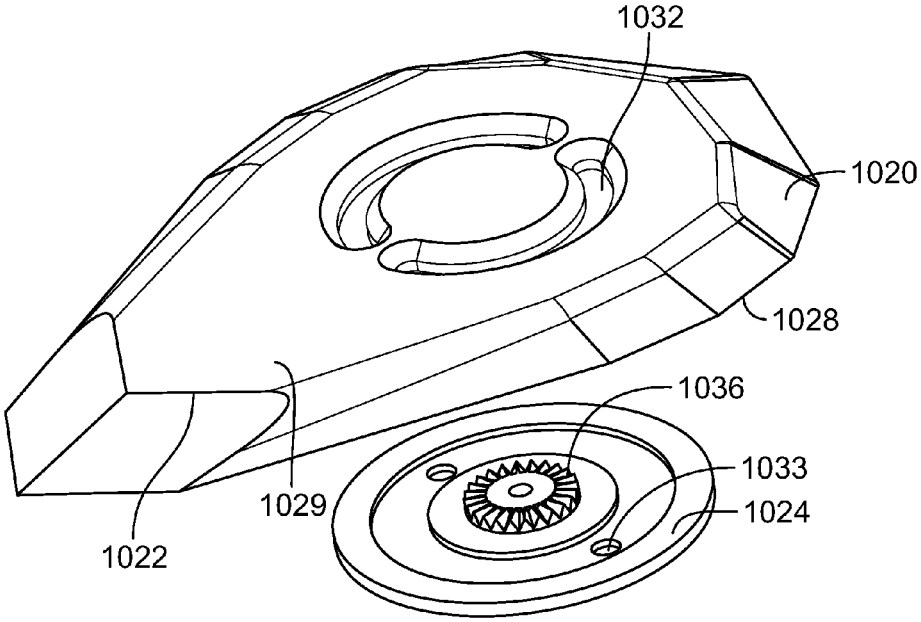
FIG. 34 is an exploded side perspective views of an assembly of FIG. 33.

In certain embodiments and as shown in FIGS. 32-33, members 948 and 949 are mounted to the top side of member 924 and to assembly 10. Exemplary member 948 takes the form of a substantially cylindrical member, although the present disclosure is not limited thereto. Rather, member 948 can take a variety of shapes/designs/forms. Member 948 can include a through aperture 950 to allow fasteners 31 to extend therethrough.

Exemplary member 949 takes the form of a cap member or the like, or a mushroom-head shaped member or the like, although the present disclosure is not limited thereto. Rather, member 949 can take a variety of shapes/designs/forms. Member 949 can include a through aperture 951 to allow fasteners 31 to extend therethrough.

After members 948 and 949 are mounted with respect to assembly 10 (with or without members 922 and/or 924 being mounted thereto as well), a user can advantageously utilize mounted members 948 and 949 to position their foot or feet onto/over or against members 948 and/or 949 for balance/positioning/riding purposes. In exemplary embodiments, at least a portion of the rider's foot (e.g., side of the rider's foot) can be positioned against member 948, and/or at least a portion of the rider's foot (e.g., top/bottom of the rider's foot) can be positioned underneath or above member 949 (e.g., underneath/above at least a portion of cap member or mushroom-head shaped member or the like) for balance/positioning/riding purposes.

In another embodiment of the present disclosure and as shown in FIGS. 38-42, skateboard assembly 100 includes a skateboard deck 111, the skateboard deck 111 typically having a top side 113 and a bottom side 115, and a front end 117 and a rear end 119. Top side 113 is configured and adapted to receive at least a portion of the feet of a rider. It is noted that skateboard deck 111 can be fabricated from a variety of materials and/or combination of materials, and can take a variety of shapes, styles and/or designs.

Skateboard assembly 100 typically includes a first (e.g., fore) truck assembly 114 and a second (e.g., aft) truck assembly 116. In general, each truck assembly 114, 116 is positioned underneath and/or mounted with respect to the bottom side 115 of skateboard deck 111.

Each truck assembly 114, 116 includes one or more wheels 118. In certain embodiments, each truck assembly 114, 116 includes an axle 119 housed in a hanger member 121, each axle 119 rotatably mounted with respect to bearings 123. A baseplate member 125 can be mounted with respect to each hanger member 121. Securement members 127 (e.g., nuts) typically allow wheels 118 and bearings 123 to be mounted with respect to axle 119. It is noted that truck assemblies 114 and/or 116 can take/have a variety of suitable forms/configurations/members.

Similar to skateboard assembly 10 discussed above, it is noted that exemplary mounting member assemblies of the present disclosure can be mounted to skateboard assembly 100 utilizing holes/apertures 130, 130' that are (130) and/or are not (130') typically associated with truck assembly 114 or 116 (e.g., via fasteners 31).

Figure 38:
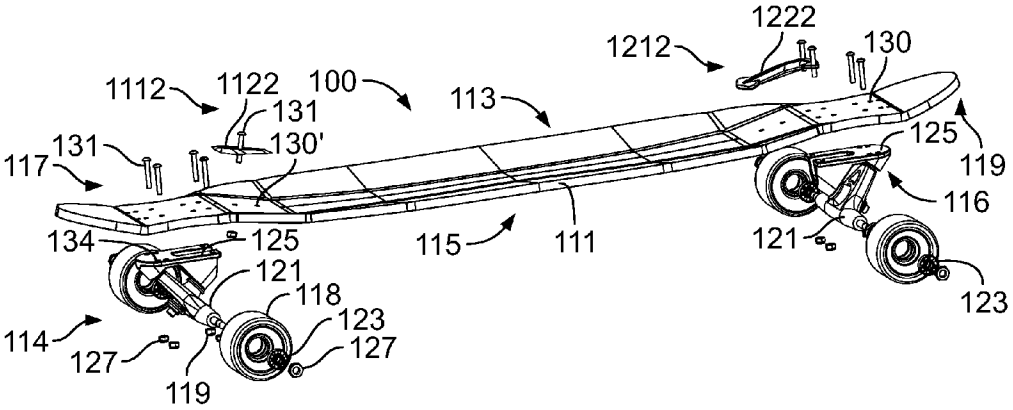
FIG. 38 is a side perspective view of an exemplary skateboard assembly according to the present disclosure, prior to exemplary mounting member assemblies being mounted thereon.
Figure 39:
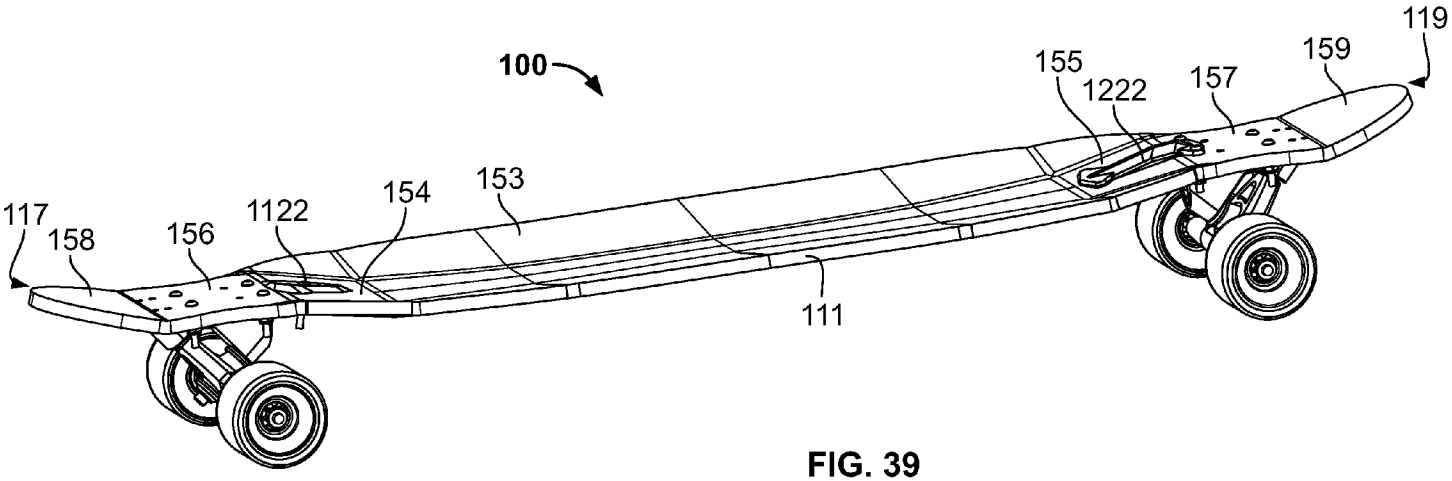
FIG. 39 is a side perspective view of the assemblies of FIG. 38 after assembly.
Figure 40:
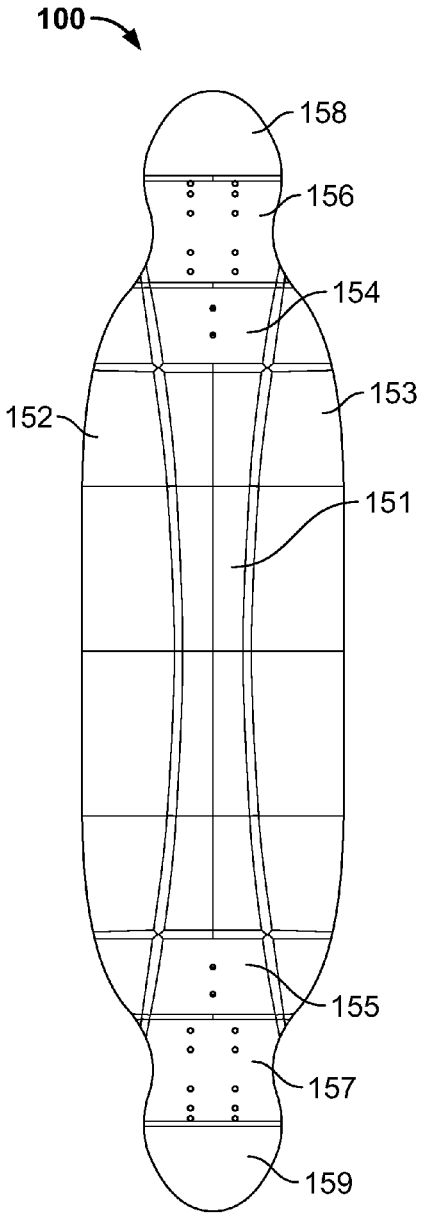
FIG. 40 is a top view of the skateboard deck of FIG. 38.
Figure 41:
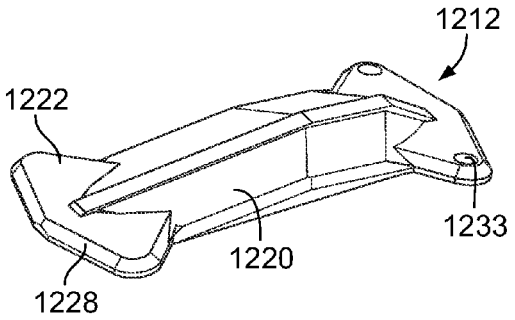
FIG. 41 is a side perspective view of an assembly of FIG. 39.
Figure 42:
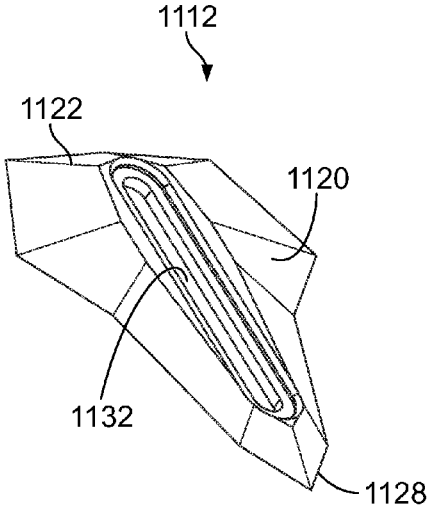
FIG. 42 is a side perspective view of another assembly of FIG. 39.

In exemplary embodiments and as shown in FIGS. 38-40, the skateboard deck 111 of assembly 100 includes a plurality of sections having different planar angles. More particularly, deck 111 includes a central section 151 that can be substantially planar or flat, and central side sections 152, 153 that angle upwardly relative to central section 151. Moreover, deck can include a first forward angled section 154 that angles upward relative to central section 151, a first rear angled section 155 that angles upward relative to central section 151, a first forward planar section 156 that can be substantially planar/flat and/or define a plane that is substantially parallel to central section 151, a first rear planar section 157 that can be substantially planar/flat and/or define a plane that is substantially parallel to central section 151, a second forward angled section 158 that angles upward relative to central section 151, and/or a second rear angled section 159 that angles upward relative to central section 151.

In general, the deck 111 having a plurality of sections having different planar angles provide predictable contact platforms for the addition of mounting member assemblies and/or other add-ons or the like. Moreover, the substantially flat planes allow such mounting member assemblies or add-ons to rest/mount on more predictable footing. They also advantageously allow for planar wheel-well cuts.

In exemplary embodiments and as shown in FIGS. 38-42, skateboard assembly 100 can include mounting member assembly 1112 mounted proximal to the front end 117 of the deck, and mounting member assembly 1212 mounted proximal to the rear end 119 of the deck 111 (e.g., mounted via holes 130 and/or 130', and fasteners 131).

The contoured top surfaces 1120, 1220 of the mounting members 1122, 1222 are configured and dimensioned to provide a user a surface 1120 and/or 1220 that the user can utilize to place or position a foot directly onto or above, with a bottom side of the user's foot contacting the contoured top surface 1120 or 1220 of the mounted mounting member 1122 or 1222 during use. Similarly as discussed above, the contoured top surfaces 1120, 1220 rise, slant, curve and/or slope upwardly/inwardly from at least a portion of the outer edge 1128, 1228.

Assembly 1112 (and assembly 1212) can be mounted (via fasteners 131, nuts 127) with respect to assembly 100 (and assembly 114 or 116 in some embodiments) by utilizing one or more holes 130, or by utilizing one or more holes 130', or by utilizing a combination of holes 130 and 130'.

Mounting member 1122 includes one or more elongated slots 1132. Each slot 1132 is configured to allow one or more fasteners 131 to extend therethrough and through assembly 1112 for mounting purposes.

Mounting member 1222 includes one or more holes 1233. Each hole 1233 is configured to allow one or more fasteners 131 to extend therethrough and through assembly 1212 for mounting purposes.

Advantageous assemblies 1112, 1212 provide users with a very wide range of mounting positions, locations and/or geometries on assembly 100 (e.g., by utilizing various holes 130, 130', and/or by moving/rotating assembly 1112, 1212 to various different positions on assembly 100). Furthermore, after assemblies 1112, 1212 have been mounted to deck 111, the user may further adjust/move their positions by loosening the fastenings 131 and moving them as desired.

In one embodiment and as shown in FIG. 39, member 1122 is mounted with respect to section 154 of deck 111 (e.g., first forward angled section 154 that angles upward relative to central section 151). In exemplary embodiments, member 1122 can be shaped to fit the expected space created by the angular board design of deck 111 (e.g., of first forward angled section 154 that angles upward relative to central section 151).

Moreover, member 1222 is mounted with respect to: (i) section 155 of deck 111 (e.g., first rear angled section 155 that angles upward relative to central section 151), and (ii) section 157 of deck 111 (e.g., first rear planar section 157 that can be substantially planar/flat and/or define a plane that is substantially parallel to central section 151). As shown in FIG. 39, it is noted that mounted member 1222 advantageously contacts and/or is mounted with respect to two different planes of the deck 111 instead of one (e.g., section 155 and section 157). It is noted that the exemplary mounting member assemblies of the present disclosure can be mounted with respect to any suitable section(s) of deck 111 (or deck 11).

Figure 43:
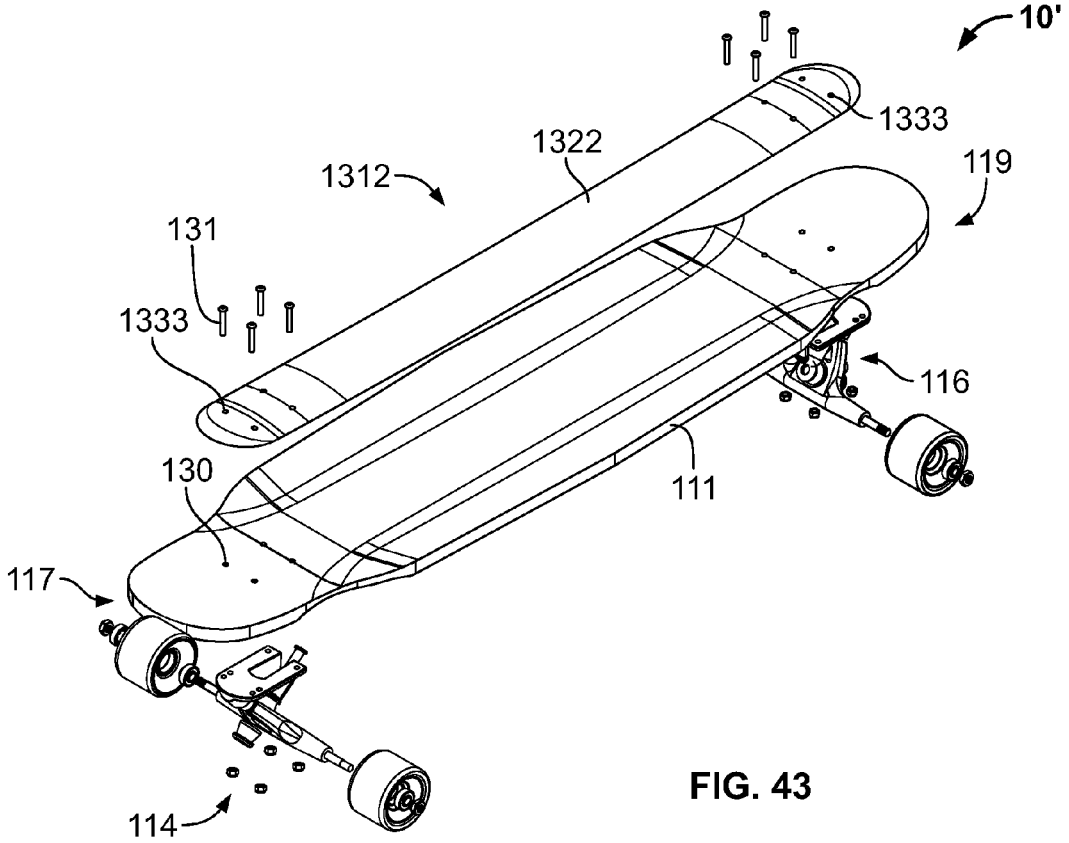
FIG. 43 is a side perspective view of an exemplary skateboard assembly according to the present disclosure, prior to an exemplary mounting member assembly being mounted thereon.
Figure 44:
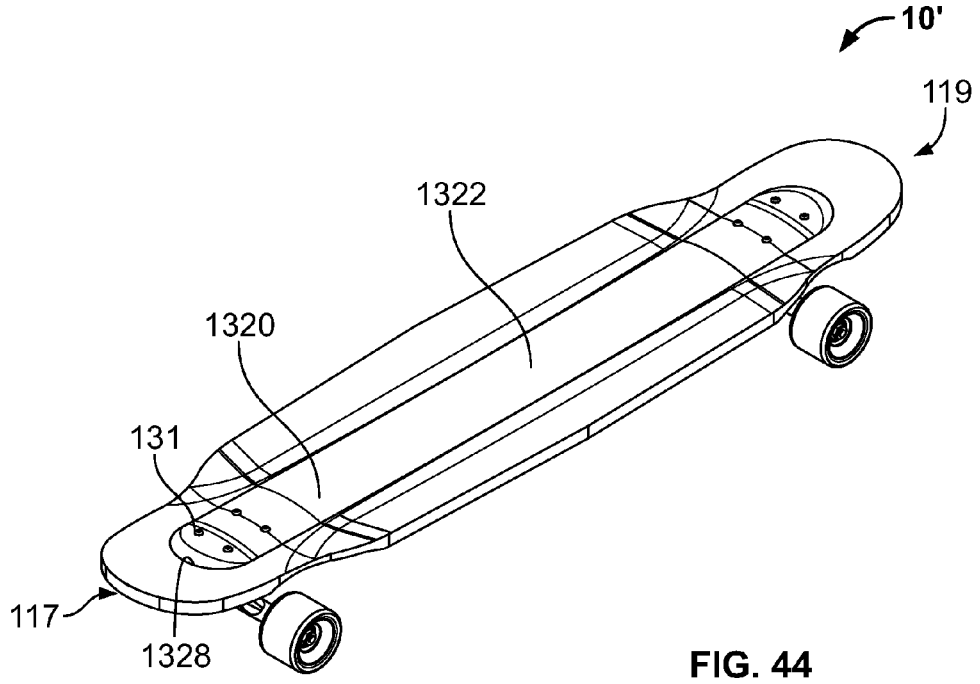
FIG. 44 is a side perspective view of the assemblies of FIG. 43 after assembly.

In other embodiments and as shown in FIGS. 43-44, skateboard assembly 10' can include mounting member assembly 1312 having a portion mounted proximal to the front end 117 of the deck, and a portion mounted proximal to the rear end 119 of the deck 111 (e.g., mounted via holes 130 and/or 130', and fasteners 131). In exemplary embodiments, mounting member 1322 of assembly 1312 extends substantially from the front end 117 of the deck to the rear end 119 of the deck 111. It is noted that member 1322 can extend any distance along and/or on top of deck 111 (e.g., member 1322 can extend over and/or along substantially all of deck 111, or along portions thereof). For example, member 1322 can cover substantially all, or the majority of, the top side 113 of deck 111 to provide a contact standing surface contour (contoured top surface 1320 of mounting member 1322) that is different compared to the previous board/deck 111 top surface 113 (e.g., prior to mounting member 1322 to deck 11). Moreover and as discussed further above/below, member 1322 can be mounted to deck 11 in a variety of ways (e.g., utilizing fasteners 131/holes 130, via self-adhesive moldable/curable material, via velcro, adhesives, tape, double-sided tape, adhesive materials, and combinations thereof).

The contoured top surface 1320 of mounting member 1322 is configured and dimensioned to provide a user a surface 1320 that the user can utilize to place or position a foot directly onto or above, with a bottom side of the user's foot contacting the contoured top surface 1320 of the mounted mounting member 1322 during use. The contoured top surface 1320 rises, slants, curves and/or slopes upwardly/inwardly from at least a portion of the outer edge 1328.

Assembly 1312 can be mounted (via fasteners 131, nuts 127) with respect to assembly 10' (and assembly 114 or 116 in some embodiments) by utilizing one or more holes 130, or by utilizing one or more holes 130', or by utilizing a combination of holes 130 and 130'. Mounting member 1322 includes one or more holes 1333. Each hole 1333 is configured to allow one or more fasteners 131 to extend therethrough and through assembly 1312 for mounting purposes. Advantageous assembly 1312 provides users with a very wide range of mounting positions, locations and/or geometries on assembly 10'. Furthermore, after assembly 1312 has been mounted to deck 111, the user may further adjust/move its position by loosening the fastenings 131 and moving it as desired.

Figure 45:
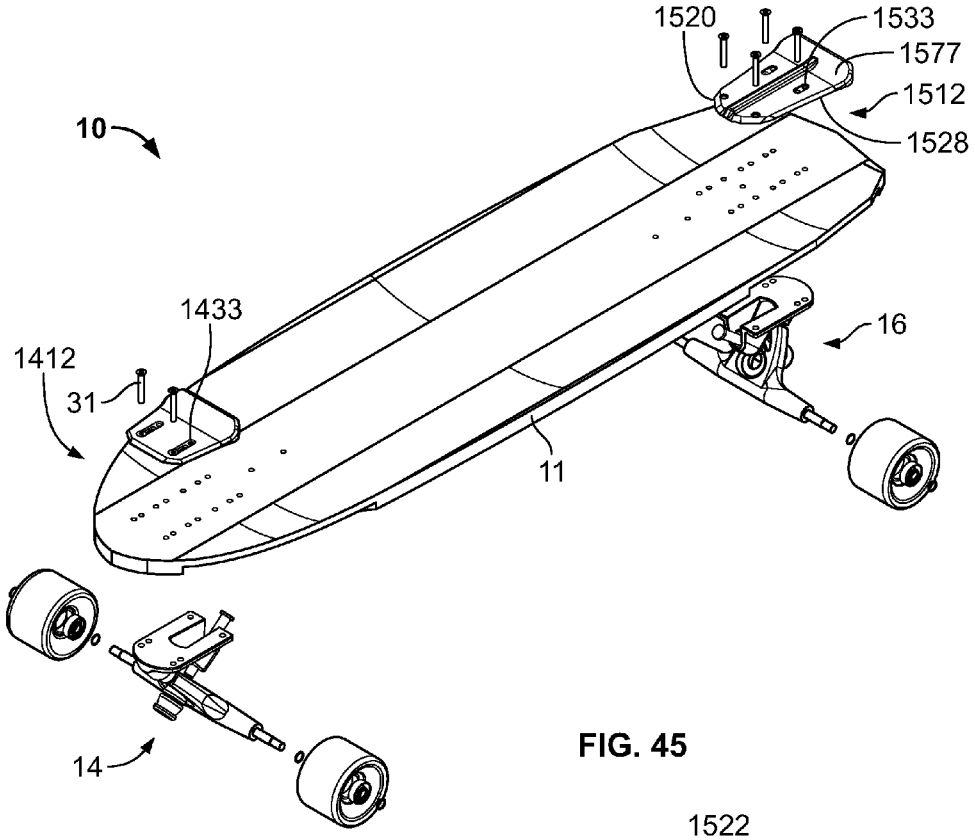
FIG. 45 is a side perspective view of an exemplary skateboard assembly according to the present disclosure, prior to exemplary mounting member assemblies being mounted thereon.
Figure 46:
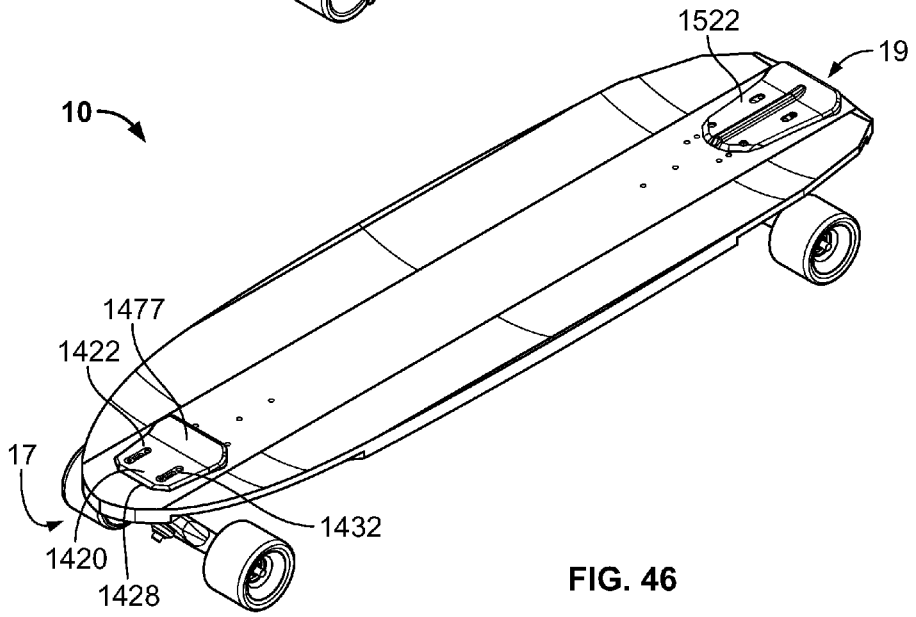
FIG. 46 is a side perspective view of the assemblies of FIG. 45 after assembly.

In other embodiments and as shown in FIGS. 45-46, skateboard assembly 10 can include mounting member assembly 1412 mounted proximal to the front end 17 of the deck, and mounting member assembly 1512 mounted proximal to the rear end 19 of the deck 11 (e.g., mounted via holes 30 and/or 30', and fasteners 31).

The contoured top surfaces 1420, 1520 of the mounting members 1422, 1522 are configured and dimensioned to provide a user a surface 1420 and/or 1520 that the user can utilize to place or position a foot directly onto or above, with a bottom side of the user's foot contacting the contoured top surface 1420 or 1520 of the mounted mounting member 1422 or 1522 during use. The contoured top surfaces 1420, 1520 rise, slant, curve and/or slope upwardly/inwardly from at least a portion of the outer edge 1428, 1528.

Mounting members 1422, 1522 also include an elevated portion 1477, 1577 (e.g., positioned at a rear portion of members 1422, 1522). In general, each elevated portion 1477, 1577 rises, slants and/or slopes upwardly from top surfaces 1420, 1520. Elevated portions 1477, 1577 are configured/dimensioned to provide a user a surface 1477 and/or 1577 that the user can utilize to place or position a foot directly onto or above, with a bottom side of the user's foot contacting the surface of 1477 or 1577 of the mounted mounting member 1422 or 1522 during use (e.g., to increase leverage and/or provide a kicktail portion).

Assembly 1412 (and assembly 1512) can be mounted (via fasteners 31, nuts 27) with respect to assembly 10 (and assembly 14 or 16 in some embodiments) by utilizing one or more holes 30, or by utilizing one or more holes 30', or by utilizing a combination of holes 30 and 30'.

Mounting member 1422 includes one or more elongated slots 1432, and one or more holes 1433. Each slot 1432 and hole 1433 is configured to allow one or more fasteners 31 to extend therethrough and through assembly 1412 for mounting purposes.

Mounting member 1522 includes one or more holes 1533. Each hole 1533 is configured to allow one or more fasteners 31 to extend therethrough and through assembly 1512 for mounting purposes.

Advantageous assemblies 1412, 1412 provide users with a very wide range of mounting positions, locations and/or geometries on assembly 10. Furthermore, after assemblies 1412, 1512 have been mounted to deck 11, the user may further adjust/move their positions by loosening the fastenings 31 and moving them as desired.

In another embodiment and as shown in FIGS. 47-51, skateboard assembly 10 can include mounting member assembly 1612 mounted proximal to the front end 17 of the deck 11, and mounting member assembly 1712 mounted proximal to the rear end 19 of the deck 11 (e.g., mounted via holes 30 and/or 30', and fasteners 31).

Mounting member assembly 1712 can include a second mounting member 1724, the second mounting member 1724 configured to be mounted with respect to: (i) the first (adjustable) mounting member 1722, (ii) the top side 13 of skateboard deck 11, and/or (iii) the first or second truck assembly 14, 16. In some embodiments, member 1724 is snap-fit or press-fit onto member 1722 to mount it thereon.

Mounting member assembly 1712 also includes a third mounting member 1742 and a fourth mounting member 1745. Member 1742 is configured to be mounted with respect to the top surface of member 1724, and member 1745 is configured to be mounted with respect to the top surface of member 1742. In some embodiments, member 1742 is snap-fit or press-fit onto member 1724 to mount it thereon, and member 1745 is snap-fit or press-fit onto member 1742 to mount it thereon. In certain embodiments, after assembly 1712 is assembled together onto deck 11 (FIG. 48), grip-tape or the like may be positioned over at least a portion of assembly 1712 for mounting purposes.

Once assembly 1712 is assembled together (FIG. 48), the contoured top surfaces 1720 of the mounting members 1722, 1724, 1742 and 7145 are configured and dimensioned to provide a user a surface 1720 that the user can utilize to place or position a foot directly onto or above, with a bottom side of the user's foot contacting the assembled contoured top surface 1720 during use. The assembled contoured top surface 1720 (FIG. 48) rises, slants, curves and/or slopes upwardly/inwardly from at least a portion of the outer edge 1728 of the top surface 1720 of each member 1722, 1724, 1742 and 7145 until it reaches upper section 1729.

Assembly 1712 can be mounted (via fasteners 31, nuts 27) with respect to assembly 10 (and assembly 14 or 16 in some embodiments) by utilizing one or more holes 30, or by utilizing one or more holes 30', or by utilizing a combination of holes 30 and 30'.

Mounting members 1722, 1724 and 1742 include one or more (corresponding) holes 1733 extending therethrough. Each hole 1733 is configured to allow one or more fasteners 31 to extend therethrough and through assembly 1712 for mounting purposes. In some embodiments, fasteners are inserted through one or more holes 1733 of member 1722, and not through members 1724, 1742 and 1745 (e.g., members 1724, 1742 and 1745 are snap-fit or press-fit together as noted above for mounting purposes). Advantageous assembly 1712 provides users with a very wide range of mounting positions, locations and/or geometries on assembly 10.

As noted above, assembly 10 can also include assembly 1612 mounted thereon. Mounting member assembly 1612 includes a second mounting member 1624, the second mounting member 1624 configured to be mounted with respect to: (i) the first mounting member 1622, (ii) the top side 13 of skateboard deck 11, and/or (iii) the first or second truck assembly 14, 16. Assembly 1612 can be mounted (via fasteners 31, nuts 27) with respect to assembly 10 (and assembly 14 or 16 in some embodiments) by utilizing one or more holes 30, or by utilizing one or more holes 30', or by utilizing a combination of holes 30 and 30'.

The contoured top surface 1620 of mounting member 1622 is configured to provide a user a surface 1620 that the user can utilize to place or position a foot directly onto or above, with a bottom side of the user's foot contacting the contoured top surface 1620 during use. Top surface 1620 rises, slants, curves and/or slopes upwardly/inwardly from at least a portion of the outer edge 1628.

Member 1622 may or may not include an extending portion 1699. After members 1622 and 1624 are mounted with respect to assembly 10, a user can advantageously utilize mounted members 1622 and 1624 to position their foot or feet onto/over or against members 1622 and/or 1624 for balance/positioning/riding purposes. In exemplary embodiments, at least a portion of the rider's foot (e.g., side of the rider's foot) can be positioned against extending portion 1699 of member 1622, and/or at least a portion of the rider's foot (e.g., top/bottom of the rider's foot) can be positioned underneath or above top surface 1620 of member 1622 for balance/positioning/riding purposes.

The second mounting member 1624 includes one or more holes 1633, and first mounting member 1622 includes one or more holes 1633. In certain embodiments, member 1622 includes one hole 1633. Each hole 1633 is configured to allow one or more fasteners 31 to extend therethrough and through assembly 1612 for mounting purposes. Member 1624 (and member 1622) can be mounted to assembly 10 utilizing a variety of combinations of fasteners 31 in the various holes 1633. Advantageous assembly 1612 provides users with a very wide range of mounting positions, locations and/or geometries on assembly 10.

Figure 47:
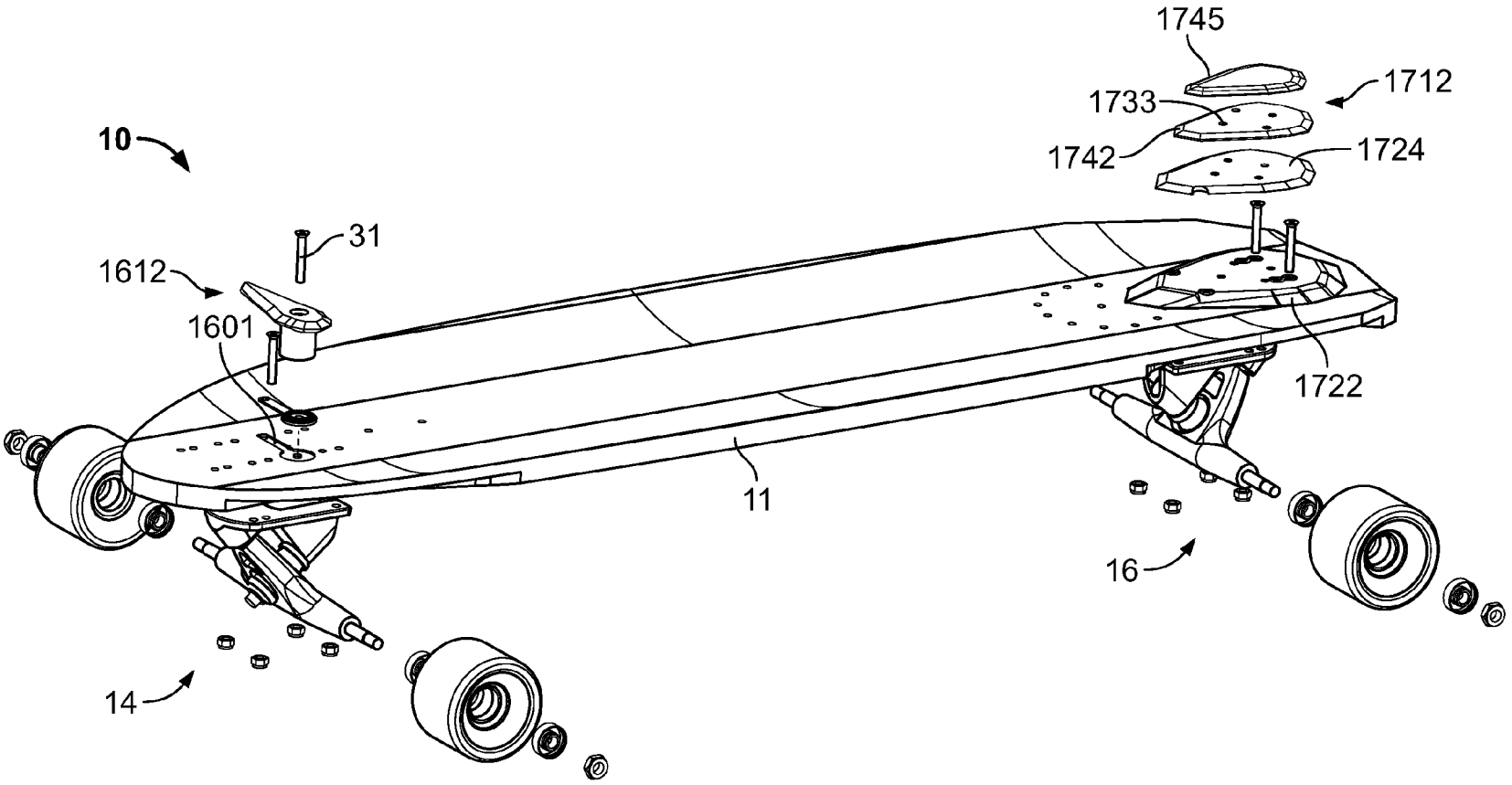
FIG. 47 is a side perspective view of an exemplary skateboard assembly according to the present disclosure, prior to exemplary mounting member assemblies being mounted thereon.
Figure 48:
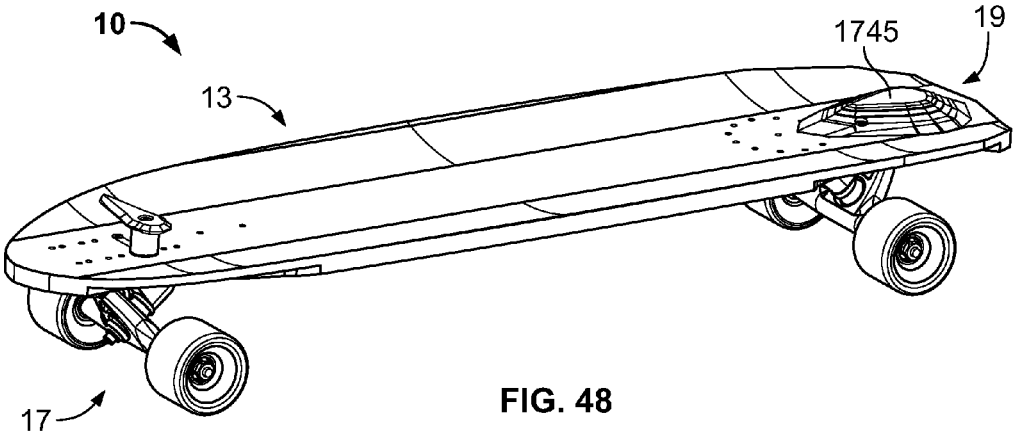
FIG. 48 is a side perspective view of the assemblies of FIG. 47 after assembly.
Figure 49:
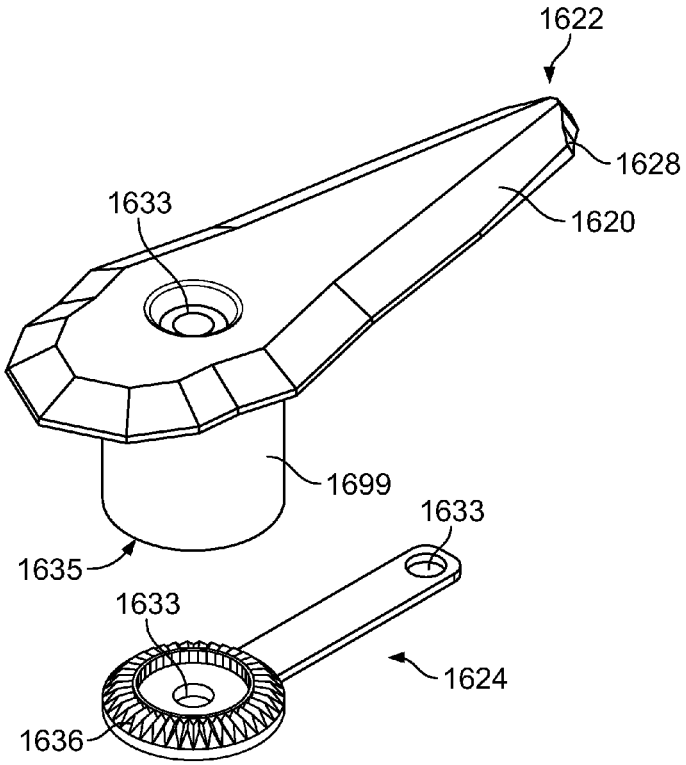
FIG. 49 is an exploded side perspective view of an assembly of FIG. 48.
Figure 50:
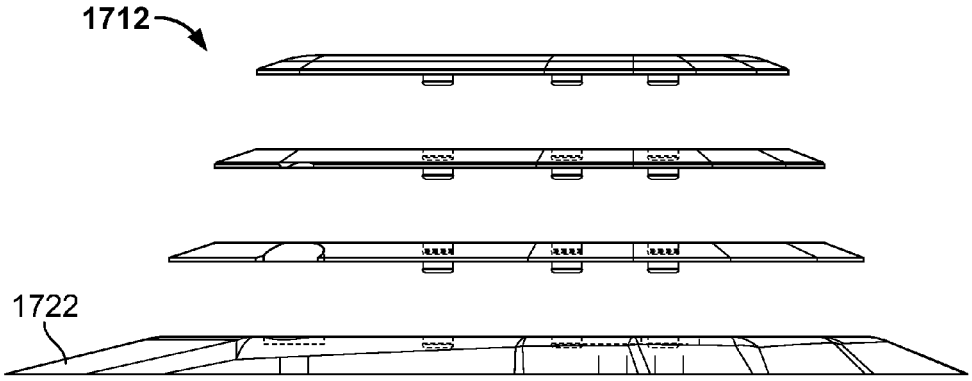
FIG. 50 is a side view of another assembly of FIG. 48.
Figure 51:
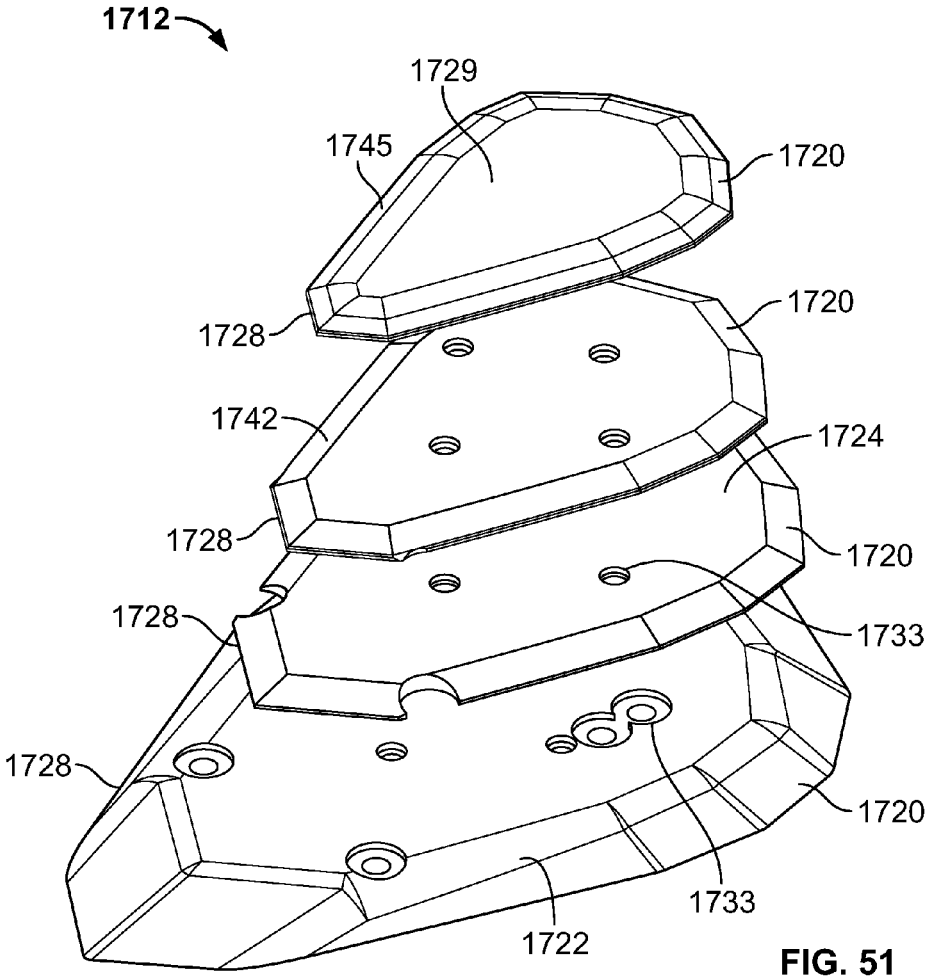
FIG. 51 is an exploded side perspective view of the assembly of FIG. 50.

In certain embodiments and as shown in FIG. 47, deck 11 can include a recess 1601 that is configured to house at least a portion of member 1624 for mounting purposes. Recess 1601 typically includes one or more holes 30 and/or 30'. It is noted, however, that member 1624 can be mounted to deck 11 without utilizing recess 1601. In general, after member 1624 is mounted within recess 1601 (FIG. 48), the recess 1601 prevents member 1624 from moving/rotating while positioned/secured within recess 1601.

Members 1622 and 1624 include mating locking teeth 1635 and 1636, respectively. Locking teeth 1635 and 1636 lockingly engage one another when at least one fastener 31 is secured through assembly 1612 (e.g., through members 1622, 1624) and to assembly 10, thereby preventing first mounting member 1622 from moving (e.g., from rotationally moving). When the at least one fastener 31 is loosened or un-secured, the locking teeth 1635 of member 1622 can be disengaged from the locking teeth 1636 of member 1624 (e.g., by raising member 1622 above member 1624 slightly), thereby allowing member 1622 to rotate relative to top side 13 of deck 11 for desired alignment/mounting purposes. As such, assembly 1612 advantageously allows a user to move/rotate member 1622 by just loosening one fastener 31. As similarly noted above, multiple mounting variations of assembly 1612 are possible on assembly 10, as desired.

In other embodiments and as shown in FIGS. 52-55, skateboard assembly 10 can include mounting member assembly 1812 mounted proximal to the front end 17 of the deck 11, and mounting member assembly 1912 mounted proximal to the rear end 19 of the deck 11 (e.g., mounted via holes 30 and/or 30', and fasteners 31).

Mounting member assembly 1812 includes a second mounting member 1824, the second mounting member 1824 configured to be mounted with respect to: (i) a third mounting member 1842 (which is configured to be mounted with respect to first mounting member 1822), (ii) the top side 13 of skateboard deck 11, and/or (iii) the first or second truck assembly 14, 16. Assembly 1812 can be mounted (via fasteners 31, nuts 27) with respect to assembly 10 (and assembly 14 or 16 in some embodiments) by utilizing one or more holes 30, or by utilizing one or more holes 30', or by utilizing a combination of holes 30 and 30'.

The contoured top surface 1820 of mounting member 1822 is configured to provide a user a surface 1820 that the user can utilize to place or position a foot directly onto or above, with a bottom side of the user's foot contacting the contoured top surface 1820 during use. Top surface 1820 rises, slants, curves and/or slopes upwardly/inwardly from at least a portion of the outer edge 1828.

It is noted that assembly 1812 may or may not include third mounting member 1842 (e.g., member 1824 can mount with respect to member 1822 without member 1842 being present). After members 1822, 1842 (if present) and 1824 are mounted with respect to assembly 10, a user can advantageously utilize mounted members 1822, 1842 and 1824 to position their foot or feet onto/over or against members 1822, 1842 and/or 1824 for balance/positioning/riding purposes. In exemplary embodiments, at least a portion of the rider's foot (e.g., side of the rider's foot) can be positioned against member 1842, and/or at least a portion of the rider's foot (e.g., top/bottom of the rider's foot) can be positioned underneath or above top surface 1820 of member 1822 for balance/positioning/riding purposes.

The second mounting member 1824 includes one or more holes 1833 (e.g., one hole 1833), and first mounting member 1822 includes one or more holes 1833 (e.g., one hole 1833). Third member 1842 includes one or more holes 1833 (e.g., one hole 1833). Each hole 1833 is configured to allow one or more fasteners 31 to extend therethrough and through assembly 1812 for mounting purposes. Member 1824 (and members 1822, 1842) can be mounted to assembly 10 utilizing a variety of combinations of fasteners 31 in the various holes 1833. Advantageous assembly 1812 provides users with a very wide range of mounting positions, locations and/or geometries on assembly 10.

Figure 52:
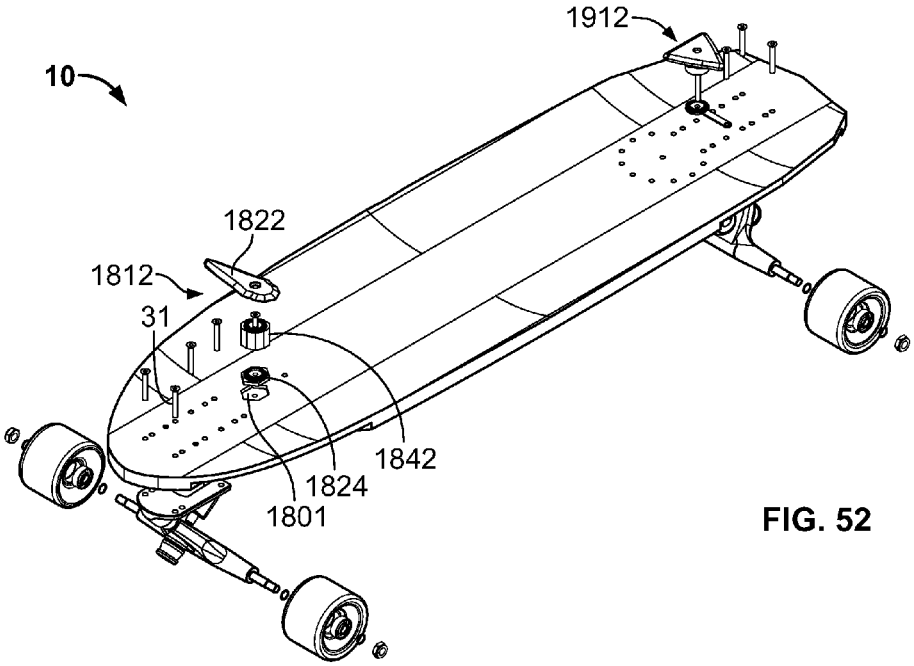
FIG. 52 is a side perspective view of an exemplary skateboard assembly according to the present disclosure, prior to exemplary mounting member assemblies being mounted thereon.
Figure 53:
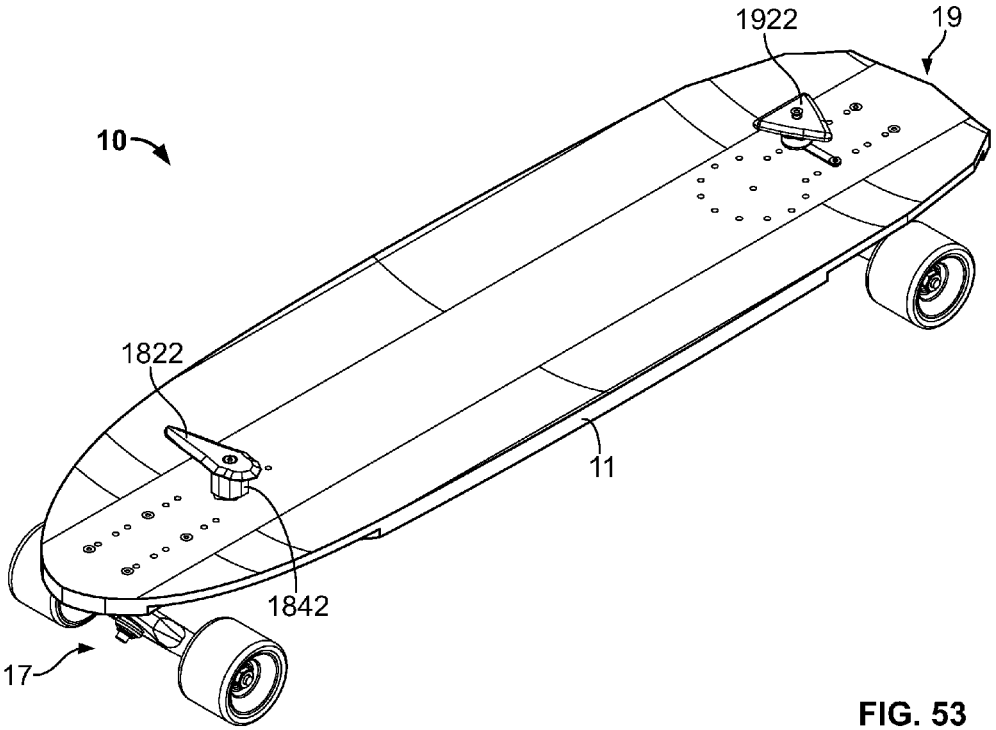
FIG. 53 is a side perspective view of the assemblies of FIG. 52 after assembly.
Figure 54:
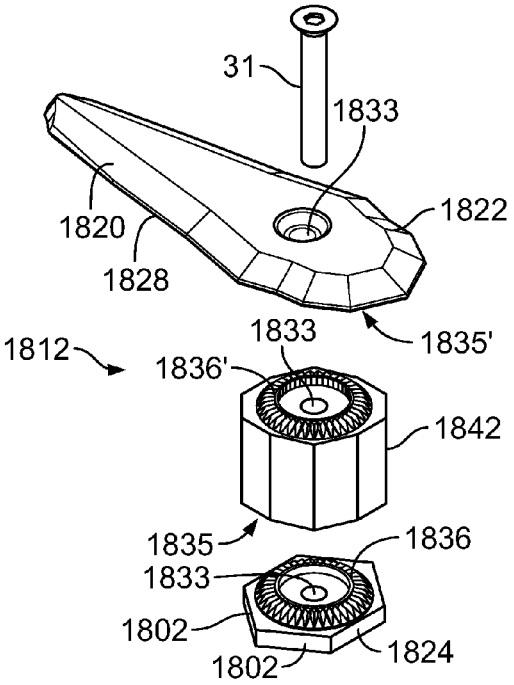
FIG. 54 is an exploded side perspective view of an assembly of FIG. 53.
Figure 55:
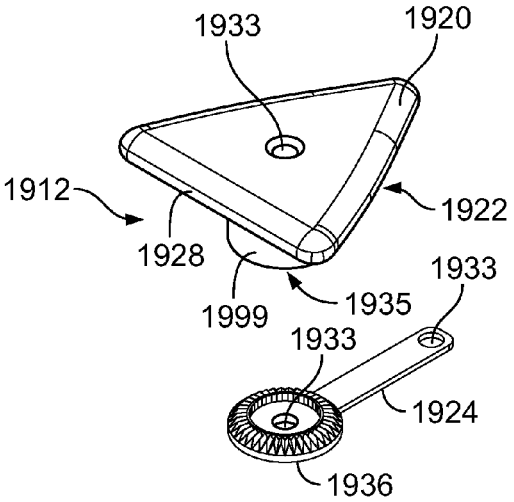
FIG. 55 is an exploded side perspective view of another assembly of FIG. 53.

In certain embodiments and as shown in FIG. 52, deck 11 can include a recess 1801 (e.g., polygonal shaped recess 1801) that is configured to house at least a portion of member 1824 for mounting purposes. Recess 1801 typically includes one or more holes 30 and/or 30'. It is noted, however, that member 1824 can be mounted to deck 11 without utilizing recess 1801. In general, after member 1824 is mounted within recess 1801 (FIG. 53), the recess 1801 prevents member 1824 from moving/rotating while positioned/secured within recess 1801. For example, the polygonal walls 1802 of member 1824 matingly correspond to polygonal recess 1801, in some embodiments.

Members 1842 and 1824 include mating locking teeth 1835 and 1636, respectively. Members 1842 and 1822 include mating locking teeth 1635' and 1636', respectively. Locking teeth 1835 and 1836 lockingly engage one another, and locking teeth 1835' and 1836' lockingly engage one another (when member 1842 is present), when at least one fastener 31 is secured through assembly 1812 (e.g., through members 1822, 1842, 1824) and to assembly 10, thereby preventing first mounting member 1822 (and member 1842) from moving (e.g., from rotationally moving).

When the at least one fastener 31 is loosened or un-secured, the locking teeth 1835 of member 1842 can be disengaged from the locking teeth 1836 of member 1824 (e.g., by raising member 1842 above member 1824 slightly), thereby allowing members 1842 and 1822 to rotate relative to top side 13 of deck 11 for desired alignment/mounting purposes. As such, assembly 1812 advantageously allows a user to move/rotate members 1842 and/or 1822 by just loosening one fastener 31. As similarly noted above, multiple mounting variations of assembly 1812 are possible on assembly 10, as desired by the user.

Similarly, when the at least one fastener 31 is loosened or un-secured, the locking teeth 1835' of member 1822 can be disengaged from the locking teeth 1836' of member 1842 (e.g., by raising member 1822 above member 1842 slightly—or above member 1824 if 1842 is not present), thereby allowing member 1822 to rotate relative to top side 13 of deck 11 for desired alignment/mounting purposes. As such, assembly 1812 advantageously allows a user to move/rotate member 1822 by just loosening one fastener 31.

As noted above, assembly 10 can also include assembly 1912 mounted thereon. Mounting member assembly 1912 includes a second mounting member 1924, the second mounting member 1924 configured to be mounted with respect to: (i) the first mounting member 1922, (ii) the top side 13 of skateboard deck 11, and/or (iii) the first or second truck assembly 14, 16. Assembly 1912 can be mounted (via fasteners 31, nuts 27) with respect to assembly 10 (and assembly 14 or 16 in some embodiments) by utilizing one or more holes 30, or by utilizing one or more holes 30', or by utilizing a combination of holes 30 and 30'.

The contoured top surface 1920 of mounting member 1922 is configured to provide a user a surface 1920 that the user can utilize to place or position a foot directly onto or above, with a bottom side of the user's foot contacting the contoured top surface 1920 during use. Top surface 1920 rises, slants, curves and/or slopes upwardly/inwardly from at least a portion of the outer edge 1928.

Member 1922 may or may not include an extending portion 1999. After members 1922 and 1924 are mounted with respect to assembly 10, a user can advantageously utilize mounted members 1922 and 1924 to position their foot or feet onto/over or against members 1922 and/or 1924 for balance/positioning/riding purposes. In exemplary embodiments, at least a portion of the rider's foot (e.g., side of the rider's foot) can be positioned against extending portion 1999 of member 1922, and/or at least a portion of the rider's foot (e.g., top/bottom of the rider's foot) can be positioned underneath or above top surface 1920 of member 1922 for balance/positioning/riding purposes.

The second mounting member 1924 includes one or more holes 1933, and first mounting member 1922 includes one or more holes 1933. In certain embodiments, member 1922 includes one hole 1933. Each hole 1933 is configured to allow one or more fasteners 31 to extend therethrough and through assembly 1912 for mounting purposes. Member 1924 (and member 1922) can be mounted to assembly 10 utilizing a variety of combinations of fasteners 31 in the various holes 1933. Advantageous assembly 1912 provides users with a very wide range of mounting positions, locations and/or geometries on assembly 10.

Members 1922 and 1924 include mating locking teeth 1935 and 1936, respectively. Locking teeth 1935 and 1936 lockingly engage one another when at least one fastener 31 is secured through assembly 1912 (e.g., through members 1922, 1924) and to assembly 10, thereby preventing first mounting member 1922 from moving (e.g., from rotationally moving). When the at least one fastener 31 is loosened or un-secured, the locking teeth 1935 of member 1922 can be disengaged from the locking teeth 1936 of member 1924 (e.g., by raising member 1922 above member 1924 slightly), thereby allowing member 1922 to rotate relative to top side 13 of deck 11 for desired alignment/mounting purposes. As such, assembly 1912 advantageously allows a user to move/rotate member 1922 by just loosening one fastener 31. As similarly noted above, multiple mounting variations of assembly 1912 are possible on assembly 10, as desired by the user.

As noted above and as shown in FIGS. 56-58, exemplary moldable/curable material 2001 (e.g., hand-moldable and self-adhesive compositions, etc.) can be utilized in conjunction with exemplary mounting member assembly 2012 for mounting purposes (e.g., to deck 11) (or material 2001 can be utilized in conjunction with other exemplary mounting members of the present disclosure discussed herein—12, 12', 112, 212, etc.). As such, exemplary moldable material 2001 can be utilized with the exemplary mounting members (12, etc.) of the present disclosure in lieu of or in addition to utilizing fasteners 31/holes 30 and/or all of the other mounting methods/structures (e.g., threaded inserts, Velcro, tape, etc.) of assemblies 12, 12' 112, etc. disclosed herein.

As noted, moldable material 2001 can take a variety of forms (e.g., single or multi-part plastic, epoxy, clay, rubber, putty, or other curable material, which is soft, or liquid, and then hardens, which is molded by hand, or otherwise, where the desired shape of the member is created and determined by the end user, by hand molding the material, or where the user uses a previously created cavity mold or other molding tool to press the curable material into the desired shape).

Figure 56:
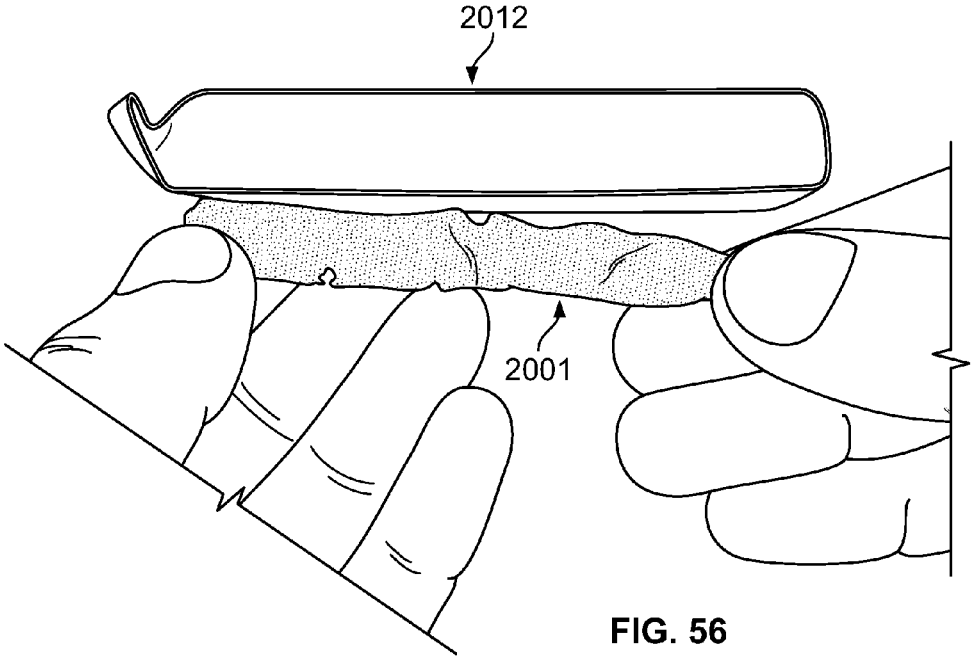
FIGS. 56-57 are side perspective views of an exemplary mounting member assembly, prior to mounting to a skateboard assembly.
Figure 57:
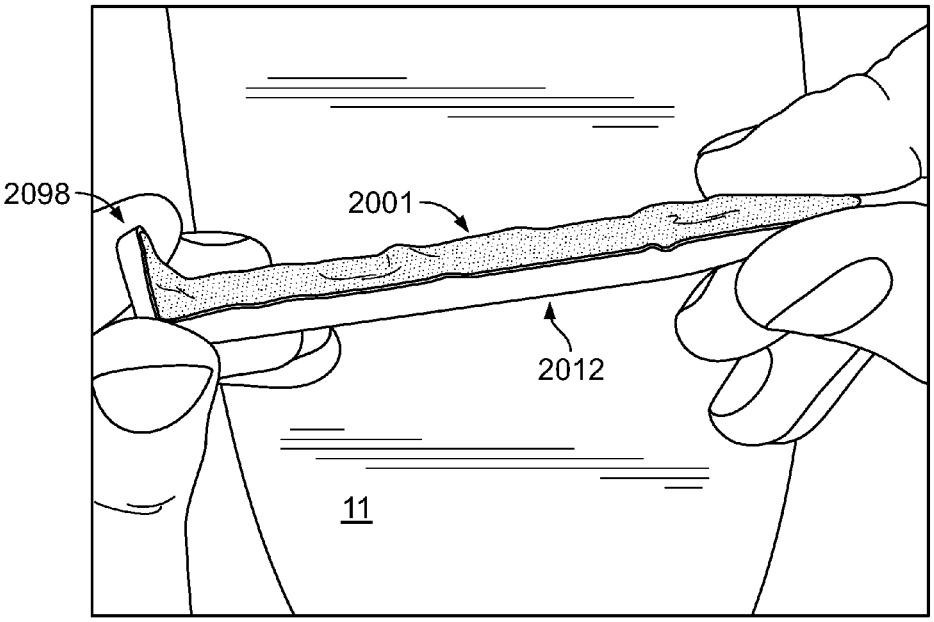
Figure 58:
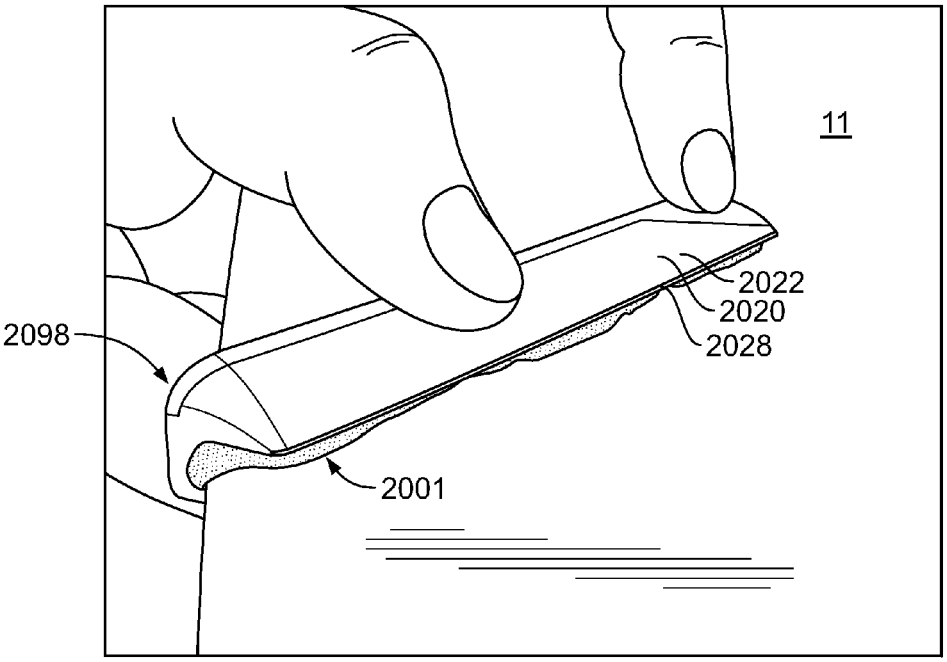
FIG. 58 is a side perspective view of the mounting member assembly of FIG. 57, after mounting the assembly to a skateboard assembly.

As shown in FIG. 56, a user can mold material 2001 to a desired shape, and then place/position the material 2001 on a desired location on mounting member 2022 of assembly 2012 (FIG. 57). The user may then press the mounting member 2022 onto deck 11 for mounting purposes and allow the material to cure/harden, which thereby securely mounts material 2001 and member 2022 to deck 11. In some embodiments and as shown in FIGS. 56-58, mounting member 2022 can include extending portion 2098 that extends over a side edge of deck 11 (e.g., for protection or edge-bumper-like functions of assembly 2012). It is noted that material 2001 can be positioned at various locations of member 2022 (e.g., entire or partial length of bottom side of member 2022). As shown in FIG. 58, after adhering/mounting member 2022, the material can act as a buffer and take up space between the top surface of the deck 11 and member 2022. Moreover, it is also noted that material 2001 can take-up/fill spaces of member 2022 that would otherwise remain unfilled/empty, thereby providing a more secure mount to deck 11 (e.g., eliminating a poor mounting fit between member 2022 and deck 11). It is noted that deck 11 may or may not include grip-tape or the like on its top surface 13.

As similarly discussed above, exemplary mounting member 2022 includes a contoured top surface 2020 that is configured to provide a user a surface 2020 that the user can utilize to place or position a foot directly onto or above, with a bottom side of the user's foot contacting the contoured top surface 2020 during use. Top surface 2020 rises, slants, curves and/or slopes upwardly/inwardly from at least a portion of the outer edge 2028.

As such, the present disclosure provides for a contoured mounting member 2022 configured to be mounted/adhered to a board/deck 11 with a single or multi-part plastic, epoxy, clay, rubber, putty, or other curable material 2001, which is soft and then hardens, which is molded by hand by the user, or otherwise molded, in such a way as to adhere the mounting member 2022 to one or more surfaces of the board/deck 11 (or to the grip tape abrasive adhesive paper covering a surface of that board), using the mechanical bond created by the air dry, curing or solidifying of the moldable curable material 2001, and where that moldable curable material 2001, upon curing, drying or cooling, retains some flexibility or additional volume to enhance the durability, or expand the range of surface shapes a member 2022 can effectively be adhered or mounted thereto.

Moreover, the present disclosure provides for a mounting member 2022 configured and dimensioned for use with a moldable/curable material 2001, with the member 2022 having contact surfaces designed for improved adhesion with the material 2001. For example, member 202 can have modified surfaces that use embossed or de-bossed grids, hashed, dimpled, or serrated surfaces, drilled holes, geometric shapes or patterns, or other structures/methods designed to improve mechanical bonding and modify leverage to result in a stronger and longer lasting bond between the mounting member 2022, the curable material 2001, and the board, or grip tape abrasive adhesive paper, contact surface.

Furthermore, the present disclosure provides for a mounting member 2022 configured for use with a moldable curable material 2001, and also having drilled mounting holes, either smooth or threaded, metal threaded inserts molded into it, or other additional mechanical methods of fixing the mounting member 2022 to the board contact surface using additional screws, bolts or other hardware, which may be used simultaneously, or instead of, the moldable curable material 2001.

Additionally and in certain embodiments, the present disclosure provides for deck 11 with a standing surface, or other contact surface, for use with mounting members (e.g., 2022) adhered with, and/or created using, a moldable material 2001, with the deck 11 having contact surfaces/structures designed for improved adhesion with the material 2001. For example, these modified surfaces of deck 11 may use embossed or de-bossed grids, hashed, dimpled, or serrated surfaces, drilled holes, geometric shapes or patterns, or other methods/structures designed to improve mechanical bonding and modify leverage to result in a stronger and longer lasting bond between the mounting member (2022), the curable material 2001, and the skateboard contact surface (e.g., 13).

In this regard, it is noted that there are many shapes and styles of skateboards (or other boards like surfboards, snowboards, wakeboards, etc.), and many of these styles have top standing surfaces, profile surfaces, or bottom surfaces that are wholly and completely different from one another. Many of those different surfaces can generally require a mounting member to have a contact surface specifically molded to fit the given board surface in instances where the member is not flexible enough to bend to fit the standing surface shape.

In these instances, certain exemplary mounting members of the present disclosure can be mounted/adhered to the board by the user/rider prior to use, utilizing a moldable (e.g., by hand or otherwise) material 2001 or the like, which itself has both shape and volume and can be molded to more universally fit between the standardized contact surface of the mounting member and the many varying board surfaces that are used in differing skateboard styles and designs.

It is further noted that one or both of the mounting surface of the skateboard deck, and/or the contact surface of the mounting member can be scoured, etched, scratched, extruded or molded to include recesses, hash marks, grids, holes or dimples that can serve to increase the adhesion between the material 2001, the top standing surface of the skateboard and the bottom surface of the mounting member (e.g., 2022).

In another embodiment, the top standing surface of the skateboard deck 11 could be covered with grip tape, an adhesive backed abrasive paper, or adhesive backed sandpaper, prior to application of the moldable putty substance 2001. In this embodiment, the moldable material 2001 can serve the same function, but would instead bind the top standing surface of the adhesive backed abrasive paper and the bottom surface of the mounting member (2022).

In other embodiments, the mounting member can make use of adhesion by both the moldable/curable material 2001, and with nuts, bolts, screws 31 or other mechanical methods simultaneously.

In other embodiments of the present disclosure, it is noted that the mounting members can be configured and dimensioned to be stacked on top of one another (e.g., lego-like or puzzle-piece fitting or stacking/mounting/engaging) during the mounting process on the exemplary skateboard assemblies. In other embodiments, the skateboard deck can integrally include one or more mounting members. The skateboard deck can also include mounting/mating features (e.g., recesses or the like, protruding members, knobs, etc.) that are configured and dimensioned to engage/accept/mount with various mounting members of the exemplary mounting member assemblies of the present disclosure. It is also noted that the exemplary mounting members of the present disclosure can include sharp members or the like (e.g., on the bottom side of the mounting members) that are configured to puncture, punch through and/or engage/mate with any grip tape or the like that may be on the skateboard decks.

In other embodiments of the present disclosure, it is noted that the mounting members (22, etc.) could be mounted to deck 11 (or 111) by utilizing Velcro (hook-and-loop fasteners), or via a similar two-part (reusable or non-reuseable) mechanically adhesive methodology (e.g., in lieu of or in addition to utilizing fasteners 31/holes 30 and/or moldable/curable materials and/or the other mounting methods disclosed herein). For example, because Velcro, like other mechanical adhesive methods, can be removed and re-applied, it offers an advantage over traditional glue-style adhesive applied during production (e.g., which can not be re-applied). Velcro or similar mechanical adhesive methodologies also advantageously provides the user with opportunities to place the mounting member(s) anywhere on the standing surface (13) of the board/deck 11 without respect to the truck mounting brackets 14, 16.

Figure 35:
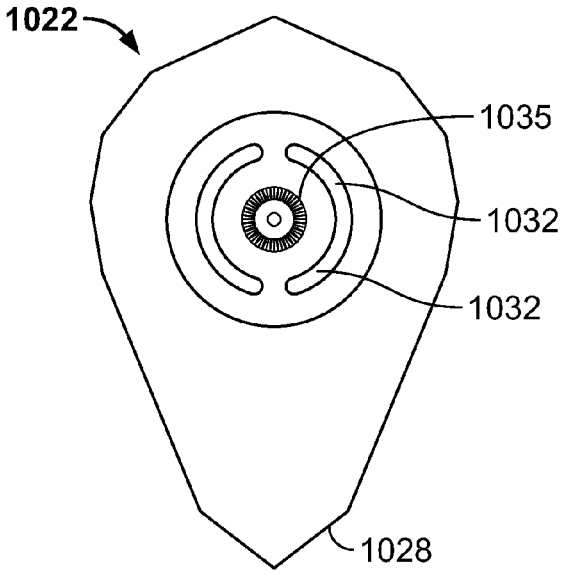
FIG. 35 is a bottom view of the first mounting member of the assembly of FIG. 34.

Since most Velcro materials (or other mechanical adhesives) have a certain thickness, the exemplary mounting members of the present disclosure could include a recessed portion or the like (e.g., a circle, square, polygonal or other shaped recessed indentation on the bottom surface of the mounting member—similar to the circle shown on the bottom of member 1022 in FIG. 35) for the purposes of incorporating at least a portion of the thickness of the Velcro (or other) mechanical adhesive into the shaped recessed indentation so as to allow the non-recessed bottom-most surface of the concave mounting member to directly contact the top standing surface 13 of the skateboard deck 11, while the component sides of the Velcro or other mechanism is concealed inside the indentation(s).

As such, the present disclosure provides for a mounting member where a two part mechanical adhesive system (Velcro or other) is used allow the mounting member to be attached, detached, and re-attached again by way of contacting the mechanically adhesive sides, and where the traditional adhesive portion of the two part system which adheres to a surface (13) of the board 11 and the contact surface of the mounting member can be attached, detached, and replaced.

In other embodiments of the present disclosure, it is noted that the mounting members 22 (etc.) could be mounted to deck 11 (or 111) by utilizing tape (e.g., double-side tape) or the like (e.g., in lieu of or in addition to utilizing fasteners 31/holes 30 and/or moldable/curable materials and/or the other mounting methods disclosed herein). For example, so as to be re-useable by the user/rider in certain embodiments, the mounting member can utilize double-sided tape to create a bond between the (bottom) contact surface of the mounting member and a surface (13) of the board 11. Since exemplary double-sided tape can be removed and re-applied, this offers an advantage over traditional glue-style adhesive which generally can not be re-applied.

As such, the present disclosure provides for a mounting member where a single, or multi-sided, adhesive tape is used to attach/mount the mounting member to a surface (13) of the board 11, in addition to or instead of another method of attachment/mounting.

In other embodiments of the present disclosure and referring back to FIG. 1, it is noted that instead of using the holes 30 (e.g., truck 14, 16 mounting drill holes/pattern), the mounting member 22 (or other mounting members of the present disclosure) can be mounted (via fasteners 31) to deck 11 by utilizing one or more a threaded inserts (e.g., metal inserts, or other material suitable to maintain threads) that are embedded into the skateboard deck 11.

For example, during the manufacturing process using the threaded inserts (e.g., metal inserts), the board deck (11) is machined to remove material and create a press fitting that allows the threaded insert to be pressed into the board, or board core. Glue, or other adhesives may be used to fix the threaded insert in place or in some embodiments there may be an additional layer of fiberglass, or other top layer material, applied on top of the board core creating a surface layer that holds the insert in place. In this case the threads would be exposed by again machining this top layer surface to expose the threaded insert and allow for mounting. In exemplary embodiments and with use with mounting members (22), the threaded inserts can be placed anywhere along the surface (13) of the a board (11) to enable the user to releasably mount a mounting member (22) without needing to drill a hole (30/30') completely through the board (11), or without need to use the truck mounting holes (30) for mounting of the member (22).

As such, the present disclosure provides for a board/deck with threaded metal inserts embedded in a surface of the board/deck, the top of the threaded inserts being substantially flush with that board surface, or below the top surface of that board but with threads exposed, and that can be utilized for the purpose of mounting/securing a mounting member to the board/deck (e.g., in order to change the contours of that surface or protect the board/deck in some way).

In alternative embodiments, it is noted that the threaded (metal) inserts can also be embedded/machined/molded into the mounting members (e.g., member 22) themselves, thereby allowing the inverse mounting option to take place. For example, user could screw through the board/deck (11) (e.g., which has been pre-drilled) with the screw (31) and then connect/secure with the threaded inserts of the mounting member, thereby attaching the mounting member to the board/deck 11. As such, the present disclosure provides for a mounting member having a threaded (metal) insert metal (e.g., press fit or molded into its base contact surface), so that a board with a drill hole (e.g., 30') through it may be attached to the mounting member by screw or bolt (31) from the opposing side (e.g., 15).

In other embodiments of the present disclosure, it is noted that the exemplary mounting members (e.g., similar to member 22, etc.) may be fabricated (e.g., extruded, printed, and/or 3D printed onto the board/deck 11) via an additive process, layer by layer, where plastic, metal, or other material is fused together and cools or cures as a result of the process. This thereby can create the desired contoured mounting member while creating a mechanical bond on the desired contact surface of the board/deck which holds that new contoured mounting member in place.

In some embodiments, the board/deck 11 surface is first coated with an adhesive of some kind to assist in mechanical bonding (however in other embodiments this is not necessary). Extruded mounting members may be removed from the surface of the board/deck and re-adhered via a different adhesive process to the same or a different board.

As such, the present disclosure provides for a skateboard assembly having one more additive-based mounting members added after pressing/production is completed. The additive-based mounting members can be added to an outward facing surface of the board/deck in order to change the shape and/or contour of that board/deck surface. Such exemplary additive based members can be printed, extruded, or otherwise built up layer by layer via a progressive additive process where material is added or joined to the board/deck surface, layer by layer, and where the material/process of the additive based members incorporates some form of curing or cooling that mechanically bonds the additional contours or members/surfaces directly to the board/deck surface (e.g., either with the help of an additional layer of spray adhesive or without).

Whereas the disclosure has been described principally in connection with advantageous skateboard assemblies or mounting member assemblies (e.g., advantageous skateboard mounting member assemblies) for recreational, domestic and/or commercial uses/purposes, such description has been utilized only for purposes of disclosure and is not intended as limiting the disclosure. To the contrary, it is to be recognized that the disclosed mounting member assemblies are capable of use for other sports and/or uses/purposes (e.g., as adjustable mounting member assemblies for surfboards, snowboards, wakeboards, and/or other board sports or vehicles or the like, etc.).

Although the systems and methods of the present disclosure have been described with reference to exemplary embodiments thereof, the present disclosure is not limited to such exemplary embodiments and/or implementations. Rather, the systems and methods of the present disclosure are susceptible to many implementations and applications, as will be readily apparent to persons skilled in the art from the disclosure hereof. The present disclosure expressly encompasses such modifications, enhancements and/or variations of the disclosed embodiments. Since many changes could be made in the above construction and many widely different embodiments of this disclosure could be made without departing from the scope thereof, it is intended that all matter contained in the drawings and specification shall be interpreted as illustrative and not in a limiting sense. Additional modifications, changes, and substitutions are intended in the foregoing disclosure. Accordingly, it is appropriate that the appended claims be construed broadly and in a manner consistent with the scope of the disclosure.

What is claimed is:

1. A skateboard mounting member assembly comprising:

a first mounting member having a contoured top surface, the first mounting member configured and dimensioned to he mounted to at least a portion of a top side of a skateboard deck in a first position;

a second mounting member having a top surface, the second mounting member configured and dimensioned to be mounted to: (i) the first mounting member, and (ii) the top side of the skateboard deck in the first position;

wherein the contoured top surface of the first mounting member is configured and dimensioned to provide a user a surface that the user can utilize to place or position a foot directly onto or above, with a bottom side of the user's foot contacting the contoured top surface of the mounted first mounting member during use of the skateboard deck;

wherein the top surface of the second mounting member is configured and dimensioned to provide a user a surface that the user can utilize to place or position a foot directly onto or above, with a bottom side of the user's foot contacting the top surface of the mounted second mounting member during use of the skateboard deck;

wherein the first and second mounting members each include mating locking teeth, the mating locking teeth of the first and second mounting members configured and dimensioned to lockingly engage one another when the first and second mounting members are mounted to one another, the lockingly engaged. first mounting member thereby prevented from rotationally moving; and wherein after the mating locking teeth of the first and second mounting members engage one another, the first and second mounting members are configured to be disengaged from one another where the mating locking teeth of the first and second mounting members are disengaged from one another, which thereby allows a user to move the first or second mounting member relative to one another, and thereafter allows the user to lockingly re-engage the mating locking teeth of the first and second mounting members to one another.

2. The assembly of claim 1, wherein the second mounting member includes a fastener member that is configured and dimensioned to be mounted to a truck assembly, the truck assembly mounted to a bottom side of the skateboard deck.

3. The assembly of claim 1, wherein the second mounting member includes an elongated slot therethrough, the elongated slot configured and dimensioned to allow a fastener member to pass therethrough to allow the second mounting member to be mounted to at least a portion of the top side of the skateboard deck in the first position; and wherein the elongated slot is configured to allow a user to loosen the mounted fastener member while the fastener member remains at least in part within the elongated slot and thereafter allow the first and second mounting members to be moved to a second position relative to the top side of the skateboard deck and relative to the loosened fastener member within the elongated slot;

wherein the first position of the mounted first and second mounting members is different than the second position of the mounted first and second mounting members on the top side of the skateboard deck.

4. The assembly of claim 1, wherein the first mounting member includes, at least in part, a moldable and curable material.

5. The assembly of claim 1, wherein after the first and second mounting members are mounted to at least a portion of the top side of the skateboard deck, the first and second mounting members are removable relative to the top side of the skateboard deck.

6. The assembly of claim 1, wherein the contoured top surface of the first mounting member rises and slopes upwardly from at least a portion of art outer edge of the first mounting member and extends to a top surface of the first mounting member, the top surface including a substantially planar portion.

7. A mounting method comprising:

providing a skateboard deck having a top side;

providing a first mounting member having a contoured top surface;

mounting the first mounting member to the top side of the skateboard deck in a first position;

providing a second mounting member having a top surface;

mounting the second mounting member to: (i) the first mounting member, and (ii) the top side of the skateboard deck in the first position;

wherein the contoured top surface of the first mounting member is configured and dimensioned to provide a user a surface that the user can utilize to place or position a foot directly onto or above, with a bottom side of the user's foot contacting the contoured top surface of the mounted first mounting member during use of the skateboard deck;

wherein the top surface of the second mounting member is configured and dimensioned to provide a user a surface that the user can utilize to place or position a foot directly onto or above, with a bottom side of the user's foot contacting the top surface of the mounting second mounting member during use of the skateboard deck;

wherein the first and second mounting members each include mating locking teeth, the mating locking teeth of the first and second mounting members configured and dimensioned to lockingly engage one another when the first and second mounting members are mounted to one another, the lockingly engaged first mounting member thereby prevented from rotationally moving; and wherein after the mating locking teeth of the first and second mounting members engage one another, the first and second mounting members are configured to be disengaged from one another where the mating locking teeth of the first and second mounting members are disengaged from one another, which thereby allows a user to move the first or second mounting member relative to one another, and thereafter allows the user to lockingly re-engage the mating locking teeth of the first and second mounting members to one another.

8. The method of claim 7, wherein the second mounting member includes a fastener member that is mounted to a truck assembly, the truck assembly mounted to a bottom side of the skateboard deck.

9. The method of clam 7 wherein the contoured top surface of the first mounting member rises and slopes upwardly from at least a portion of an outer edge of the first mounting member and extends to a top surface of the first mounting member, the top surface including a substantially planar portion.

10. The method of claim 7, wherein the first mounting member includes, at least in part, a moldable and curable material.

11. The method of claim 7, wherein after the first and second mounting members are mounted to at least a portion of the top side of the skateboard deck, the first and second mounting members are removable relative to the top side of the skateboard deck.

* * * * *